US011514743B2

(12) United States Patent
Adams et al.

(10) Patent No.: US 11,514,743 B2
(45) Date of Patent: Nov. 29, 2022

(54) SYSTEMS, METHODS AND DEVICES FOR COIN PROCESSING AND COIN RECYCLING

(71) Applicant: Cummins-Allison Corp., Mount Prospect, IL (US)

(72) Inventors: Thomas P. Adams, Oconomowoc, WI (US); Glenn S. Gordon, Buffalo Grove, IL (US); Matthew J. Bochnak, Mt. Prospect, IL (US); Curtis W. Hallowell, Palatine, IL (US); John R. Blake, St. Charles, IL (US); Mikhail B. Sobolevsky, Streamwood, IL (US)

(73) Assignee: Cummins-Allison Corp., Mount Prospect, IL (US)

( * ) Notice: Subject to any disclaimer, the term of this patent is extended or adjusted under 35 U.S.C. 154(b) by 0 days.

(21) Appl. No.: 16/853,618

(22) Filed: Apr. 20, 2020

(65) Prior Publication Data

US 2020/0250914 A1 Aug. 6, 2020

Related U.S. Application Data

(63) Continuation of application No. 16/028,068, filed on Jul. 5, 2018, now Pat. No. 10,629,020, which is a (Continued)

(51) Int. Cl.
*G07D 3/06* (2006.01)
*G07D 9/00* (2006.01)
(Continued)

(52) U.S. Cl.
CPC ..... *G07D 3/06* (2013.01); *G07D 1/00* (2013.01); *G07D 3/128* (2013.01); *G07D 3/14* (2013.01);
(Continued)

(58) Field of Classification Search
CPC ..... G07D 3/06; G07D 5/00; G07D 9/008; G07D 3/14; G07D 9/002; G07D 3/16;
(Continued)

(56) References Cited

U.S. PATENT DOCUMENTS 1,099,706 A 6/1914 Lindeen
2,570,920 A 10/1951 Clough et al.
(Continued)

FOREIGN PATENT DOCUMENTS

CA 2143943 A1 3/1994
CA 2189330 A1 11/1995
(Continued)

OTHER PUBLICATIONS

English Translation of JP003463730B2 (Year: 2003).*
(Continued)

*Primary Examiner* — Jeffrey A Shapiro

(57) ABSTRACT

Currency processing systems, coin processing machines, coin sorting and recycling assemblies, and methods of making and methods of using the same are presented herein. A currency processing system is disclosed which includes a housing with a coin input area for receiving coins and coin receptacles for stowing processed coins. A disk-type coin processing unit includes a rotatable disk for imparting motion to input coins, and a sorting head for separating and discharging coins from exit stations. An automated coin chute receives coins from one of the exit stations. The automated coin chute includes a movable diverter plate that selectively transitions between a first position, whereby coins received from the exit station of the disk-type coin processing unit are redirected through a coin-recycling output passage to a coin-recycling receptacle, and a second
(Continued)

position, whereby coins received from the exit station are redirected through a coin-depositing output passage to a coin-depositing receptacle.

20 Claims, 36 Drawing Sheets

Related U.S. Application Data continuation of application No. 15/842,314, filed on Dec. 14, 2017, now Pat. No. 10,043,333, which is a continuation of application No. 15/230,123, filed on Aug. 5, 2016, now Pat. No. 9,875,593.

(60) Provisional application No. 62/202,571, filed on Aug. 7, 2015.

(51) Int. Cl.

| | |
|---|---|
| ***G07D 3/14*** | (2006.01) |
| ***G07D 5/00*** | (2006.01) |
| ***G07D 11/20*** | (2019.01) |
| ***G07D 11/235*** | (2019.01) |
| ***G07D 11/22*** | (2019.01) |
| ***G07D 3/12*** | (2006.01) |
| ***G07D 1/00*** | (2006.01) |
| ***G07D 3/16*** | (2006.01) |

(52) U.S. Cl.
CPC ..... *G07D 3/16* (2013.01); *G07D 5/00* (2013.01); *G07D 9/002* (2013.01); *G07D 9/008* (2013.01); *G07D 11/20* (2019.01); *G07D 11/22* (2019.01); *G07D 11/235* (2019.01)

(58) Field of Classification Search
CPC ..... G07D 3/128; G07D 1/00; G07D 11/12; G07D 11/125; G07D 11/20; G07D 11/22; G07D 11/23; G07D 11/235
See application file for complete search history.

(56) References Cited

U.S. PATENT DOCUMENTS 2,669,998 A 2/1954 Buchholz
2,750,949 A 6/1956 Kulo et al.
2,835,260 A 5/1958 Buchholz
2,865,561 A 12/1958 Rosapepe
3,132,654 A 5/1964 Adams
3,376,970 A 4/1968 Roseberg
3,771,583 A 11/1973 Bottemiller
3,778,595 A 12/1973 Hatanaka et al.
3,851,755 A 12/1974 Hull et al.
3,916,922 A 11/1975 Prumm
3,998,237 A 12/1976 Kressin et al.
3,998,379 A 12/1976 Myers et al.
4,050,218 A 9/1977 Call
4,059,122 A 11/1977 Kinoshita
4,075,460 A 2/1978 Gorgens
4,124,111 A 11/1978 Hayashi
4,150,740 A 4/1979 Douno
4,166,945 A 9/1979 Inoyama et al.
4,172,462 A 10/1979 Uchida et al.
4,179,685 A 12/1979 OMaley
4,179,723 A 12/1979 Spencer
4,184,366 A 1/1980 Butler
4,197,986 A 4/1980 Nagata
4,208,549 A 6/1980 Polillo et al.
4,228,812 A 10/1980 Marti
4,232,295 A 11/1980 McConnell
4,234,003 A 11/1980 Ristvedt et al.
4,249,552 A 2/1981 Margolin et al.
4,251,867 A 2/1981 Uchida et al.
4,286,703 A 9/1981 Schuller et al.
RE30,773 E 10/1981 Glaser et al.
4,310,885 A 1/1982 Azcua et al.
4,317,957 A 3/1982 Sendrow
4,341,951 A 7/1982 Benton
4,355,369 A 10/1982 Garvin
4,360,034 A 11/1982 Davila et al.
4,369,442 A 1/1983 Werth et al.
4,380,316 A 4/1983 Glinka et al.
4,383,540 A 5/1983 De Meyer et al.
4,385,285 A 5/1983 Horst et al.
4,412,292 A 10/1983 Sedam et al.
4,416,299 A 11/1983 Bergman
4,417,136 A 11/1983 Rushby et al.
4,423,316 A 12/1983 Sano et al.
4,434,359 A 2/1984 Watanabe
4,436,103 A 3/1984 Dick
4,454,414 A 6/1984 Benton
4,474,197 A 10/1984 Kinoshita et al.
4,488,116 A 12/1984 Plesko
4,531,531 A 7/1985 Johnson et al.
4,543,969 A 10/1985 Rasmussen
4,549,561 A 10/1985 Johnson et al.
4,556,140 A 12/1985 Okada
4,558,711 A 12/1985 Yoshiaki et al.
4,564,036 A 1/1986 Ristvedt
4,570,655 A 2/1986 Raterman
4,594,664 A 6/1986 Hashimoto
4,602,332 A 7/1986 Hirose et al.
4,607,649 A 8/1986 Taipale et al.
4,620,559 A 11/1986 Childers et al.
4,641,239 A 2/1987 Takesako
4,674,260 A 6/1987 Rasmussen et al.
4,681,128 A 7/1987 Ristvedt et al.
4,705,154 A 11/1987 Masho et al.
4,718,218 A 1/1988 Ristvedt
4,731,043 A 3/1988 Ristvedt et al.
4,733,765 A 3/1988 Watanabe
4,749,074 A 6/1988 Ueki et al.
4,753,624 A 6/1988 Adams et al.
4,753,625 A 6/1988 Okada
4,765,464 A 8/1988 Ristvedt
4,766,548 A 8/1988 Cedrone et al.
4,775,353 A 10/1988 Childers et al.
4,775,354 A 10/1988 Rasmussen et al.
4,778,983 A 10/1988 Ushikubo
4,803,347 A 2/1989 Sugahara et al.
4,804,830 A 2/1989 Miyagisima et al.
4,812,629 A 3/1989 ONeil et al.
4,839,505 A 6/1989 Bradt et al.
4,840,290 A 6/1989 Nakamura et al.
4,844,369 A 7/1989 Kanayachi
4,848,556 A 7/1989 Shah et al.
4,863,414 A 9/1989 Ristvedt et al.
4,883,158 A 11/1989 Kobayashi et al.
4,884,212 A 11/1989 Stutsman
4,900,909 A 2/1990 Nagashima et al.
4,908,516 A 3/1990 West
4,921,463 A 5/1990 Primdahl et al.
4,936,435 A 6/1990 Griner
4,953,086 A 8/1990 Fukatsu
4,954,697 A 9/1990 Kokubun et al.
4,964,495 A 10/1990 Rasmussen
4,966,570 A 10/1990 Ristvedt et al.
4,970,655 A 11/1990 Winn et al.
4,971,187 A 11/1990 Furuya et al.
4,988,849 A 1/1991 Sasaki et al.
4,992,647 A 2/1991 Konishi et al.
4,995,848 A 2/1991 Goh
5,009,627 A 4/1991 Rasmussen
5,010,238 A 4/1991 Kadono et al.
5,010,485 A 4/1991 Bigari
5,011,455 A 4/1991 Rasmussen
5,022,889 A 6/1991 Ristvedt et al.
5,025,139 A 6/1991 Halliburton, Jr.
5,026,320 A 6/1991 Rasmussen
5,031,098 A 7/1991 Miller et al.
5,033,602 A 7/1991 Saarinen et al.
5,039,848 A 8/1991 Stoken

(56) References Cited

U.S. PATENT DOCUMENTS 5,055,086 A 10/1991 Raterman et al.
5,055,657 A 10/1991 Miller et al.
5,056,643 A 10/1991 Kirberg
5,064,999 A 11/1991 Okamoto et al.
5,067,928 A 11/1991 Harris
5,080,633 A 1/1992 Ristvedt et al.
5,091,713 A 2/1992 Horne et al.
5,104,353 A 4/1992 Ristvedt et al.
5,105,601 A 4/1992 Horiguchi et al.
5,106,338 A 4/1992 Rasmussen et al.
5,111,927 A 5/1992 Schulze, Jr.
5,114,381 A 5/1992 Ueda et al.
5,120,945 A 6/1992 Nishibe et al.
5,123,873 A 6/1992 Rasmussen
5,129,205 A 7/1992 Rasmussen
5,135,435 A 8/1992 Rasmussen
5,140,517 A 8/1992 Nagata et al.
5,141,443 A 8/1992 Rasmussen et al.
5,141,472 A 8/1992 Todd et al.
5,145,455 A 9/1992 Todd
5,146,067 A 9/1992 Sloan et al.
5,154,272 A 10/1992 Nishiumi et al.
5,163,866 A 11/1992 Rasmussen
5,163,867 A 11/1992 Rasmussen
5,163,868 A 11/1992 Adams et al.
5,167,313 A 12/1992 Dobbins et al.
5,175,416 A 12/1992 Mansvelt et al.
5,176,565 A 1/1993 Ristvedt et al.
5,179,517 A 1/1993 Sarbin et al.
5,183,142 A 2/1993 Latchinian et al.
5,184,709 A 2/1993 Nishiumi et al.
5,194,037 A 3/1993 Jones et al.
5,197,919 A 3/1993 Geib et al.
5,205,780 A 4/1993 Rasmussen
5,207,784 A 5/1993 Schwartzendruber
5,209,696 A 5/1993 Rasmussen et al.
5,236,071 A 8/1993 Lee
5,243,174 A 9/1993 Veeneman et al.
5,251,738 A 10/1993 Dabrowski
5,252,811 A 10/1993 Henochowicz et al.
5,253,167 A 10/1993 Yoshida et al.
5,259,491 A 11/1993 Ward, II
5,263,566 A 11/1993 Nara et al.
5,265,874 A 11/1993 Dickinson et al.
5,268,561 A 12/1993 Kimura et al.
5,277,651 A 1/1994 Rasmussen et al.
5,282,127 A 1/1994 Mii
5,286,226 A 2/1994 Rasmussen
5,286,954 A 2/1994 Sato et al.
5,291,003 A 3/1994 Avnet et al.
5,291,560 A 3/1994 Daugman
5,293,981 A 3/1994 Abe et al.
5,297,030 A 3/1994 Vassigh et al.
5,297,598 A 3/1994 Rasmussen
5,297,986 A 3/1994 Ristvedt et al.
5,299,977 A 4/1994 Mazur et al.
5,302,811 A 4/1994 Fukatsu
5,324,922 A 6/1994 Roberts
5,326,104 A 7/1994 Pease et al.
5,370,575 A 12/1994 Geib et al.
5,372,542 A 12/1994 Geib et al.
5,374,814 A 12/1994 Kako et al.
5,379,344 A 1/1995 Larsson et al.
5,379,875 A 1/1995 Shames et al.
5,382,191 A 1/1995 Rasmussen
5,390,776 A 2/1995 Thompson
5,401,211 A 3/1995 Geib et al.
5,404,986 A 4/1995 Hossfield et al.
5,410,590 A 4/1995 Blood et al.
RE34,934 E 5/1995 Raterman et al.
5,425,669 A 6/1995 Geib et al.
5,429,550 A 7/1995 Mazur et al.
5,440,108 A 8/1995 Tran et al.
5,443,419 A 8/1995 Adams et al.
5,450,938 A 9/1995 Rademacher
5,453,047 A 9/1995 Mazur et al.
5,458,285 A 10/1995 Remien
5,468,182 A 11/1995 Geib
5,470,079 A 11/1995 LeStrange et al.
5,474,495 A 12/1995 Geib et al.
5,474,497 A 12/1995 Jones et al.
5,480,348 A 1/1996 Mazur et al.
5,489,237 A 2/1996 Geib et al.
5,500,514 A 3/1996 Veeneman et al.
5,501,631 A 3/1996 Mennie et al.
5,507,379 A 4/1996 Mazur et al.
5,514,034 A 5/1996 Jones et al.
5,520,577 A 5/1996 Rasmussen
5,531,309 A 7/1996 Kloss et al.
5,538,468 A 7/1996 Ristvedt et al.
5,542,880 A 8/1996 Geib et al.
5,542,881 A 8/1996 Geib
5,553,320 A 9/1996 Matsuura et al.
5,559,887 A 9/1996 Davis et al.
5,564,546 A 10/1996 Molbak et al.
5,564,974 A 10/1996 Mazur et al.
5,564,978 A 10/1996 Jones et al.
5,570,465 A 10/1996 Tsakanikas
5,573,457 A 11/1996 Watts et al.
5,584,758 A 12/1996 Geib
5,592,377 A 1/1997 Lipkin
5,602,933 A 2/1997 Blackwell et al.
5,615,625 A 4/1997 Cassidy et al.
5,620,079 A 4/1997 Molbak
5,623,547 A 4/1997 Jones et al.
5,625,562 A 4/1997 Veeneman et al.
5,630,494 A 5/1997 Strauts
5,641,050 A 6/1997 Smith et al.
5,650,605 A 7/1997 Morioka et al.
5,650,761 A 7/1997 Gomm et al.
5,652,421 A 7/1997 Veeneman et al.
5,665,952 A 9/1997 Ziarno
5,679,070 A 10/1997 Ishida et al.
5,684,597 A 11/1997 Hossfield et al.
5,696,366 A 12/1997 Ziarno
5,743,373 A 4/1998 Strauts
5,746,299 A 5/1998 Molbak et al.
5,774,874 A 6/1998 Veeneman et al.
5,782,686 A 7/1998 Geib et al.
5,799,767 A 9/1998 Molbak
5,813,510 A 9/1998 Rademacher
5,823,315 A 10/1998 Hoffman et al.
5,830,054 A * 11/1998 Petri ..... G07D 1/04 453/5
5,838,812 A 11/1998 Pare, Jr. et al.
5,842,188 A 11/1998 Ramsey et al.
5,842,916 A 12/1998 Gerrity et al.
5,850,076 A 12/1998 Morioka et al.
5,854,581 A 12/1998 Mori et al.
5,865,673 A * 2/1999 Geib ..... G07D 3/128 194/346
5,873,446 A * 2/1999 Wei ..... G07D 11/125 194/350
5,875,879 A 3/1999 Hawthorn
5,880,444 A 3/1999 Shibata et al.
5,892,211 A 4/1999 Davis et al.
5,892,827 A 4/1999 Beach et al.
5,909,793 A 6/1999 Beach et al.
5,909,794 A 6/1999 Molbak et al.
5,913,399 A 6/1999 Takemoto et al.
5,918,748 A 7/1999 Clark et al.
5,940,623 A 8/1999 Watts et al.
5,941,364 A 8/1999 Wei
5,944,162 A 8/1999 Filiberti
5,944,600 A 8/1999 Zimmermann
5,944,601 A 8/1999 Hayashi et al.
5,951,476 A 9/1999 Beach
5,957,262 A 9/1999 Molbak et al.
5,988,348 A 11/1999 Martin et al.
5,995,949 A 11/1999 Morioka et al.
5,997,395 A 12/1999 Geib et al.
6,017,270 A 1/2000 Ristvedt et al.
6,021,883 A 2/2000 Casanova et al.
6,032,859 A 3/2000 Muehlberger et al.

(56) References Cited

U.S. PATENT DOCUMENTS 6,039,644 A 3/2000 Geib et al.
6,039,645 A 3/2000 Mazur
6,042,470 A 3/2000 Geib et al.
6,047,807 A 4/2000 Molbak
6,047,808 A 4/2000 Neubarth et al.
6,056,104 A 5/2000 Neubarth et al.
6,068,194 A 5/2000 Mazur
6,080,056 A 6/2000 Karlsson
6,082,519 A 7/2000 Martin et al.
6,086,471 A 7/2000 Zimmermann
6,095,313 A 8/2000 Molbak et al.
6,116,402 A 9/2000 Beach et al.
6,131,625 A 10/2000 Casanova et al.
6,139,418 A 10/2000 Geib et al.
6,142,285 A 11/2000 Panzeri et al.
6,145,738 A 11/2000 Stinson et al.
6,154,879 A 11/2000 Pare, Jr. et al.
6,168,001 B1 1/2001 Davis
6,171,182 B1 1/2001 Geib et al.
6,174,230 B1 1/2001 Gerrity et al.
6,196,371 B1 3/2001 Martin et al.
6,196,913 B1 3/2001 Geib et al.
6,202,006 B1 3/2001 Scott
6,213,277 B1 * 4/2001 Blad ..... G07D 5/04 194/350
6,230,928 B1 5/2001 Hanna et al.
6,264,545 B1 7/2001 Magee et al.
6,308,887 B1 10/2001 Korman et al.
6,318,536 B1 11/2001 Korman et al.
6,318,537 B1 11/2001 Jones et al.
6,338,007 B1 * 1/2002 Broadfield ..... A61G 12/001 221/123
6,349,972 B1 2/2002 Geiger et al.
6,386,323 B1 5/2002 Ramachandran et al.
6,412,620 B1 7/2002 Imura
6,431,342 B1 8/2002 Schwartz
6,438,230 B1 8/2002 Moore
6,456,928 B1 9/2002 Johnson
6,471,030 B1 10/2002 Neubarth et al.
6,474,548 B1 11/2002 Montross et al.
6,484,863 B1 11/2002 Molbak
6,484,884 B1 11/2002 Gerrity et al.
6,494,776 B1 12/2002 Molbak
6,499,277 B1 12/2002 Warner et al.
6,503,138 B2 1/2003 Spoehr et al.
6,520,308 B1 2/2003 Martin et al.
6,522,772 B1 2/2003 Morrison et al.
6,547,131 B1 4/2003 Foodman et al.
6,552,781 B1 4/2003 Rompel et al.
6,554,185 B1 4/2003 Montross et al.
6,579,165 B2 6/2003 Kuhlin et al.
6,581,042 B2 6/2003 Pare, Jr. et al.
6,602,125 B2 8/2003 Martin
6,609,604 B1 8/2003 Jones et al.
6,612,921 B2 9/2003 Geib et al.
6,637,576 B1 10/2003 Jones et al.
6,640,956 B1 11/2003 Zwieg et al.
6,644,696 B2 11/2003 Brown et al.
6,652,380 B1 11/2003 Luciano
6,655,585 B2 12/2003 Shinn
6,659,259 B2 12/2003 Knox et al.
6,662,166 B2 12/2003 Pare, Jr. et al.
6,663,675 B2 12/2003 Blake et al.
6,666,318 B2 12/2003 Gerrity et al.
6,719,121 B2 4/2004 Alexander et al.
6,755,730 B2 6/2004 Geib et al.
6,758,316 B2 7/2004 Molbak
6,761,308 B1 7/2004 Hanna et al.
6,766,892 B2 7/2004 Martin et al.
6,783,452 B2 8/2004 Hino et al.
6,786,398 B1 9/2004 Stinson et al.
6,854,581 B2 2/2005 Molbak
6,854,640 B2 2/2005 Peklo
6,863,168 B1 3/2005 Gerrity et al.
6,892,871 B2 5/2005 Strauts et al.
6,896,118 B2 5/2005 Jones et al.
6,928,546 B1 8/2005 Nanavati et al.
6,950,810 B2 9/2005 Lapsley et al.
6,953,150 B2 10/2005 Shepley et al.
6,957,746 B2 10/2005 Martin et al.
6,966,417 B2 11/2005 Peklo et al.
6,976,570 B2 12/2005 Molbak
6,988,606 B2 1/2006 Geib et al.
6,991,530 B2 1/2006 Hino et al.
7,004,831 B2 2/2006 Hino et al.
7,014,029 B2 3/2006 Winters
7,014,108 B2 3/2006 Sorenson et al.
7,017,729 B2 3/2006 Gerrity et al.
7,018,286 B2 3/2006 Blake et al.
7,028,827 B1 4/2006 Molbak et al.
7,036,651 B2 5/2006 Tam et al.
7,083,036 B2 8/2006 Adams
7,113,929 B1 9/2006 Beach et al.
7,131,580 B2 11/2006 Molbak
7,149,336 B2 12/2006 Jones et al.
7,152,727 B2 12/2006 Waechter
7,158,662 B2 1/2007 Chiles
7,188,720 B2 3/2007 Geib et al.
7,213,697 B2 5/2007 Martin et al.
7,243,773 B2 7/2007 Bochonok et al.
7,269,279 B2 9/2007 Chiles
7,303,119 B2 12/2007 Molbak
7,331,521 B2 2/2008 Sorenson et al.
7,337,890 B2 3/2008 Bochonok et al.
7,427,230 B2 9/2008 Blake et al.
7,438,172 B2 10/2008 Long et al.
7,464,802 B2 12/2008 Gerrity et al.
7,500,568 B2 3/2009 Cousin
7,520,374 B2 4/2009 Martin et al.
7,551,764 B2 6/2009 Chiles et al.
7,552,810 B2 6/2009 Mecklenburg
7,580,859 B2 8/2009 Economy et al.
7,604,107 B2 10/2009 Richard et al.
7,654,450 B2 2/2010 Mateen et al.
7,658,270 B2 2/2010 Bochonok et al.
7,735,125 B1 6/2010 Alvarez et al.
7,743,902 B2 6/2010 Wendell et al.
7,778,456 B2 8/2010 Jones et al.
7,819,308 B2 10/2010 Osterberg et al.
7,874,478 B2 1/2011 Molbak
7,886,890 B2 2/2011 Blake et al.
7,931,304 B2 4/2011 Brown et al.
7,946,406 B2 5/2011 Blake et al.
7,949,582 B2 5/2011 Mennie et al.
7,963,382 B2 6/2011 Wendell et al.
7,980,378 B2 7/2011 Jones et al.
8,023,715 B2 9/2011 Jones et al.
8,042,732 B2 10/2011 Blake et al.
8,229,821 B2 7/2012 Mennie et al.
8,346,610 B2 1/2013 Mennie et al.
8,352,322 B2 1/2013 Mennie et al.
8,360,224 B2 * 1/2013 Park ..... G07F 19/205 902/13
8,393,455 B2 3/2013 Blake et al.
8,443,958 B2 5/2013 Blake et al.
RE44,252 E 6/2013 Jones et al.
8,469,173 B2 * 6/2013 Inuki ..... G07D 3/14 194/217
8,523,641 B2 9/2013 Kuykendall et al.
8,545,295 B2 10/2013 Blake et al.
8,602,200 B2 12/2013 Blake
8,607,957 B2 12/2013 Blake et al.
8,616,359 B2 12/2013 Bochonok et al.
RE44,689 E 1/2014 Wendell et al.
8,684,159 B2 4/2014 Blake
8,684,160 B2 4/2014 Hallowell et al.
8,701,860 B1 4/2014 Blake et al.
8,950,566 B2 2/2015 Hallowell et al.
8,959,029 B2 2/2015 Jones et al.
9,092,924 B1 7/2015 Rasmussen et al.
9,330,515 B1 5/2016 Rasmussen et al.
9,384,614 B2 7/2016 Nagoya et al.
9,430,893 B1 8/2016 Blake et al.
9,437,069 B1 9/2016 Blake et al.

(56) References Cited

U.S. PATENT DOCUMENTS 9,501,885 B1 11/2016 Yacoubian et al.
9,508,208 B1 11/2016 Jagielinski et al.
9,633,500 B1 4/2017 Blake et al.
9,830,762 B1 11/2017 Blake et al.
9,870,668 B1 1/2018 Jagielinski et al.
9,875,593 B1 1/2018 Adams et al.
9,916,713 B1 3/2018 Yacoubian et al.
9,934,640 B2 4/2018 Blake et al.
10,043,333 B1 8/2018 Adams et al.
10,049,521 B1 8/2018 Blake et al.
10,068,406 B1 9/2018 Jagielinski et al.
10,089,812 B1 10/2018 Blake et al.
10,181,234 B2 1/2019 Rasmussen et al.
10,629,020 B1 4/2020 Adams et al.
10,685,523 B1 6/2020 Jagielinski
2001/0034203 A1 10/2001 Geib et al.
2001/0048025 A1 12/2001 Shinn
2002/0085745 A1 1/2002 Jones et al.
2002/0126885 A1 2/2002 Mennie et al.
2002/0065033 A1 5/2002 Geib et al.
2002/0069104 A1 6/2002 Beach et al.
2002/0074209 A1 6/2002 Karlsson
2002/0095587 A1 7/2002 Doyle et al.
2002/0107738 A1 8/2002 Beach et al.
2002/0130011 A1 9/2002 Casanova et al.
2002/0147588 A1 10/2002 Davis et al.
2002/0151267 A1 10/2002 Kuhlin et al.
2002/0174348 A1 11/2002 Ting
2002/0179401 A1 12/2002 Knox et al.
2003/0004878 A1 1/2003 Akutsu et al.
2003/0013403 A1 1/2003 Blake et al.
2003/0042110 A1 3/2003 Wilfong
2003/0081824 A1 5/2003 Mennie et al.
2003/0127299 A1 7/2003 Jones et al.
2003/0168309 A1 9/2003 Geib et al.
2003/0168310 A1 9/2003 Strauts et al.
2003/0182217 A1 9/2003 Chiles
2003/0190882 A1 10/2003 Blake et al.
2003/0230464 A1 12/2003 Deaville et al.
2003/0234153 A1 12/2003 Blake et al.
2004/0021898 A1 2/2004 Ashizaki
2004/0055902 A1 3/2004 Peklo
2004/0092222 A1 5/2004 Kowalczyk et al.
2004/0153406 A1 8/2004 Alarcon-Luther et al.
2004/0153421 A1 8/2004 Robinson
2004/0154899 A1 8/2004 Peklo et al.
2004/0173432 A1 9/2004 Jones
2004/0188221 A1 9/2004 Carter
2004/0195302 A1 10/2004 Washington et al.
2004/0199924 A1 10/2004 Ganesh et al.
2004/0200691 A1 10/2004 Geib et al.
2004/0238319 A1 12/2004 Hand et al.
2004/0238614 A1 12/2004 Yoshioka et al.
2004/0256197 A1 12/2004 Blake et al.
2005/0006197 A1 1/2005 Wendell et al.
2005/0035140 A1* 2/2005 Carter ..... G07G 1/0027 221/195
2005/0040007 A1 2/2005 Geib et al.
2005/0040225 A1 2/2005 Csulits et al.
2005/0045450 A1 3/2005 Geib et al.
2005/0067305 A1 3/2005 Bochonok et al.
2005/0073809 A1* 4/2005 Chang ..... G06F 1/184 361/679.32
2005/0077142 A1 4/2005 Tam et al.
2005/0086140 A1 4/2005 Ireland et al.
2005/0087425 A1 4/2005 Peklo
2005/0096986 A1 5/2005 Taylor et al.
2005/0098625 A1 5/2005 Walker et al.
2005/0108165 A1 5/2005 Jones et al.
2005/0109836 A1 5/2005 Ben-Aissa
2005/0121507 A1 6/2005 Brown et al.
2005/0124407 A1 6/2005 Rowe
2005/0150740 A1 7/2005 Finkenzeller et al.
2005/0156318 A1 7/2005 Douglas
2005/0205654 A1 9/2005 Carter
2005/0205655 A1 9/2005 Carter
2005/0228717 A1 10/2005 Gusler et al.
2005/0256792 A1 11/2005 Shimizu et al.
2006/0037835 A1 2/2006 Doran et al.
2006/0054455 A1 3/2006 Kuykendall et al.
2006/0054457 A1 3/2006 Long et al.
2006/0060363 A2 3/2006 Carter
2006/0064379 A1 3/2006 Doran et al.
2006/0065717 A1 3/2006 Hurwitz et al.
2006/0069654 A1 3/2006 Beach et al.
2006/0146839 A1 7/2006 Hurwitz et al.
2006/0148394 A1 7/2006 Blake et al.
2006/0149415 A1 7/2006 Richards
2006/0151285 A1 7/2006 String
2006/0154589 A1 7/2006 String
2006/0175176 A1 8/2006 Blake
2006/0182330 A1 8/2006 Chiles
2006/0196754 A1 9/2006 Bochonok et al.
2006/0205481 A1 9/2006 Dominelli
2006/0207856 A1 9/2006 Dean et al.
2006/0219519 A1 10/2006 Molbak et al.
2006/0253332 A1 11/2006 Dobbins
2006/0283685 A1 12/2006 Cousin
2007/0029159 A1* 2/2007 Quattrini ..... G07D 3/14 194/302
2007/0051582 A1 3/2007 Bochonok et al.
2007/0071302 A1 3/2007 Jones et al.
2007/0108015 A1 5/2007 Bochonok et al.
2007/0108267 A1 5/2007 Jonsson et al.
2007/0119681 A1* 5/2007 Blake ..... G07F 9/08 194/215
2007/0135965 A1* 6/2007 Nguyen ..... A61B 90/98 700/231
2007/0181676 A1 8/2007 Mateen et al.
2007/0187494 A1 8/2007 Hanna
2007/0221470 A1 9/2007 Mennie et al.
2007/0251800 A1 11/2007 Castleberry
2007/0269097 A1 11/2007 Chiles et al.
2007/0270997 A1 11/2007 Brumfield et al.
2008/0033829 A1 2/2008 Mennie et al.
2008/0044077 A1 2/2008 Mennie et al.
2008/0082207 A1* 4/2008 Sjostrom ..... G07D 9/02 700/231
2008/0135608 A1 6/2008 Ireland et al.
2008/0142335 A1* 6/2008 Nogin ..... G07F 9/02 700/12
2008/0220707 A1 9/2008 Jones et al.
2008/0223930 A1 9/2008 Rolland et al.
2009/0018959 A1 1/2009 Doran et al.
2009/0236200 A1 9/2009 Hallowell et al.
2009/0236201 A1 9/2009 Blake et al.
2009/0239459 A1 9/2009 Watts et al.
2009/0242626 A1 10/2009 Jones et al.
2009/0320106 A1 12/2009 Jones et al.
2010/0017017 A1* 1/2010 Adams ..... G07D 9/02 700/223
2010/0038419 A1 2/2010 Blake et al.
2010/0065623 A1 3/2010 Sauter
2010/0155193 A1 6/2010 Gunst et al.
2010/0198726 A1 8/2010 Doran et al.
2010/0234985 A1 9/2010 Shuren et al.
2010/0261421 A1 10/2010 Wendell et al.
2010/0276485 A1 11/2010 Jones et al.
2010/0327005 A1 12/2010 Martin et al.
2011/0098845 A1 4/2011 Blake et al.
2011/0099105 A1 4/2011 Mennie et al.
2011/0132718 A1* 6/2011 Park ..... G07F 19/20 194/206
2011/0259961 A1 10/2011 Folk et al.
2011/0270695 A1 11/2011 Jones et al.
2012/0012437 A1* 1/2012 Matsumoto ..... G07D 11/60 194/342
2012/0067950 A1 3/2012 Blake et al.
2012/0156976 A1* 6/2012 Blake ..... G07D 13/00 453/4
2012/0231721 A1* 9/2012 Starke ..... G07D 9/00 453/57

(56) References Cited

U.S. PATENT DOCUMENTS

| | | | | |
|---|---|---|---|---|
| 2013/0099442 | A1* | 4/2013 | Takada | B65H 43/02 271/219 |
| 2013/0163944 | A1* | 6/2013 | Krampotich | G02B 6/4455 385/135 |
| 2013/0178139 | A1 | 7/2013 | Hallowell et al. | |
| 2013/0199890 | A1 | 8/2013 | Blake | |
| 2013/0205723 | A1* | 8/2013 | Blake | G07D 9/00 53/473 |
| 2014/0263269 | A1* | 9/2014 | Veltrop | A47J 39/02 219/394 |
| 2015/0085447 | A1* | 3/2015 | Fredericksen | A47B 88/40 361/727 |
| 2015/0302678 | A1 | 10/2015 | Blake et al. | |
| 2015/0325069 | A1* | 11/2015 | Eckerdt | G07C 9/00896 340/5.61 |
| 2015/0327726 | A1* | 11/2015 | Betzold | A47J 39/02 99/483 |
| 2017/0169645 | A1* | 6/2017 | Nobuhara | H02H 3/207 |
| 2017/0324576 | A1* | 11/2017 | Jain | H04L 12/2803 |
| 2018/0108198 | A1 | 4/2018 | Rasmussen | |
| 2018/0108199 | A1 | 4/2018 | Blake et al. | |

FOREIGN PATENT DOCUMENTS

| | | | | |
|---|---|---|---|---|
| CA | 2235925 | A1 | 11/1995 | |
| FR | 2042254 | A5 | 2/1971 | |
| GB | 2035642 | A | 6/1980 | |
| GB | 2175427 | A | 11/1986 | |
| GB | 2198274 | A | 6/1988 | |
| GB | 2458387 | A | 9/2009 | |
| GB | 2468783 | A | 9/2010 | |
| GB | 2514241 | A | 11/2014 | |
| JP | 49-058899 | A | 6/1974 | |
| JP | 52-014495 | A | 2/1977 | |
| JP | 52-071300 | A | 6/1977 | |
| JP | 56-040992 | A | 4/1981 | |
| JP | 57-117080 | A | 7/1982 | |
| JP | 59-079392 | A | 5/1984 | |
| JP | 60-016271 | U | 2/1985 | |
| JP | 62-134168 | U | 8/1987 | |
| JP | 62-182995 | A | 8/1987 | |
| JP | 62-221773 | A | 9/1987 | |
| JP | 62-166562 | A | 10/1987 | |
| JP | 62-166562 | U | 10/1987 | |
| JP | 64-035683 | A | 2/1989 | |
| JP | 64-042789 | A | 2/1989 | |
| JP | 64-067698 | A | 3/1989 | |
| JP | 01-118995 | A | 5/1989 | |
| JP | 01-307891 | A | 12/1989 | |
| JP | 02-050793 | A | 2/1990 | |
| JP | 02-252096 | A | 10/1990 | |
| JP | 03-012776 | A | 1/1991 | |
| JP | 03-063795 | A | 3/1991 | |
| JP | 03-092994 | A | 4/1991 | |
| JP | 03-156673 | A | 7/1991 | |
| JP | 04-085695 | A | 3/1992 | |
| JP | 04-175993 | A | 6/1992 | |
| JP | 05-046839 | A | 2/1993 | |
| JP | 05-217048 | A | 8/1993 | |
| JP | 05-274527 | A | 10/1993 | |
| JP | 06-035946 | A | 2/1994 | |
| JP | 06-103285 | A | 4/1994 | |
| JP | 09-251566 | A | 9/1997 | |
| JP | 2002-117439 | A | 4/2002 | |
| JP | 2003-242287 | A | 8/2003 | |
| JP | 003463730 | B2 * | 11/2003 | G07F 9/10 |
| JP | 2004-213188 | A | 7/2004 | |
| SE | 44 244 | | 9/1988 | |
| WO | 85/00909 | A1 | 2/1985 | |
| WO | 91/06927 | A1 | 5/1991 | |
| WO | 91/08952 | A1 | 6/1991 | |
| WO | 91/12594 | A1 | 8/1991 | |
| WO | 91/18371 | A1 | 11/1991 | |
| WO | 92/08212 | A1 | 5/1992 | |
| WO | 92/20043 | A1 | 11/1992 | |
| WO | 92/20044 | A1 | 11/1992 | |
| WO | 92/22044 | A1 | 12/1992 | |
| WO | 93/00660 | A1 | 1/1993 | |
| WO | 93/09621 | A1 | 5/1993 | |
| WO | 94/06101 | A1 | 3/1994 | |
| WO | 94/08319 | A1 | 4/1994 | |
| WO | 94/23397 | A1 | 10/1994 | |
| WO | 95/02226 | A1 | 1/1995 | |
| WO | 95/04978 | A1 | 2/1995 | |
| WO | 95/06920 | A1 | 3/1995 | |
| WO | 95/09406 | A1 | 4/1995 | |
| WO | 95/13596 | A1 | 5/1995 | |
| WO | 95/19017 | A1 | 7/1995 | |
| WO | 95/23387 | A1 | 8/1995 | |
| WO | 95/30215 | A1 | 11/1995 | |
| WO | 96/07163 | A1 | 3/1996 | |
| WO | 96/07990 | A1 | 3/1996 | |
| WO | 96/12253 | A1 | 4/1996 | |
| WO | 96/27525 | A1 | 9/1996 | |
| WO | 96/27859 | A1 | 9/1996 | |
| WO | 97/22919 | A1 | 6/1997 | |
| WO | 97/25692 | A1 | 7/1997 | |
| WO | 98/24041 | A1 | 6/1998 | |
| WO | 98/24067 | A1 | 6/1998 | |
| WO | 98/48383 | A2 | 10/1998 | |
| WO | 98/48384 | A2 | 10/1998 | |
| WO | 98/48385 | A2 | 10/1998 | |
| WO | 98/51082 | A1 | 11/1998 | |
| WO | 98/59323 | A1 | 12/1998 | |
| WO | 99/00776 | A1 | 1/1999 | |
| WO | 99/06937 | A1 | 2/1999 | |
| WO | 99/16027 | A2 | 4/1999 | |
| WO | 99/33030 | A1 | 7/1999 | |
| WO | 99/41695 | A1 | 8/1999 | |
| WO | 99/48057 | A1 | 9/1999 | |
| WO | 99/48058 | A1 | 9/1999 | |
| WO | 00/48911 | A1 | 8/2000 | |
| WO | 00/65546 | A1 | 11/2000 | |
| WO | 01/63565 | A2 | 8/2001 | |
| WO | 02/071343 | A1 | 9/2002 | |
| WO | 03/052700 | A2 | 6/2003 | |
| WO | 03/079300 | A1 | 9/2003 | |
| WO | 03/085610 | A1 | 10/2003 | |
| WO | 03/107280 | A2 | 12/2003 | |
| WO | 2004/044853 | A1 | 5/2004 | |
| WO | 2004/109464 | A2 | 12/2004 | |
| WO | 2005/041134 | A2 | 5/2005 | |
| WO | 2005/088563 | A1 | 9/2005 | |
| WO | 2006/086531 | A1 | 8/2006 | |
| WO | 2007/035420 | A2 | 3/2007 | |
| WO | 2007/120825 | A2 | 10/2007 | |
| WO | 2010/032055 | A1 | 3/2010 | |

OTHER PUBLICATIONS

Amiel Industries: AI-1500 'Pulsar' High Performance Sorting and Bagging Machine, 13 pages (date unknown, but prior to Dec. 14, 2000).

AUI: Coinverter—"No More Lines . . . Self-Serve Cash-Out," by Cassius Elston, 1995 World Games Congress/Exposition Converter, 1 page (dated prior to 1995).

Brandt: 95 Series Coin Sorter Counter, 2 pages (1982).

Brandt: Model 817 Automated Coin and Currency Ordering System, 2 pages (1983).

Brandt: Model 920/925 Counter, 2 pages (date unknown, prior to Jul. 2011, possibly prior to Mar. 17, 1997).

Brandt: System 930 Electric Counter/Sorter, "Solving Problems, Pleasing Customer, Building Deposits," 1 page (date unknown, prior to Mar. 2, 2011, possibly prior to Mar. 17, 1997).

Brandt: Model 940-6 High Speed Sorter/Counter, 2 pages (date unknown, prior to Oct. 31, 1989).

Brandt: System 945 High-Speed Sorter, 2 pages (date unknown, prior to Mar. 2, 2011, possibly prior to Mar. 17, 1997).

Brandt: Model 952 Coin Sorter/Counter, 2 pages (date unknown, prior to Oct. 31, 1989).

(56) References Cited

OTHER PUBLICATIONS

Brandt: Model 954 Coin Sorter/Counter, 2 pages (date unknown, prior to Oct. 31, 1989).
Brandt: Model 957 Coin Sorter/Counter, 2 pages (date unknown, prior to Oct. 31, 1989).
Brandt: Model 958 Coin Sorter/Counter, 5 pages (201 1982).
Brandt: Model 960 High-Speed Coin Sorter & Counter, 2 pages (1984).
Brandt; Model 966 Microsort.TM. Coin Sorter and Counter, 4 pages, (1979).
Brandt: Model 970 Coin Sorter and Counter, 2 pages (1983).
Brandt: Model 1205 Coin Sorter Counter, 2 pages (1986).
Brandt: Model 1400 Coin Sorter Counter, 2 pages (date unknown, prior to Mar. 2, 2011, possibly prior to Mar. 17, 1997).
Brandt: Model 8904 Upfeed—"High Speed 4-Denomination Currency Dispenser," 2 pages (1989).
Brandt: Mach 7 High-Speed Coin Sorter/Counter, 2 pages (1992).
Case ICC Limited: CDS Automated Receipt Giving Cash Deposit System, 3 pages (date unknown, prior to Nov. 15, 2000).
Cash, Martin: Newspaper Article "Bank Blends New Technology With Service," Winnipeg Free Press, 1 page (Sep. 4, 1992).
Childers Corporation: Computerized Sorter/Counter, "To coin an old adage, time is money . . . ," 3 pages (1981).
CTcoin: CDS602 Cash Deposit System, 1 page (date unknown, prior to Jan. 15, 2001).
Cummins: Cash Information and Settlement Systems (Form 023-1408), 4 pages (date Dec. 1991).
Cummins: The Universal Solution to All Coin and Currency Processing Needs (Form 13C1218 3-83), 1 page (Mar. 1983).
Cummins: JetSort.RTM. High Speed Sorter/Counter Kits I & J—Operating Instructions (Form 022-7123-00) 12 pages (1994).
Cummins: JetSort.RTM. Coin Sorter Counter/CA-130XL Coin Wrapper, Cummins Automated Money Systems (AMS) Case Study—Fifth-Third, "6,000 (Coin Per Minute Counter/Sorter Keeps pace With Fifth-Third Bank's Money Processing Needs," (Form 13C1180), 2 pages (Nov. 1981).
Cummins: JetSort.RTM., "Venders Love JetSort," (13C1255), 1 page (Mar. 1987).
Cummins: JetSort.RTM. "High Speed Coin Sorter & Counter for Payphone Applications," "CTOCS Ready" (Form 023-1365), 2 pages (Mar. 1989).
Cummins: JetSort.RTM. mailer, "One moving part simplicity," "Vendors—Are validators changing your coin and cuerrency needs?" (Form 023-1297), 3 pages (Apr. 1987).
Cummins: JetSort.RTM. Series V High Speed Coin Sorter/Counter, (Form 023-1383), 2 pages (Sep. 1990).
Cummins: JetSort.RTM. "Time for a Change, Be a smashing success!," (Form 023-1328), 1 page (Jun. 1988).
Cummins: JetSort.RTM. "Time for a Change—JetSort.RTM. vs. Brandt X," (Form 023-1330), 1 page (Jun. 1988).
Cummins: JetSort.RTM. "Time for a Change—No Coins Sorted After 3:00 or on Saturday," (Form 023-1327), 1 page (Aug. 1988).
Cummins: JetSort.RTM., "What do all these Banks have in Common . . . ?", JetSort, CA-130XL coin wrapper, CA-118 coin wrapper, CA-4000 JetCount, (13C1203), 3 pages (Aug. 1982).
Cummins: JetSort.RTM. 700-01/CA-118 Coin Wrapper, Cummins Automated Money Systems (AMS) Case Study—university State Bank, "Cummins Money Processing System Boosts Teller Service at University State Bank," (Form 13C1192), 2 pages (Mar. 1982).
Cummins: JetSort.RTM. 700-01, Cummins Automated Money Systems (AMS) Case Study—First State Bank of Oregon, "JetSort. RTM. Gives Bank Coin Service Edge," (Form 13C1196), 2 pages (Apr. 1982).
Cummins: JetSort.RTM. 700-01 Coin Sorter/Counter, Operating Instructions, 14 pages (1982).
Cummins: JetSort200 701, Cummins Automated Money System (AMS) Case Study—Convenco Vending, "High Speed Coint Sorter increase coin processing power at Convenco Vending," (Form 13C1226), 2 pages (Jul. 1983).
Cummins: JetSort Models 701 and 705, "State-of-the-art coins processing comes of age," 2 pages (Feb. 1984).
Cummins: JetSort.RTM. Model CA-750 Coin Processor (Item No. 50-152), 1 page (Jul. 1984).
Cummins: JetSort.RTM. Model CA-750 Coin Sorter/Counter and CA-4050 JetCount currency counter, "Money Processing Made Easy," (Form 13C1221) 2 pages (Jun. 1983).
Cummins: JetSort.RTM. Model 1701 with JetStops, Operating Instructions Manual (Form 022-1329-00), 16 pages (1984).
Cummins: JetSort.RTM. Model 1760 brochure, (Form 023-1262-00), 2 pages (Jul. 1985).
Cummins: JetSort.RTM. Model 1770 and 3000, Communication Package specification and operating instructions, 10 pages (uncertain, possibly Nov. 1985).
Cummins: JetSort.RTM. Model 1770, "JetSort.RTM. Speed and Accuracy, Now with Communications!", (Form 023-1272) 1 page (Oct. 1986).
Cummins: JetSort.RTM. 2000 Series High Speed Coin Sorter/Counter (Form 023-1488), 2 pages (Oct. 2000).
Cummins: JetSort.RTM. 3000 Series High Speed Coin Sorter (Form 023-1468 Rev 1), 2 pages (Feb. 1995).
Cummins: JetSort.RTM. 3000 Series Options, "Talking JetSort 3000" (Form 023-1338-00), 1 page (between Jan. 1989-Feb. 1989).
Cummins: JetSort.RTM. 3000, "3000 Coins per Minute!," (Form 023-1312), 1 page (date unknown, est. 1987).
Cummins: JetSort.RTM. 3200, Enhanced electronics for the JetSort. RTM. 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 pages (date unknown, prior to Nov. 10, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, In Less Space Than A Branch Manager's Desk, 4 pages (date unknown, prior to Jan. 15, 2001).
Intellectual Australia Pty. Ltd.: Microbank, "From down under: Microbank," "hand-held smart card terminal that combines smart card functions and telephone banking," 2 pages (Feb. 1996).
ISH Electronic: ISH 12005/500 Coin Counter (with translation), 4 pages (date unknown, prior to Aug. 1996).
ISH Electronic: ISH 12005/501 Self-Service Unit (with translation), 4 pages (date unknown, prior to Aug. 1996).
Namsys, Inc.: Namsys Express, Making currency management . . . more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Aug. 13, 1996, maybe Feb. 1995).
Reis Eurosystems: CRS 6520/ CRS 6525 Standard-Class Coin Deposit Systems, 1 page (date unknown, prior to Apr. 2003).
Reis Eurosystems: CS 3510 Disc-Sorter, 1 page (date unknown, prior to Apr. 2003).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Gazette Montreal, 2 pages (Sep. 19, 1991).

(56) References Cited

OTHER PUBLICATIONS

Royal Bank: SuperBranch, "Experience the Ultimate in Convenience Banking," 2 pages (Feb. 1992).
Scan Coin: International Report, 49 pages (Apr. 1987).
Scan Coin: Money Processing Systems, 8 pages (date unknown, prior to Apr. 2003).
Scan Coin: World, 2 pages (Feb. 1988).
Scan Coin: CDS Cash Deposit System, 6 pages (date unknown, prior to Apr. 2003) [SC 0369].
Scan Coin: CDS Coin Deposit System-Technical Referens Manual, 47 pages (1989).
Scan Coin: CDS 600 User's Manual, 14 pages (date unknown, prior to Apr. 2003).
Scan Coin: CDS 600 & CDS 640 Cash Deposit System—Technical Manual, 45 pages (date unknown, prior to Apr. 2003).
Scan Coin: CDS MK 1 Coin Deposit System—Technical Manual, 32 pages (1991).
Scan Coin: SC 102 Value Counter Technical Manual, 28 pages (date unknown, prior to Apr. 2003).
Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Cards," American Banker, New York, NY, vol. 159, Iss. 195, p. 37, 2 pages (Oct. 10, 1994).
Scan Coin: Coin Sachet System brochure, 4 pages (last page marked ".COPYRGT. Scan Coin / Jun. 2007").

* cited by examiner

SYSTEMS, METHODS AND DEVICES FOR COIN PROCESSING AND COIN RECYCLING

CROSS-REFERENCE TO RELATED APPLICATIONS

The present application is a continuation of U.S. application Ser. No. 16/028,068, filed Jul. 5, 2018, which is a continuation of U.S. application Ser. No. 15/842,314, filed Dec. 14, 2017, now U.S. Pat. No. 10,043,333, issued Aug. 7, 2018, which is a continuation of U.S. application Ser. No. 15/230,123, filed Aug. 5, 2016, now U.S. Pat. No. 9,875, 593, issued Jan. 23, 2018, which claims priority to U.S. Application No. 62/202,571 filed on Aug. 7, 2015, incorporated herein by reference in its entirety.

TECHNICAL FIELD

The present disclosure relates generally to systems, methods and devices for processing currency. More particularly, aspects of this disclosure relate to self-service coin processing machines and coin processing systems for depositing and recycling coins.

BACKGROUND

Some businesses, particularly banks and casinos, are regularly faced with large amounts of currency which must be organized, counted, authenticated and recorded. To hand count and record large amounts of currency of mixed denominations requires diligent care and effort, and demands significant manpower and time that might otherwise be available for more profitable and less tedious activity. To make counting of bills and coins less laborious, machines have been developed which automatically sort, by denomination, mixed assortments of currency, and transfer the processed currency into receptacles specific to the corresponding denominations. For example, coin processing machines for processing large quantities of coins from either the public at large or private institutions, such as banks, casinos, supermarkets, and cash-in-transit (CIT) companies, have the ability to receive bulk coins from users of the machine, count and sort the coins, and store the received coins in one or more coin receptacles, such as coin bins, coin cassettes, or coin bags. One type of currency processing machine is a redemption-type processing machine wherein, after the deposited coins and/or bank notes are counted, funds are returned to the user in a pre-selected manner, such as a payment ticket or voucher, a smartcard, a cash card, a gift card, and the like. Another variation is the deposit-type processing machine where funds which have been deposited by the user are credited to a personal account. Hybrid variations of these machines are also known and available.

A well-known device for processing coins is the disk-type coin sorter. In one exemplary configuration, the coin sorter, which is designed to process a batch of mixed coins by denomination, includes a rotatable disk that is driven by an electric motor. The lower surface of a stationary, annular sorting head (or "sort disk") is parallel to and spaced slightly from the upper surface of the rotatable disk. A mixed batch of coins may be progressively deposited onto the top surface of the rotatable disk. As the disk is rotated, the coins deposited on the top surface thereof tend to slide outwardly due to centrifugal force. As the coins move outwardly, those coins which are lying flat on the top surface of the rotatable disk enter a gap between the disk and the sorting head. The lower surface of the sorting head is formed with an array of exit channels which guide coins of different denominations to different exit locations around the periphery of the disk. The exiting coins, having been sorted by denomination for separate storage, are counted by sensors located, for example, along the exit channel. A representative disk-type coin sorting mechanism is disclosed in U.S. Pat. No. 5,009, 627, to James M. Rasmussen, which is incorporated herein by reference in its entirety and for all purposes.

It is oftentimes desirable in the sorting of coins to discriminate between valid coins and invalid coins. Use of the term "valid coin" can refer to genuine coins of the type to be sorted. Conversely, use of the term "invalid coin" can refer to items in the coin processing unit that are not one of the coins to be sorted. For example, it is common that foreign (or "stranger") coins and counterfeit coins enter a coin processing system for sorting domestic coin currency. So that such items are not sorted and counted as valid coins, it is helpful to detect and discard these "invalid coins" from the coin processing system. In another application wherein it is desired to process only U.S. quarters, nickels and dimes, all other U.S. coins, including dollar coins, half-dollar coins, pennies, etc., are considered "invalid." Additionally, coins from all other coins sets including Canadian coins and European coins, for example, would be considered "invalid" when processing U.S. coins. In another application it may be desirable to separate coins of one country (e.g., Canadian coins) from coins of another country (e.g., U.S. coins). Finally, any truly counterfeit coins (also referred to in the art as "slugs") are always considered "invalid" regardless of application.

Self-service coin redemption machines are used in banking environments (e.g., in patron-accessible areas), business environments (e.g., armored transport services, telephone companies, etc.), and retail environments, (e.g., convenience stores, grocery stores, etc.). In operation, a user deposits a mixed batch of coins into a coin tray of the coin redemption machine. Coins are progressively fed into a coin processing unit whereby the machine discriminates items that are invalid, determines the value of the valid coins, and outputs a receipt indicative of the determined amount. In some systems, the receipt also indicates a second, lesser amount, which reflects a commission charged for use of the machine. In one example, a coin redemption and voucher dispensing machine disclosed in U.S. Pat. No. 6,976,570, which is incorporated herein by reference in its entirety, receives bunches of unsorted coins, counts the total value of the coins, and outputs a voucher or store coupon related to the total amount, less a commission charge for the use of the machine. Customers take the voucher/coupon to a cashier or clerk for redemption, following verification of the authenticity of the voucher by the cashier or clerk.

Coin recycling historically required user-deposited coins be pulled from circulation, shipped to a separate site for sorting and authentication, then repackaged and distributed for recirculation. Typically, coin recycling is performed by privately owned and operated armored car services ("armored carriers"). Generally, an armored car carrier sends out an armored vehicle to a number of different businesses, some of which provide customers with one or more self-service coin redemption machines having coin receptacles requiring pickup and processing. Once the armored car has picked up all of the redemption machines coins and dropped off packaged coins according to the requirements of the businesses, the armored car returns to the armored car carrier where the collected coins are processed and repackaged for delivery on subsequent routes. The armored carrier charges a "Deposit Pick Up Charge" for picking up the store's deposit each day, including excess notes, coin and checks, and a "Change Order Delivery Charge" for dropping off cash (coin/notes) needed by the store to fund daily activities. There are further fees, for example, for the "Currency Furnished" (e.g., $1.25 per $1000), "Rolled Coin Provided (per roll)" (e.g., $0.10 per roll) and a "Deposit Processing Charge" charged by the deposit processor (armored carrier or bank) to count and verify each deposit.

SUMMARY

Currency processing systems, coin processing machines, coin processing units, and methods of processing batches of coins are presented herein. For example, aspects of the present disclosure are directed to disk-type coin processing units and currency processing machines with disk-type coin processing units. In some embodiments, a self-service coin processing and recycling machine is presented which denominates, authenticates, and off-sorts a portion of customer-deposited coins into handheld, portable coin totes or other receptacles that can be retrieved from the machine and used by the host, either at the machine's location or at another location. This allows the host to stock currency coins without the need for paying an armored carrier to retrieve, haul away and process bulk coin, and then buying back coin from that same or a different armored carrier with attendant service fees.

For some system configurations, the coin processing unit is provided with sorted exits for at least four denominations of coins (e.g., penny, nickel, dime, quarter) that are routed to respective containers. These containers may comprise dedicated coin totes that are accessible via a lockable drawer accessible at the front or back of the machine. Once a given tote has been filled to capacity or a predetermined amount of its denomination of coin, the remaining coins of that denomination are sent to a dedicated or mixed-denomination bin, e.g., for retrieval by armored carrier. For at least some configurations, the system utilizes a single mixed-denomination bin or dual mixed-denomination bins. As an example, a dual-bin configuration can use a conveyor belt to selectively move coins forward to a front bin and rearward to a rear bin. The conveyor system can be eliminated altogether on a single bin machine. Optional or alternative configurations could employ a gravity feed tube system to the front and/or rear bin.

In accordance with aspects of the present disclosure, various currency processing systems are presented. One such currency processing system includes a housing with a coin input area that is configured to receive a batch of coins, e.g., from a customer or other user. The currency processing system also includes coin receptacles that are operatively coupled to the housing and configured to stow processed coins. These receptacles include one or more coin-recycling receptacles and one or more coin-depositing receptacles. A disk-type coin processing unit is operatively coupled to the coin input area and the coin receptacles to transfer coins therebetween. The coin processing unit includes a rotatable disk that is configured to impart motion to a plurality of the coins, and a sorting head with a lower surface that is generally parallel to and at least partially spaced from the rotatable disk. The lower surface forms a number of shaped regions that guide the coins, under the motion imparted by the rotatable disk, to exit channels that sort and discharge the coins through a plurality of exit stations.

The currency processing system also includes one or more automated coin chutes, each of which has a chute body defining an input passage connected to coin-recycling and coin-depositing output passages. The automated coin chute includes a movable diverter plate that is configured to selectively transition (e.g., pivot back and forth) between first and second positions. When in the first position, coins received from one of the exit stations of the coin processing unit by the input passage are redirected by the diverter plate through the coin-recycling output passage to one of the coin-recycling receptacles. When in the second position, coins received by the input passage of the automated coin chute from the same exit station are redirected by the movable diverter plate through the coin-depositing output passage to one of the coin-depositing receptacles.

Other aspects of the present disclosure are directed to self-service coin processing machines. In an example, a self-service coin processing machine is presented that includes a housing with a coin input area configured to receive coins. A plurality of coin receptacles is removably positioned inside the housing and configured to receive and store processed coins. These coin receptacles include a plurality of coin-recycling receptacles and a plurality of coin-depositing receptacles. A coin processing unit is configured to receive coins from the coin input area, process the coins, and output the processed coins through coin exit stations. The coin processing machine also includes automated coin chutes, each of which has chute body defining an input passage connected to coin-recycling and coin-depositing output passages. Each automated coin chute includes a movable diverter plate that selectively transitions between a first position, whereby coins received by the input passage from a respective one of the exit stations are redirected through the coin-recycling output passage to a respective one of the coin-recycling receptacles, and a second position, whereby coins received by the input passage from the respective one of the exit stations are redirected through the coin-depositing output passage to a respective one of the coin-depositing receptacles.

According to other aspects of this disclosure, methods of processing and recycling batches of coins are disclosed. As an example, one method includes: receiving a batch of mixed coins in a self-service currency processing machine comprising a coin processing unit that is configured to authenticate and sort received coins, at least one coin-depositing receptacle, and a plurality of coin-recycling receptacles, each of the coin-recycling receptacles being associated with a single denomination of coin; discharging authenticated and sorted coins from the coin processing unit through a plurality of exit stations, each of the exit stations being associated with a single denomination of coin; receiving coins from each of the exit stations via one of a plurality of automated coin chutes, each of the automated coin chutes including a movable diverter plate that is configured to selectively transition between a first position, whereby coins received from the exit station are directed through a coin-recycling output passage, and a second position, whereby coins received from the exit station are directed through a coin-depositing output passage; discharging coins from the coin-recycling output passage of each of the automated coin chutes into a respective one of the coin-recycling receptacles; and discharging coins from the coin-depositing output passage of each of the automated coin chutes into the at least one coin-depositing receptacle.

According to yet other aspects of this disclosure, coin-recycling systems and coin-recycling dispenser assemblies are presented. In an example, disclosed is a coin-recycling dispenser assembly for sorting coins stowed in coin totes into a plurality of coin containers. The coin-recycling dispenser assembly includes a housing with a plurality of tote docking stations. Each tote docking station includes a guide mechanism and a drive mechanism. The coin-recycling dispenser assembly also includes a plurality of tote docks coupled to the housing. Each tote dock is rotatably mounted to one of the tote docking stations and is configured to seat therein one of the coin totes. Movement of each tote dock is limited by the guide mechanism. The drive mechanisms of tote docking stations are each selectively actuable to rotate one of the tote docks back and forth between a loading position, whereat the coin tote can be placed in or removed from the tote dock, and a dispensing position, whereat coins stowed inside the coin tote are dispensed, one at a time, into one of the coin containers.

As another example, a coin-recycling system is disclosed. In according to some such embodiments, the coin-recycling system includes an electronic display device that is configured to display information and user-selectable options to users. An electronic user input device is configured to receive one or more user selections to control one or more operations of the coin-recycling system. A central processing unit (CPU) or processor is communicatively coupled to the electronic display device and the electronic user input device for control thereof. The coin-recycling system also includes an assortment of hand-held coin totes. Each said coin tote has a respective rigid tote body with a wall defining therethrough a coin hole. A lid is attached to the tote body and is configured to move back and forth between a first position, whereat the lid covers the coin hole, and a second position, whereat the lid exposes the coin hole such that coins can be passed into and out of the tote body. The coin-recycling system further includes a coin till with a plurality of coin chutes attached to a till housing and a plurality of coin funnels stowed inside the till housing. Each coin funnel has removably mounted at a narrow end thereof a respective coin cylinder. Additionally, each coin chute is configured to direct coins, under the force of gravity, into a respective one of the coin cylinders through one of the coin funnels.

The coin-recycling system also includes a dispenser assembly housing with a plurality of tote docking stations. Each of the tote docking stations includes a respective guide track with a rotation stop, a respective motor-driven gear assembly, and a respective coin slot configured to transmit coins, under the force of gravity, one at a time, to one of the coin chutes. Juxtaposed on the dispenser assembly housing is a plurality of tote docks, each of which is rotatably mounted to a respective one of the tote docking stations. Each tote dock has a respective tote pocket that is configured to removably seat therein one of the coin totes, and a respective stopping shoulder configured to mate with a rotation stop of one of the tote docking stations and thereby limit rotation of the tote dock. Each of the tote docks also includes a respective guide rail that is configured to mate with a guide track of one of the tote docking stations and thereby limit lateral movement of the tote dock during rotation thereof. Each tote dock further comprises an automated coin disk assembly that is configured to separate coins received from the coin totes, and a respective toothed track that is engaged with the motor-driven gear assembly. The motor-driven gear assemblies are each selectively actuable to rotate a respective one of the tote docks back and forth between a loading position and a dispensing position. When in the loading position, a coin tote can be pushed into and removed from the tote dock. Conversely, when in the dispensing position, coins stowed inside the coin tote are dispensed, one at a time, from the tote dock, through the tote docking station, to the coin till and into one of the coin cylinders through one of the coin funnels.

Also disclosed herein are specialized coin containers. In an example, a coin bag for storing a plurality of coins is disclosed. The coin bag comprises an at least partially transparent and flexible polymeric body. The coin bag body has a first end with an opening configured to receive therethrough plural coins. The coin bag also includes a seal for securing close the opening in the first end. A second end of the coin bag body has a frangible portion that is configured to be manually opened such that coins can be emptied from the coin bag through the opened frangible portion. One or more segments of the coin bag body may be opaque. The coin bag body may be sized to fit in a single hand of an average adult male.

An advantage of one or more of the disclosed coin-recycling concepts is a reduction in carbon footprint by utilizing reusable coin totes instead of cardboard coin boxes and paper coin rolls, and by reducing fuel consumption required to transport coins to and from multiple business locations. Coin recycling, as disclosed herein, can also help to reduce operating costs by: (1) reducing/eliminating payments to CIT companies for coin processing and for rolled coin delivery; (2) reducing/eliminating expenses associated with CIT up charges for emergency coin orders and delivery services; and (3) allowing recycled coins to be shared among stores/branches within an organization. Customers can also enjoy an additional revenue stream by packaging and selling recycled coins at a premium to consumers and local businesses. Coin recycling can be leveraged for numerous coin activities in many businesses, including vending machines, self-service checkout lanes, point-of-sale (POS) lanes, cash tills, automated coin dispensers, etc.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, which are considered to be inventive singly or in any combination, will be readily apparent from the following detailed description of representative embodiments and modes for carrying out the present invention when taken in connection with the accompanying drawings and the appended claims.

Figure 1A:
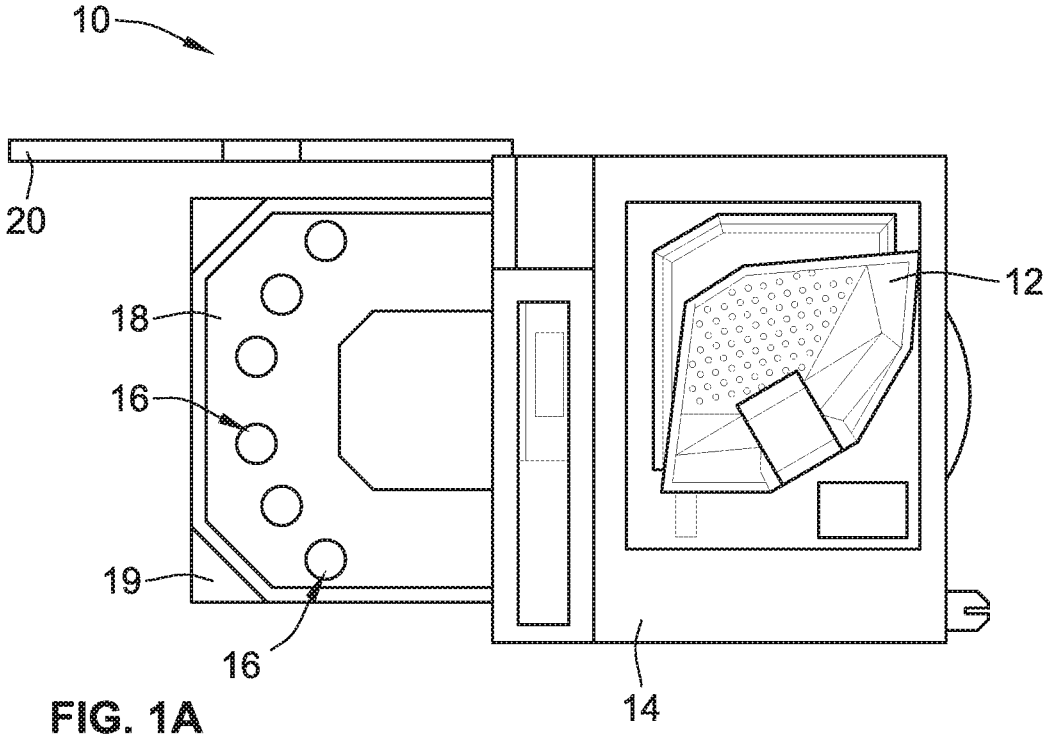
FIGS. 1A and 1B are alternate views of a representative self-service coin processing machine in accordance with aspects of the present disclosure.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, the disclosure is to cover all modifications, equivalents, combinations, and alternatives falling within the spirit and scope of the invention as defined by the appended claims.

DETAILED DESCRIPTION OF THE ILLUSTRATED EMBODIMENTS

This disclosure is susceptible of embodiment in many different forms. There are shown in the drawings, and will herein be described in detail, representative embodiments with the understanding that the present disclosure is to be considered as an exemplification of the principles of the present disclosure and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed or logically prohibited: the words "including" or "comprising" or "having" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Figure 1B:
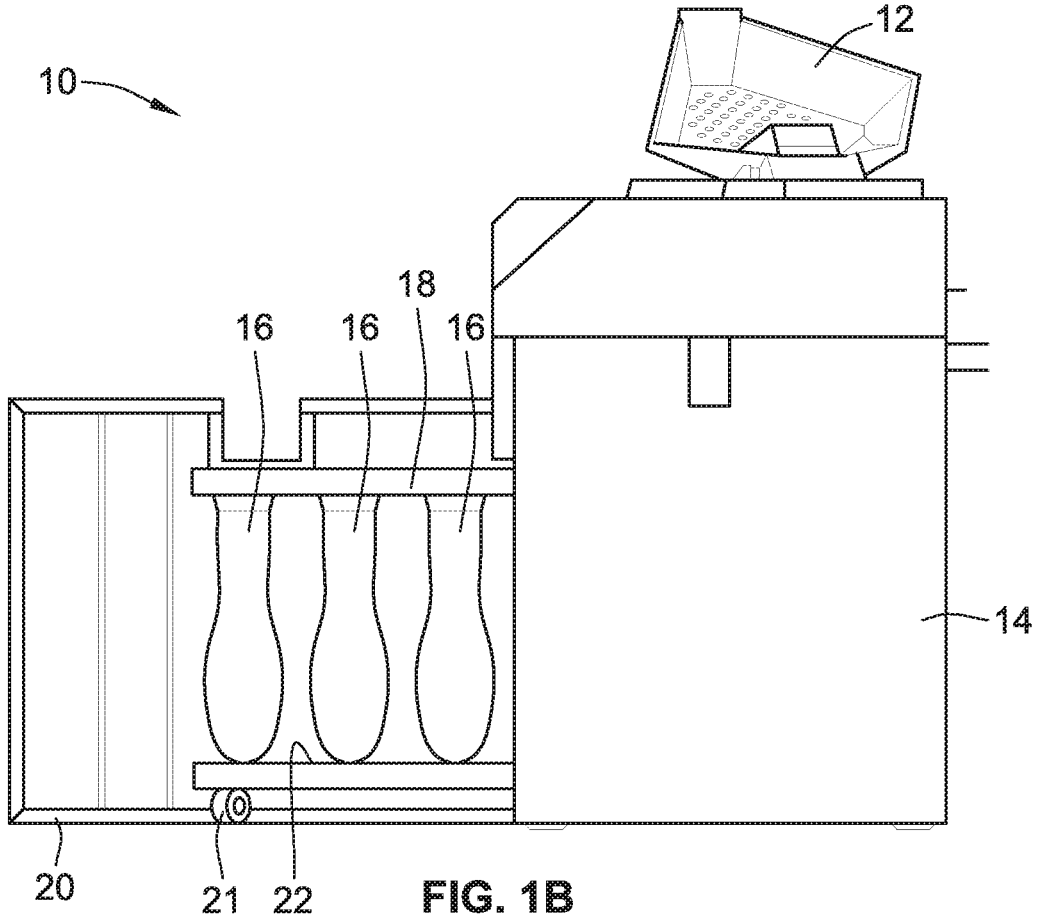

FIGS. 1A and 1B show an example of a self-service coin processing machine 10 having a pivoting coin input tray 12 that is shaped and sized to hold batches of coins prior to inputting coins into the coin processing machine 10. The coin tray 12 pivots upwardly, e.g., via manual manipulation or motor-driven automation, to cause coins deposited therein to move, under the force of gravity through a hopper, funnel, or chute, into a coin processing unit (e.g., FIGS. 6 and 7) disposed within a cabinet or housing 14. The processing unit discharges sorted coins to a plurality of receptacles (e.g., coin bags 16 of FIG. 1B) suspended within the cabinet 14. The bottoms of the bags may rest upon a movable platform 22 and/or may hang from bag holders, clamps or funnels attached to a support member of a moveable bag receptacle station 18. The station 18 moves (e.g., via casters 21, etc.) to travel into and out of the housing 14 to facilitate access by authorized personnel to the coin receptacle bags via door 20 (shown in an open position).

Figure 2:
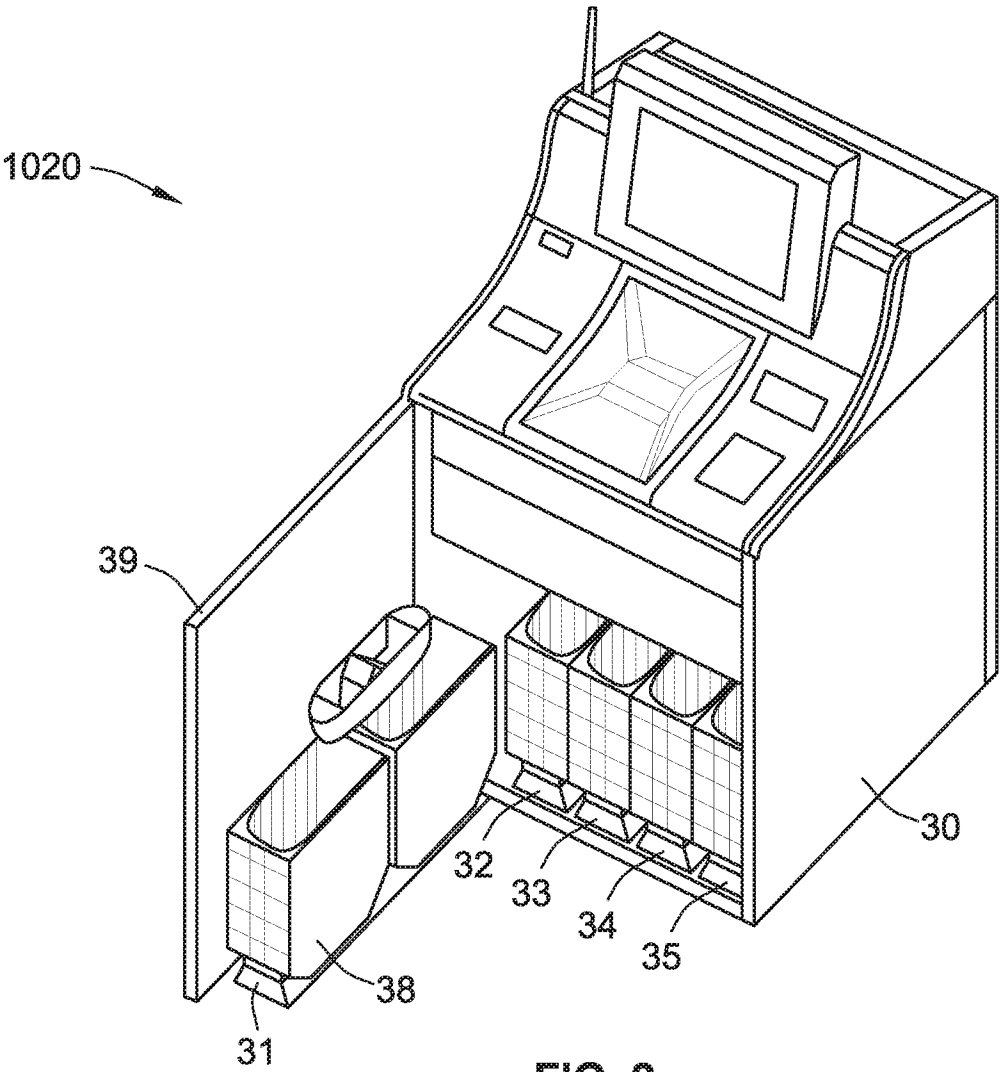
FIG. 2 is an elevated perspective-view illustration of a representative currency processing machine in accordance with aspects of the present disclosure.

FIG. 2 shows an example of a self-service currency processing machine 1020 wherein coin receptacles, such as discrete coin bins 38, are disposed on glide units 31-35 that slide into and out of the housing 30 of a coin processing device. These moveable receptacles 38 comprise coin bag partitions that prevent coins bags disposed in the moveable receptacles 38 from interfering with adjacent coin bags as the coin bags become filled. A door 39 (shown in an open position) facilitate access by authorized personnel to the coin bins or receptacles 38.

Figure 3:
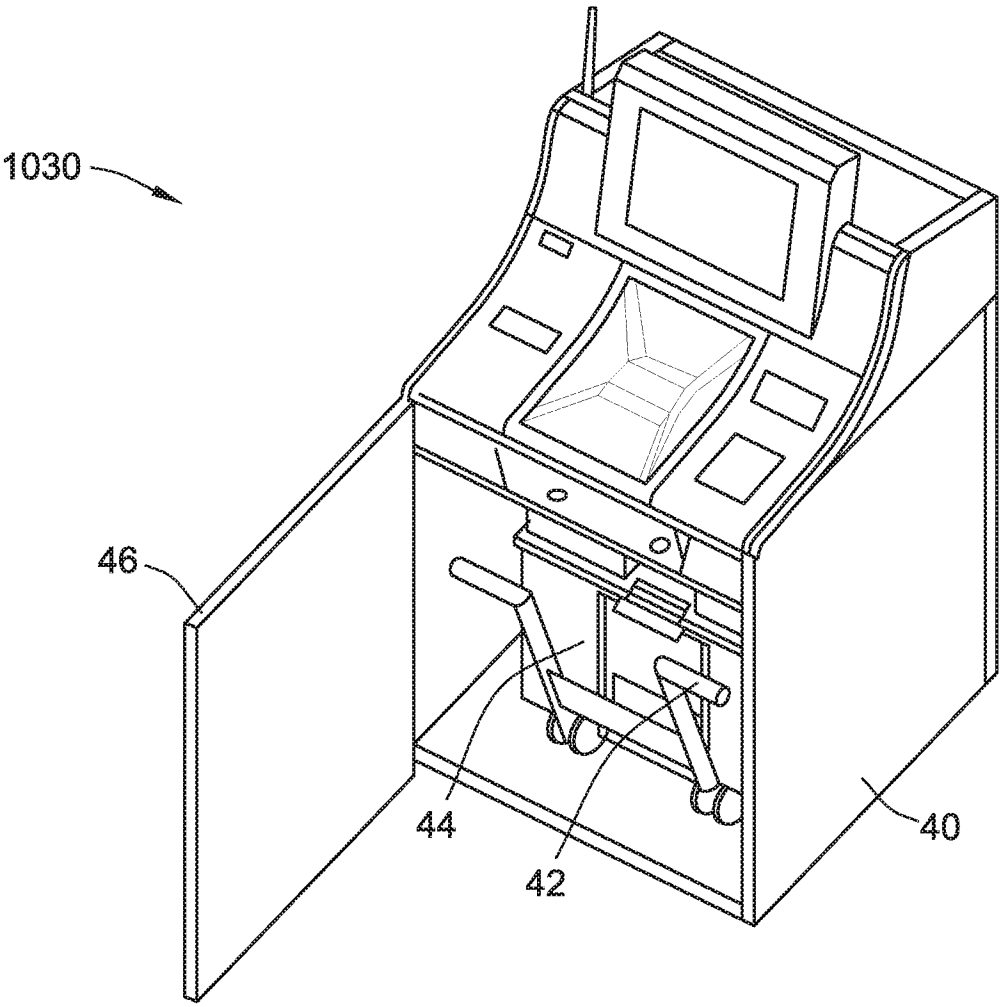
FIG. 3 is an elevated perspective-view illustration of another representative currency processing machine in accordance with aspects of the present disclosure.

FIG. 3 shows an example of another coin processing device 1030, this example including a mixed-denomination coin bin 44 that is disposed within the housing 40, behind door 46, which is shown in an open position. In this configuration, all of the processed coins are commingled in the coin bin 44. The coin bin 44 is disposed on wheels and includes a handle 42 pivotally attached thereto for pulling the coin bin from within the housing. Although differing in appearance, each of the various currency and coin processing units, systems and machines illustrated in the figures may include any of the features, options, and alternatives described herein with respect to the other units, systems and machines unless explicitly disclaimed or logically prohibited.

Figure 4:
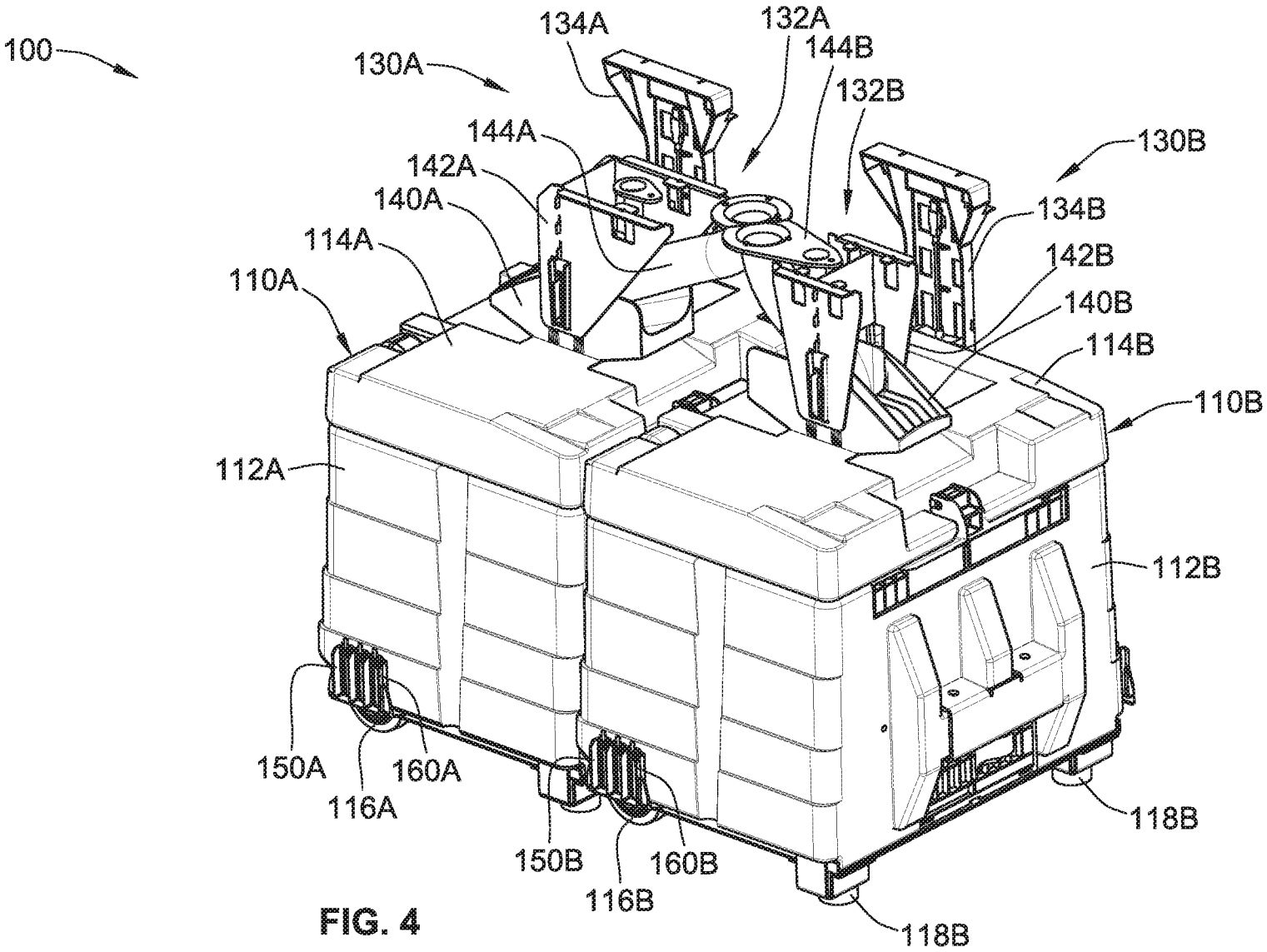
FIG. 4 is a perspective-view illustration of selected components of a representative coin processing system in accordance with aspects of the present disclosure.

FIG. 4 illustrates select portions of a representative coin processing system, designated generally at 100, in accordance with aspects of the present concepts. The coin processing system 100 is portrayed herein by a number of representative parts, including first and second wheeled bins 110A and 110B, respectively, which are removably lodged in complementary bin stations 130A and 130B. Each bin station 130A, 130B includes a respective floating funnel system 132A and 132B that is mounted to a housing, which is represented herein by a pair of support columns 134A and 134B. Each floating funnel system 132A and 132B includes a respective funnel 140A and 140B that is movably mounted, e.g., to the underside of base plate 302, via a respective metal bracket 142A and 142B. Optional coin tubes 144A and 144B direct coins from a coin processing unit to a respective coin funnel 140A and 140B. The features of the present disclosure are not limited to the two-bin implementation presented in FIG. 4; rather, these features are similarly amenable to coin processing systems with greater or fewer than two wheeled bins and corresponding bin stations. In this regard, only selected components of the coin processing system 100 have been shown and will be described in detail herein. Nevertheless, the coin processing system 100 can include numerous additional components, such as a coin processing mechanism, security doors, input devices, such as a computer-based user interface, a variety of output devices, such as display screens, lighting elements, and audio speakers, many of which are described in the various patents and patent publications incorporated herein by reference.

Figure 5:
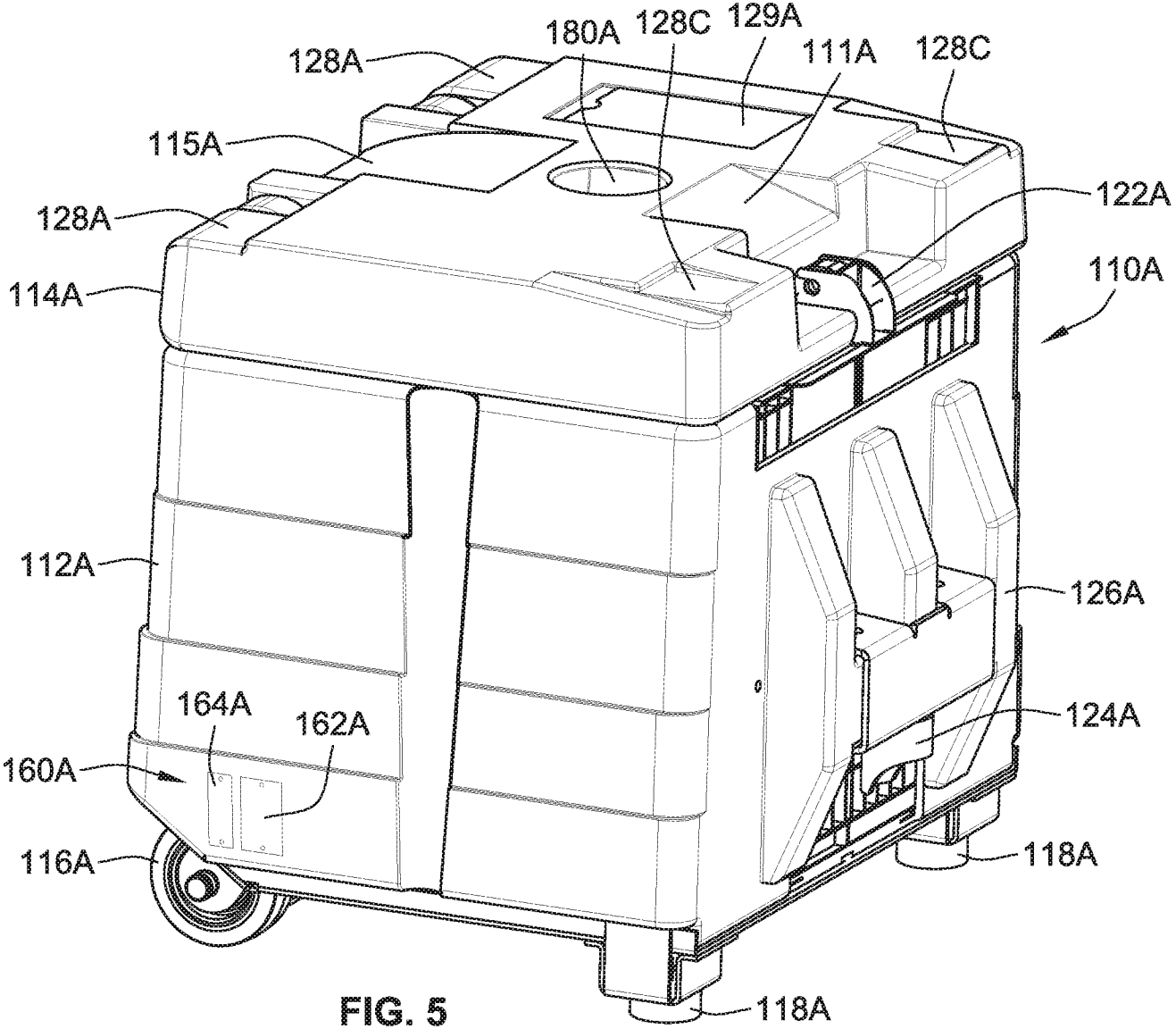
FIG. 5 is a perspective-view illustration of one of the coin bins of FIG. 4.

Wheeled bins 110A, 110B (also referred to herein as "coin receptacles") function generally as mobile coin containers—receiving coins from a coin processing device, such as the disk-type coin sorter described below, and transporting the received coins to another location. As seen in FIGS. 4 and 5, each wheeled bin 110A, 110B includes a respective box-shaped coin container 112A and 112B with a security lid 114A and 114B that extends across and covers the container 112A, 112B. The coin containers 112A, 112B and security lids 114A, 114B can be fabricated from a variety of rigid and robust materials, including synthetic polymers, such as medium density polyethylene, and metallic materials, such as aluminum or steel, and combinations thereof. The coin containers 112A, 112B are each supported for movement thereof on a respective pair of laterally spaced casters or wheels 116A and 116B, located at a forward end of the container 112A, 112B. A pair of laterally spaced support stanchions 118A, 118B, is located at a rearward end of the container 112A, 112B on the opposite side of the casters 116A, 116B. In alternative configurations, the wheeled bins 110A, 110B may include greater of fewer than two casters/wheels each. Moreover, the bins 110A, 110B can be designed without wheels and moved via alternative means, such as air bearings, fork lifts, moving dollies, etcetera.

In the illustrated embodiment, the first and second wheeled bins 110A, 110B of FIG. 4 are substantially structurally identical; thus, for brevity and conciseness, additional features of the bins 110A, 110B will be described with respect to the wheeled bin 110A portrayed in FIG. 5. The lid 114A of the wheeled bin 110A includes a centrally located hole 180A through which coins received from the funnel system 132A pass into the coin container 112A. Leading and trailing guide ramps 115A and 111A, respectively, are integrally formed in the lid 114A, disposed on opposing sides of the central hole 180A. Hinged to a forward peripheral edge of the container 112A, the lid 114A can be swung open to provide access to the inside of the container 112A, for example, to simplify removal of the contents of the container 112A. Conversely, the lid 114A can be swung closed and locked shut, for example, via an optional security latch 122A for securing the contents of the container 112A.

The lid 114A can also be provided with optional structural features for securely supporting another wheeled bin on top of the wheeled bin 110A. In the illustrated embodiment, these features comprise four recessed stacking platforms: a pair of recessed wheel platforms 128A at a forward end of the lid 114A for nesting the wheels of another bin, and a pair of recessed stanchion platforms 128C at a rearward end of the lid 114A for nesting the support stanchions of another bin. The recessed platforms 128A, 128C allow for another wheeled bin, such as the second wheeled bin 110B, to be generally immobilized and securely stacked on top of the first wheeled bin 110A. The lid 114A can also be provided with an optional RFID reader or transmitter/receiver for wirelessly communicating, receiving and storing information, as described in detail in U.S. Pat. No. 8,545,295, incorporated herein by reference in its entirety. Moreover, a clean sleeve 129A for holding and displaying a receipt or other printed information is situated on the top of the lid 114A adjacent the coin hole 180A.

The wheeled bin 110A is designed to be quickly and easily moved into and out of the bin station 130A. A socket 124A projects downward from a hitch chassis 126A, which projects from the rear side of the coin container 112A. A complementary socket-ball of a cantilevered dolly (not shown) can be inserted into the socket 124A. The cantilevered dolly provides a mechanical advantage (e.g., 10:1) for lifting the rear end of the container 112A. By inserting the socket-ball into the socket 124A and applying a downward force to the opposite end of the cantilevered dolly, a moment arm is applied to the coin container 112A causing the wheeled bin 110A to pitch slightly forward (e.g., counterclockwise in FIG. 5) off of the support stanchions 118A, placing the weight of the bin 110A on the casters 116A and cantilevered dolly. This allows for the wheeled bin 110A to be readily wheeled in and out of the bin station 130A. To prevent damage to sensitive electronics and other equipment in the bin station 130A, the housing 134A, 134B and/or bin 110A can be provided with means (e.g., a bracket) for limiting the height to which the wheeled bin 110A can be raised. The aforementioned wheel-and-stanchion arrangement, in combination with the use of the cantilevered dolly, helps to minimize the height of the wheeled bin 110A in comparison to its conventional counterparts.

When the wheeled bins 110A, 110B are properly lodged inside their respective bin stations 130A, 130B, this condition can be communicated to or detected by a processor of the coin processing system 100, for example, via wired or wireless communication. By way of non-limiting example, the bin logic system utilizes a number of electrically conductive interfaces for determining information. These electrically conductive interfaces are exemplified in the drawings by two contact blocks 150A and 150B that are connected to respective bin stations 130A, 130B, and a set of contact plates 162A and 164A (FIG. 5) that are connected to each respective bin 110A, 110B. When the contact blocks 150A, 150B come into contact with the contact plates 162A, 164A one or more electrical circuits are completed. The completion or non-completion of these one or more electrical circuits is indicated to different conditions associated with the wheeled bins 110A, 110B such as, for example, that the bins 110A, 110B are properly lodged inside their respective bins stations 130A, 130B, and/or whether a given bin 110A, 110B is empty, has coins therein, or has reached a full level of coins. One or more of the contact blocks 150A, 150B and contact plates 162A, 164A may also be used to dissipate electrostatic charge associated with the wheeled bins 110A, 110B and/or coins within those wheeled bins.

Figure 6:
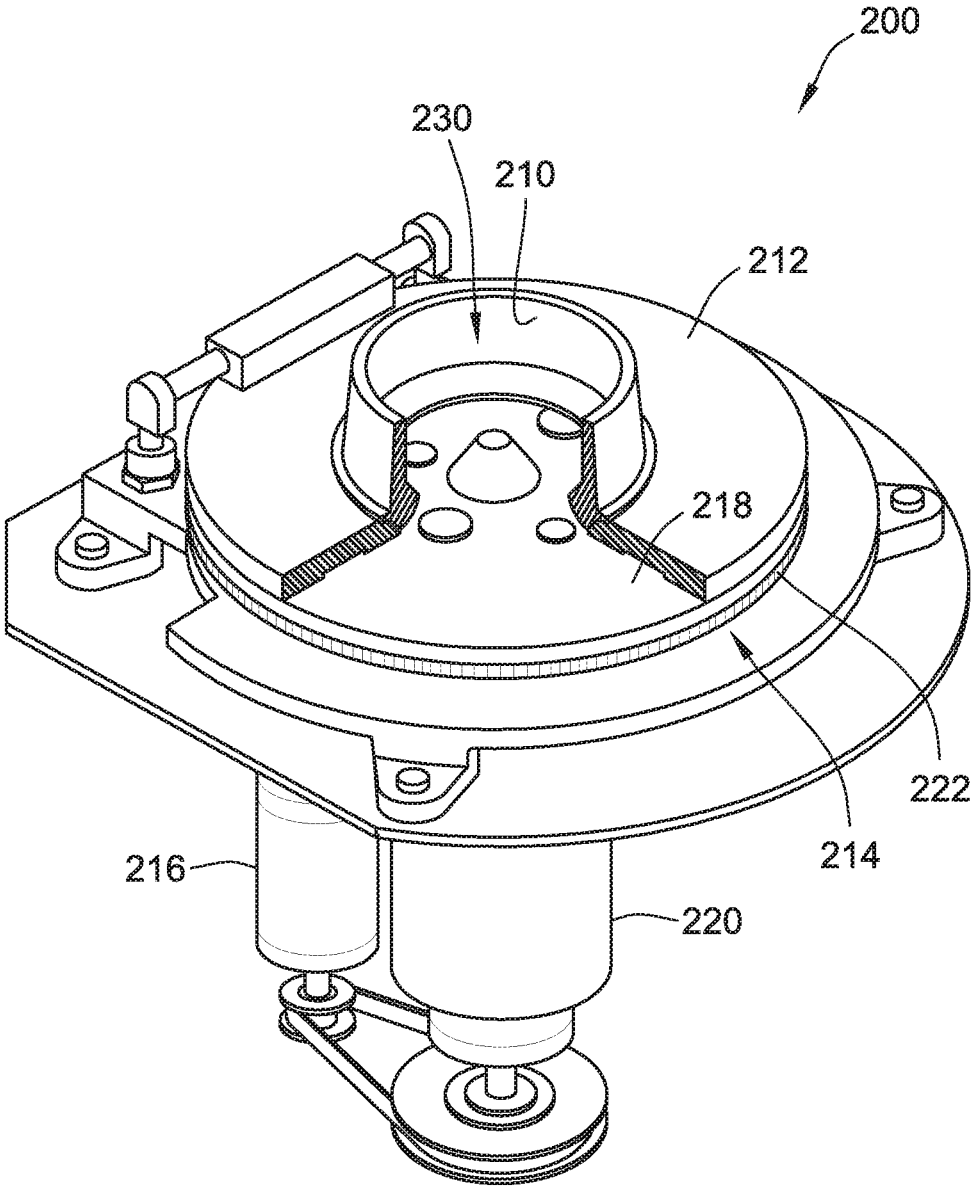
FIG. 6 is a partially broken away perspective-view illustration of an example of a disk-type coin processing unit in accordance with aspects of the present disclosure.

FIG. 6 shows a non-limiting example of a coin sorting device, represented herein by a disk-type coin processing unit 200 that can be used in any of the currency processing systems, methods and devices disclosed herein. The coin processing unit 200 includes a hopper channel, a portion of which is shown at 210, for receiving coins of mixed denominations from a coin input area (e.g., coin input areas 12 of FIGS. 1A and 1B). The hopper channel 210 feeds the coins through a central opening 230 in an annular, stationary sorting head 212 (oftentimes referred to as a "sorting disk" or "sort disk"). As the coins pass through this opening, the coins are deposited onto the top surface of a resilient pad 218 disposed on a rotatable disk 214. According to some embodiments, coins are initially deposited by a user onto a coin tray (e.g., coin tray 12 of FIG. 1A) disposed above the coin processing unit 200; coins flow from the coin tray into the hopper channel 210 under the force of gravity.

This rotatable disk 214 is mounted for rotation on a shaft (not visible) and driven by an electric motor 216. The rotation of the rotatable disk 214 of FIG. 6 is slowed and stopped by a braking mechanism 220. The disk 214 typically comprises a resilient pad 218, preferably made of a resilient rubber or polymeric material, that is bonded to, fastened on, or integrally formed with the top surface of a solid disk 222. The resilient pad 218 may be compressible such that coins laying on the top surface thereof are biased or otherwise pressed upwardly against the bottom surface of the sorting head 212 as the rotatable disk 214 rotates. The solid disk 222 is typically fabricated from metal, but it can also be made of other materials, such as a rigid polymeric material.

The underside of the inner periphery of the sorting head 212 is spaced above the pad 218 by a distance which is approximately the same as or, in some embodiments, just slightly less than the thickness of the thinnest coin that the coin processing unit 200 is designed to sort. While the disk 214 rotates, coins deposited on the resilient pad 218 tend to slide outwardly over the top surface of the pad 218 due to centrifugal force. As the coins continue to move outwardly, those coins that are lying flat on the pad 218 enter a gap between the upper surface of the pad 218 and the lower surface of the sorting head 212. As is described in further detail below, the sorting head 212 includes a plurality of coin directing channels (also referred to herein as "exit channels") for manipulating the movement of the coins from an entry area to a plurality of exit stations (or "exit slots") where the coins are discharged from the coin processing unit 200. The coin directing channels may sort the coins into their respective denominations and discharge the coins from exit stations in the sorting head 212 corresponding to their denominations. Sorting head 212 can also be provided with means for off-sorting invalid coins and foreign objects deposited into the unit 200.

Figure 7:
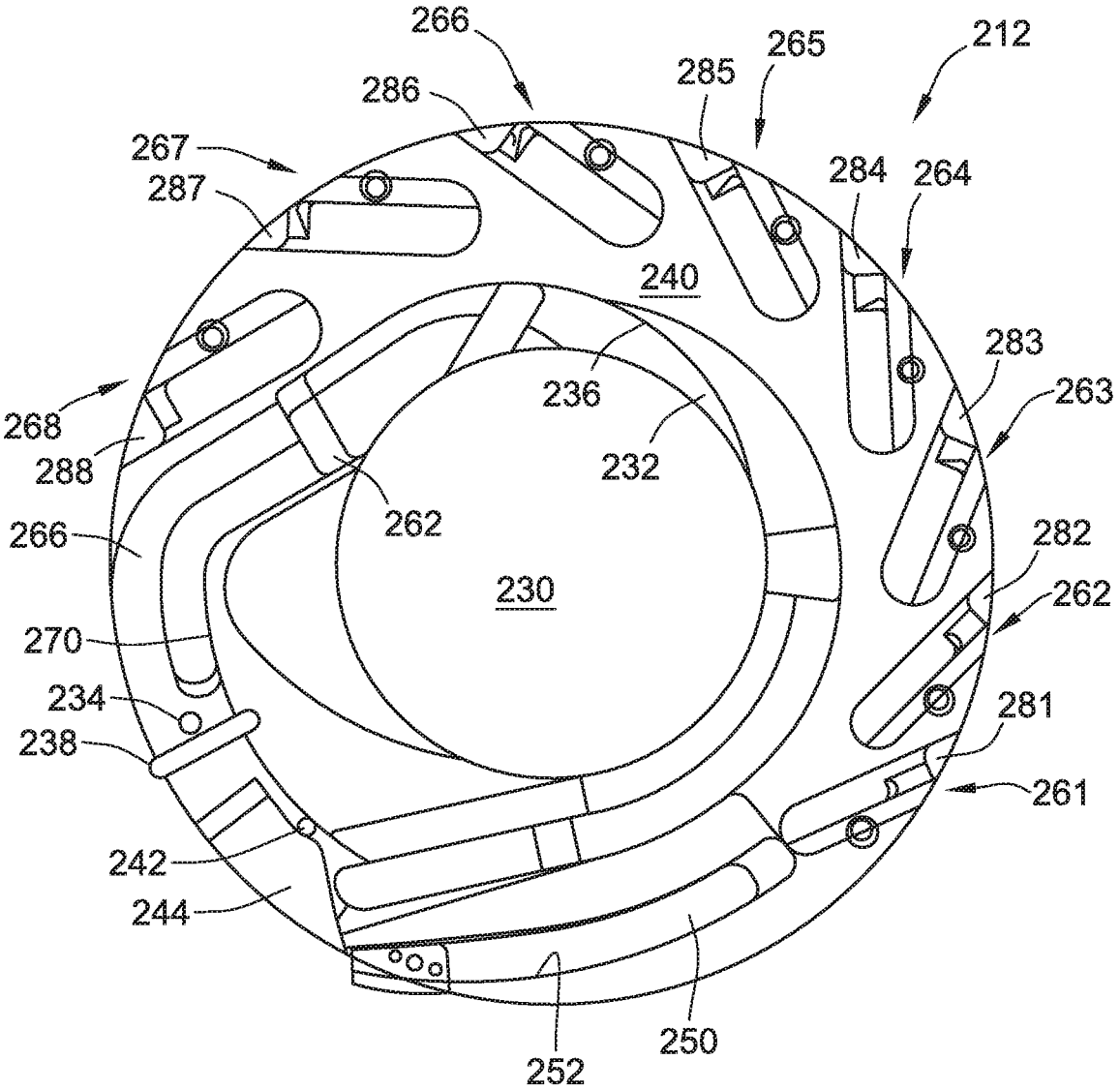
FIG. 7 is an enlarged bottom-view illustration of the sorting head of the exemplary disk-type coin processing unit of FIG. 6.

Referring now to FIG. 7, the underside of the sorting head 212 is shown. The coin set for a given country can be sorted by the sorting head 212 due to variations in the diameter and/or thickness of the individual coin denominations. For example, according to the United States Mint, the U.S. coin set has the following diameters:

Penny=0.750 in. (19.05 mm)
Nickel=0.835 in. (21.21 mm)
Dime=0.705 in. (17.91 mm)
Quarter=0.955 in. (24.26 mm)
Half Dollar=1.205 in. (30.61 mm)
Presidential One Dollar=1.043 in. (26.49 mm)

The coins circulate between the stationary sorting head 212 and the rotating pad 218 on the rotatable disk 214, as shown in FIG. 6. Coins that are deposited on the pad 218 via the central opening 230 initially enter an entry channel 232 formed in the underside of the sorting head 212. It should be kept in mind that the circulation of the coins in FIG. 7 appears counterclockwise as FIG. 7 is a view of the underside of the sorting head 212.

An outer wall 236 of the entry channel 232 divides the entry channel 232 from the lowermost surface 240 of the sorting head 212. The lowermost surface 240 is preferably spaced from the pad 218 by a distance that is slightly less than the thickness of the thinnest coins that the coin processing unit 200 is designed to process. Consequently, the initial outward radial movement of all the coins is terminated when the coins engage the outer wall 236, although the coins continue to move more circumferentially along the wall 236 (e.g., in a counterclockwise direction in FIG. 7) by the rotational movement imparted to the coins by the pad 218 of the rotatable disk 214.

While the pad 218 continues to rotate, those coins that were initially aligned along the wall 236 move across the ramp 262 leading to a queuing channel 266 for aligning the innermost edge of each coin along an inner queuing wall 270. The coins are gripped between the queuing channel 266 and the pad 218 as the coins are rotated through the queuing channel 266. The coins, which were initially aligned with the outer wall 236 of the entry channel 232 as the coins move across the ramp 262 and into the queuing channel 266, are rotated into engagement with inner queuing wall 270. As the pad 218 continues to rotate, the coins which are being positively driven by the pad move through the queuing channel 266 along the queuing wall 270 past a trigger sensor 234 and a discrimination sensor 238, which may be operable for discriminating between valid and invalid coins. In some embodiments, the discrimination sensor 238 may also be operable to determine the denomination of passing coins. The trigger sensor 234 sends a signal to the discrimination sensor 238 that a coin is approaching.

In the illustrated example, coins determined to be invalid are rejected by a diverting pin 242 that is lowered into the coin path such that the invalid coin impacts the pin 242 and thereby redirects the invalid coin to a reject channel 244. In some embodiments, the reject channel 244 guides the rejected coins to a reject chute that returns the coin to the user (e.g., rejected coins ejected into a coin reject tube to a coin dispensing receptacle). The diverting pin 242 depicted in FIG. 7 remains in a retracted "non-diverting" position until an invalid coin is detected. Those coins not diverted into the reject channel 244 continue along inner queuing wall 270 to a gauging region 250. The inner queuing wall 270 terminates just downstream of the reject channel 244; thus, the coins no longer abut the inner queuing wall 270 at this point and the queuing channel 266 terminates. The radial position of the coins is maintained, because the coins remain under pad pressure, until the coins contact an outer gauging wall 252 of the gauging region 250.

The gauging wall 252 aligns the coins along a common outer radius as the coins approach a series of coin exit channels 261-268 which discharge coins of different denominations through corresponding exit stations 281-288. The first exit channel 261 is dedicated to the smallest coin to be sorted (e.g., the dime in the U.S. coin set). Beyond the first exit channel 261, the sorting head 212 shown in FIGS. 6 and 7 forms seven more exit channels 262-268 which discharge coins of different denominations at different circumferential locations around the periphery of the sorting head 212. Thus, the exit channels 261-268 are spaced circumferentially around the outer periphery of the sorting head 212 with the innermost edges of successive channels located progressively closer to the center of the sorting head 212 so that coins are discharged in the order of increasing diameter. The number of exit channels can vary according to alternative embodiments of the present disclosure.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 218. To maintain a constant radial position of the coins, the pad 218 continues to exert pressure on the coins as they move between successive exit channels 261-268.

Further details of the operation of the sorting head 212 shown in FIGS. 6 and 7 are disclosed in U.S. Patent Application Publication No. US 2003/0168309 A1, which is incorporated herein by reference in its entirety. Other disk-type coin processing devices and related features that may be suitable for use with the coin processing devices disclosed herein are shown in U.S. Pat. Nos. 6,755,130; 6,637,576; 6,612,921; 6,039,644; 5,997,395; 5,865,673; 5,782,686; 5,743,373; 5,630,494; 5,538,468; 5,507,379; 5,489,237; 5,474,495; 5,429,550; 5,382,191; and 5,209,696, each of which is incorporated herein by reference in its entirety and for all purposes. In addition, U.S. Pat. Nos. 7,188,120 B2, 6,996,263 B2, 6,896,118 B2, 6,892,871 B2, 6,810,137 B2, 6,748,101 B1, 6,731,786 B2, 6,124,926 B2, 6,678,401 B2, 6,637,576 B1, 6,609,604, 6,603,872 B2, 6,579,165 B2, 6,318,537 B 1, 6,171,182 B1, 6,068,194, 6,042,470, 6,039,645, 6,021,883, 5,982,918, 5,943,655, 5,905,810, 5,564,974, and 4,543,969, and U.S. Patent Application Publication Nos. 2013/0205723 A1, 2007/0119681 A1 and 2004/0256197 A1, and U.S. patent application Ser. No. 14/752,474 are incorporated herein by reference in their respective entireties and for all purposes.

Figure 8:
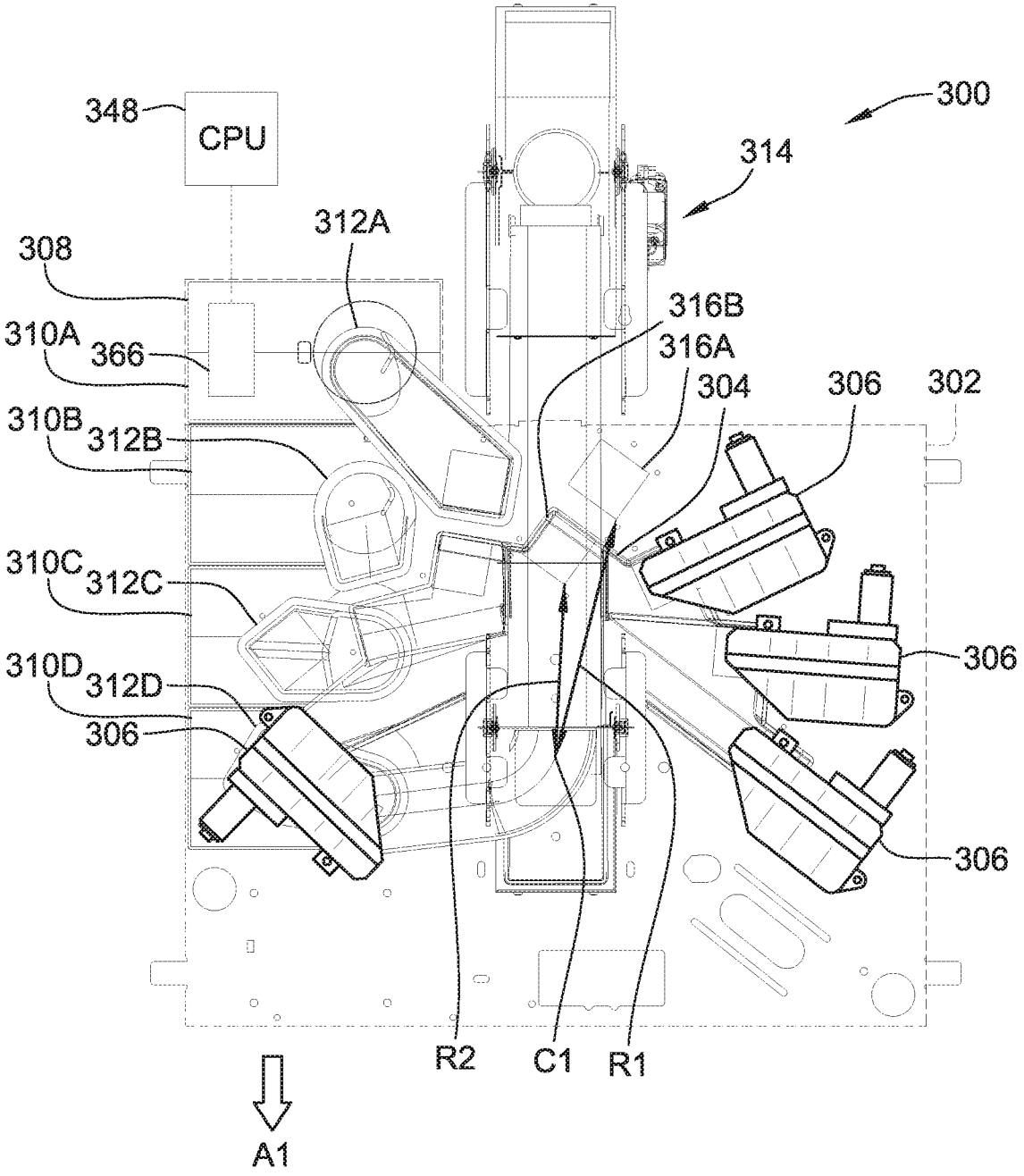
FIG. 8 is a plan-view illustration of selected components of a representative coin depositing and recycling unit ("CDR Unit") in accord with aspects of the present disclosure.

Turning next to FIG. 8, there are shown select components of a coin depositing and recycling unit, designated generally at 300, for receiving processed coins from a coin sorting device, such as the disk-type coin processing unit 200 of FIGS. 6 and 7, and distributing those coins in accordance with a predetermined coin logic procedure to one or more coin-recycling receptacles and one or more coin-depositing receptacles. As indicated above, the coin depositing and recycling unit 300 (also referred to herein as "CDR Unit") can be incorporated into any of the illustrated systems and machines, as well as accommodate any of the optional configurations and functional alternatives described herein with respect to the examples shown in FIGS. 1-7, and thus can include any of the corresponding options and features.

The CDR Unit 300 portrayed in FIG. 8 includes a base plate 302 that is positioned underneath the disk-type coin processing unit 200, disposed over a coin-mixing manifold 304 and coin bins 110A and 110B (FIGS. 4 and 5), and supports thereon a plurality of automated coin chutes 306. While there are four automated coin chutes 306 shown in FIG. 8, the illustrated example can include as few as one and as many as eight (or potentially more) automated coin chutes 306 depending, for example, on the intended application and design requirements of the CDR Unit 300. CDR Unit 300 further includes a tote drawer 308 (see FIGS. 8 and 12), which carries a variety of handheld coin totes 310A-310D, as well as an assortment of tote chutes 312A-312D positioned above the totes 310A-310D. Adjacent the tote drawer 308 and coin totes 310A-310D is a conveyor belt assembly, designated generally as 314, all of which are located underneath the base plate 302. The illustrated example is shown comprising four coin totes with four corresponding chutes; nevertheless, it is within the scope and spirit of this disclosure to incorporate greater or fewer than four totes and chutes into the CDR Unit 300. In addition, the base plate 302 is shown hidden in FIGS. 8-10 (i.e., illustrated with dashed lines) to more clearly show the components positioned underneath the base plate 302 and to more clearly convey how those components interact with the components positioned on top of the base plate 302.

Figure 9:
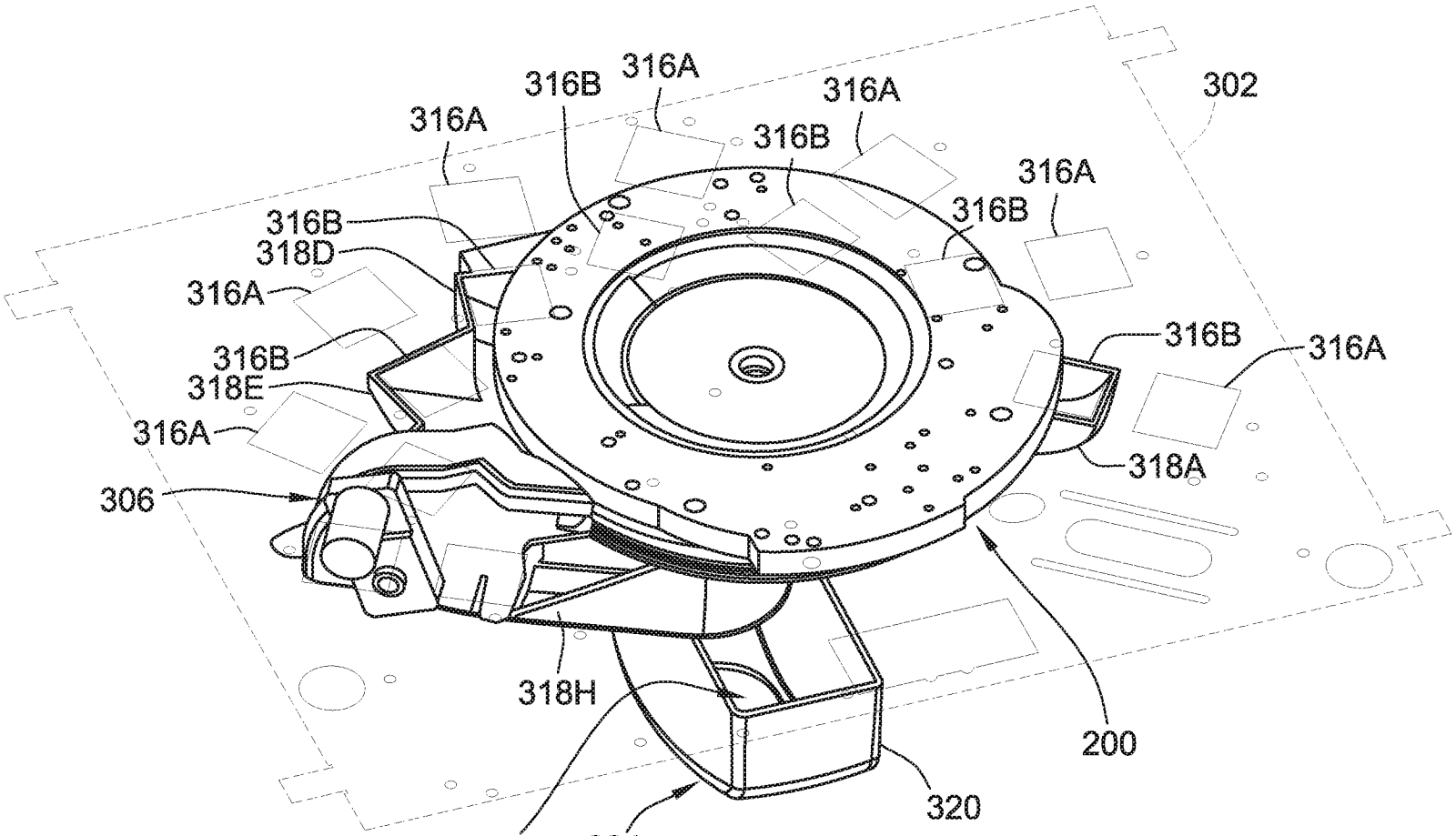
FIG. 9 is a perspective-view illustration of the base plate, coin processing unit, coin-mixing manifold and one of the automated coin chutes of the CDR Unit of FIG. 8.
Figure 10:
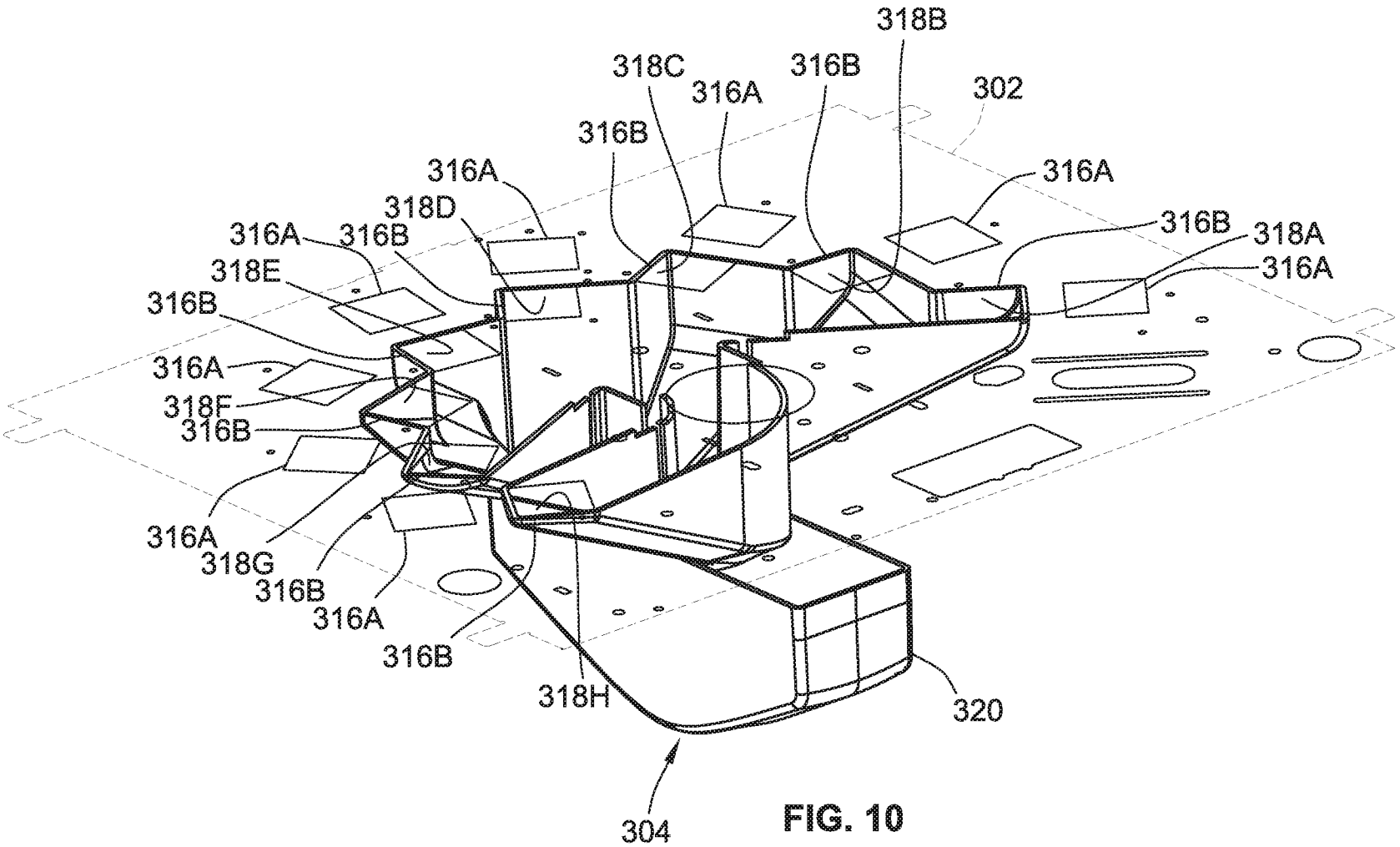
FIG. 10 is a perspective-view illustration of the base plate and coin-mixing manifold of the CDR Unit of FIG. 8.

Base plate 302, which is shown as a single-piece unitary structure, is fabricated from a rigid, generally inflexible material, such as a stamped or laser-cut sheet of stainless steel or aluminum. Typically mounted within the outer housing of a coin processing machine (e.g., housing 14 of processing machine 10) or currency processing system (e.g., housing 134 of processing system 100 of FIG. 4), this base plate 302 acts to provide subjacent support for various components, including the disk-type coin processing unit 200 and automated coin chutes 306, as well as other constituent parts that are not shown in FIGS. 8 and 9, such as a funnel-shaped coin hopper, a wiring harness, a central processor, etc. As seen in FIGS. 8-10, an arrangement of coin ports, represented herein by eight square-shaped first coin ports 316A (also referred to herein as "coin-recycling ports") and eight square-shaped second coin ports 316B (also referred to herein as "coin-depositing ports"), are spaced circumferentially about the coin processing unit 200. Each coin port 316A, 316B extends through the base plate 302 and is spaced a predetermined distance from the coin processing unit 200. For instance, as seen in FIG. 8, the coin-recycling ports 316A are spaced a first radial distance R1 from the center Cl of the processing unit's rotatable disk 214, whereas the coin-depositing ports 316B are spaced a second radial distance R2 from the center Cl of the rotatable disk 214. As shown, the first radial distance R1 is greater than the second radial distance R2. It should be readily understood that the shape, location and quantity of the coin ports can be varied, singly or in any combination, from that which is shown in the drawings.

As best seen in FIGS. 9-10, positioned underneath the base plate 302, pressing flush against an underside surface thereof, is a coin-mixing manifold 304 that is configured to receive coins sorted by the disk-type coin processing unit 200, recombine the sorted coins, and direct the recombined coins to one or more coin-depositing receptacles. According to the illustrated example, the coin-mixing manifold 304 is a single-piece polymeric construction comprising a plurality of individually shaped, ramped coin baffles 318A-318H which coalesce to an integrally formed outlet plenum 320. Coin inlet ports of these ramped coin baffles 318A-318H are complementary to and aligned with the base plate's coin-depositing ports 316B. By contrast, a coin outlet port 304A of the plenum 320 is suspended above the conveyor belt assembly 314. Coins that are received by the coin baffles 318A-318H through the ports 316B of base plate 302 are directed, under the force of gravity, to the outlet plenum 320 of the manifold 304. Outlet plenum 320 pools together coins received from the coin baffles 318A-318H, and feeds the combined coins, under the force of gravity, through a coin outlet port 304A onto the conveyor belt assembly 314. While shown as an integrally formed single-piece construction, the manifold 304 may comprise multiple segments that are mechanically or otherwise functionally connected. Moreover, the manifold 304 may comprise greater or fewer than eight baffles 318A-318H, for example, to coincide with the number of coin-depositing ports 316B in the base plate 302. According to some embodiments, the coin depositing and recycling unit (CDR Unit) 300 has only a single wheeled bin 110A, 110B associated therewith and coins falling through the coin outlet port 304A are directed into such bin 110A, 110B and no conveyor belt assembly 314 is present.

Figure 11A:
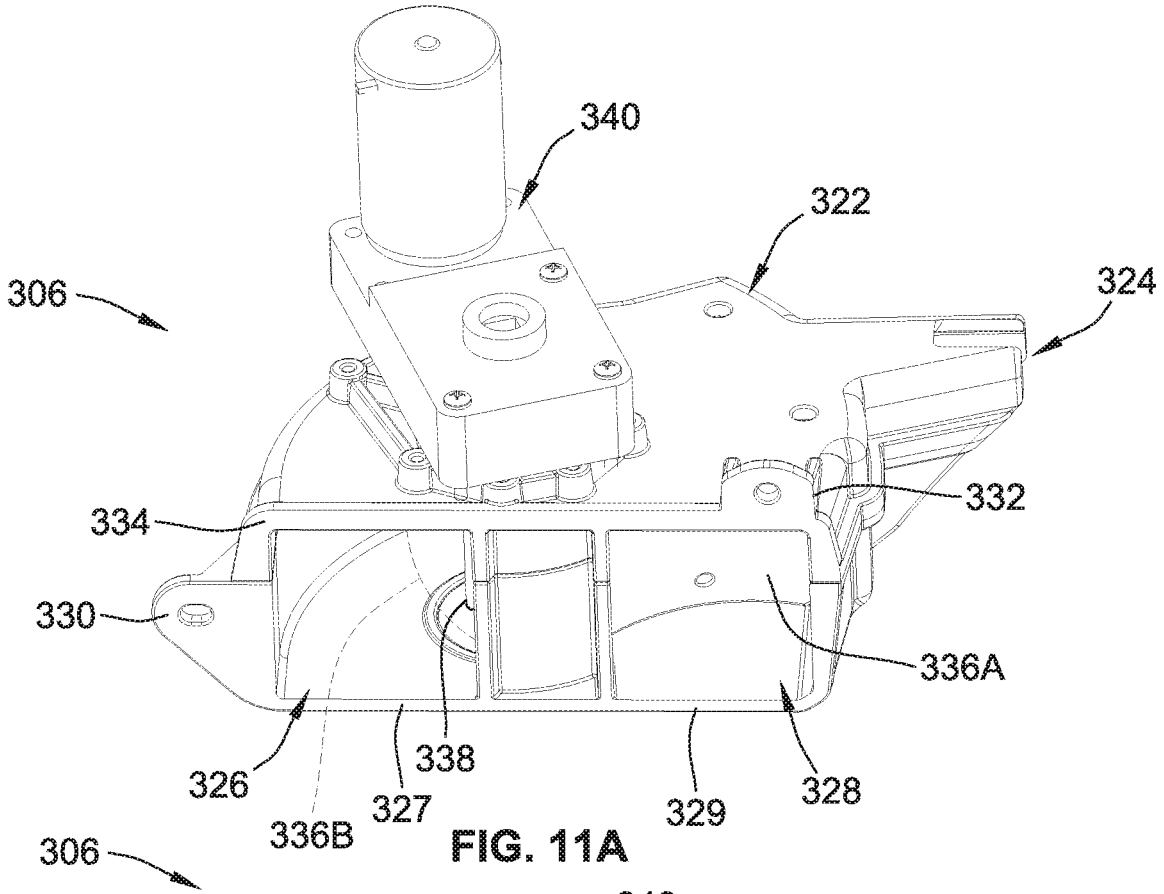
FIGS. 11A and 11B are perspective-view illustrations of one of the automated coin chutes of the CDR Unit of FIG. 8.
Figure 11B:
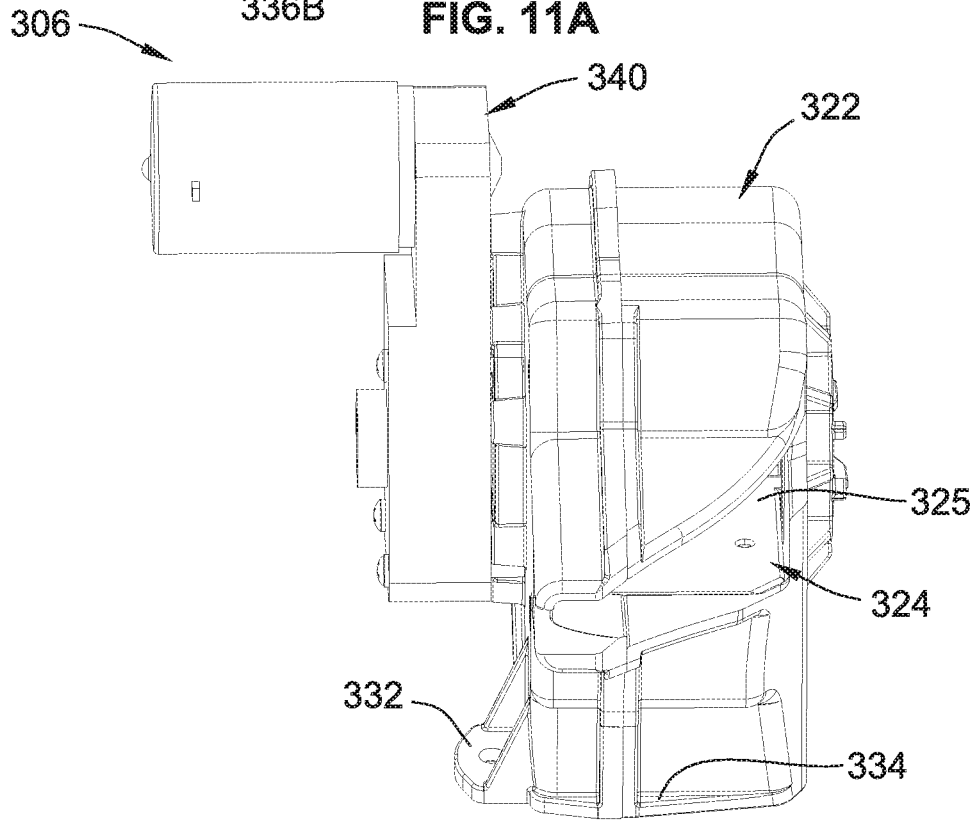

Returning to FIG. 8, automated coin chutes 306 are bolted on the base plate 302, positioned to generally circumscribe the disk-type coin processing unit 200. For illustrative purposes, one such automated coin chute 306 is shown in FIG. 9 bolt to base plate 302. The coin processing unit 200, in turn, is mounted on the base plate 302 concentric with a common center of the circumferential array of coin ports 316A and 316B. With this arrangement, a respective input passage of each automated coin chute 306 is seated against or otherwise functionally coupled to one of the exit stations of the disk-type coin processing unit 200 to receive coins therefrom. In the illustrated embodiment, the automated coin chutes 306 of FIG. 8 are substantially structurally identical; thus, for brevity and conciseness, additional features of these coin chutes 306 will be described with respect to the automated coin chute 306 presented in FIGS. 11A and 11B. Automated coin chute 306 includes a polymeric, bipartite chute housing 322 that defines therein an input passage 324 which forks to a pair of (coin-recycling and coin-depositing) output passages 326 and 328, respectively. The chute housing 322 is provided with a pair of mounting tabs 330 and 332 through which are received bolts or other mechanical fasteners (not shown) for mounting the automated coin chute 306 onto the base plate 302. A base flange 334, which extends continuously about the lower periphery of the chute housing 322 around the output passages 326 and 328, provides lateral stability for the chute 306 during operation thereof. According to the illustrated example, the mouth 325 of the input passage 324 is designed to seat generally flush against the outer periphery of the sorting head 212, whereas the exit peripheries 327 and 329 of the output passages 326 and 328, respectively, are each designed to seat flush against the base plate 302 and circumscribe one of the coin ports 316A, 316B. It is contemplated that the automated coin chute 306 may comprise any number of input passages, output passages, and mechanized diverter plates such that coins can be received from one or multiple exit stations and/or diverted to one or multiple sets of coin ports.

Each coin chute 306 is selectively operable to direct coins received from the coin processing unit 200 to one of the coin-recycling ports 316A or, when desired, to one of the coin-depositing ports 316B. As shown, the automated coin chute 306 includes a curved diverter plate 336 that can selectively transition between a first position, shown at 336A in FIG. 11A, and a second position, designated hidden at 336B in FIG. 11A. This movable diverter plate 336 is rotatably mounted on a diverter shaft 338, both of which are located inside of the chute housing 322 intermediate the output passages 326 and 328. A driving mechanism, which may be in the nature of a 24-volt DC electric motor and gear train assembly 340, is connected to the diverter shaft 338 and is selectively actuable to shift the diverter plate 336 back-and-forth between the first and second positions. When in the first position 336A, coins received from one of the exit stations 281-288 in the sorting head 212 of the coin processing unit 200 by the input passage 324 are redirected by the diverter plate 336 through coin-recycling output 326 to one of the coin-recycling output passages 316A to a coin-recycling receptacle. Conversely, when in the second position, coins that are received by the input passage 324 from an exit station are redirected by the diverter plate 336 through coin-dispending output 328 to one of the coin-depositing output passages 316B to a coin-depositing receptacle.

Figure 12:
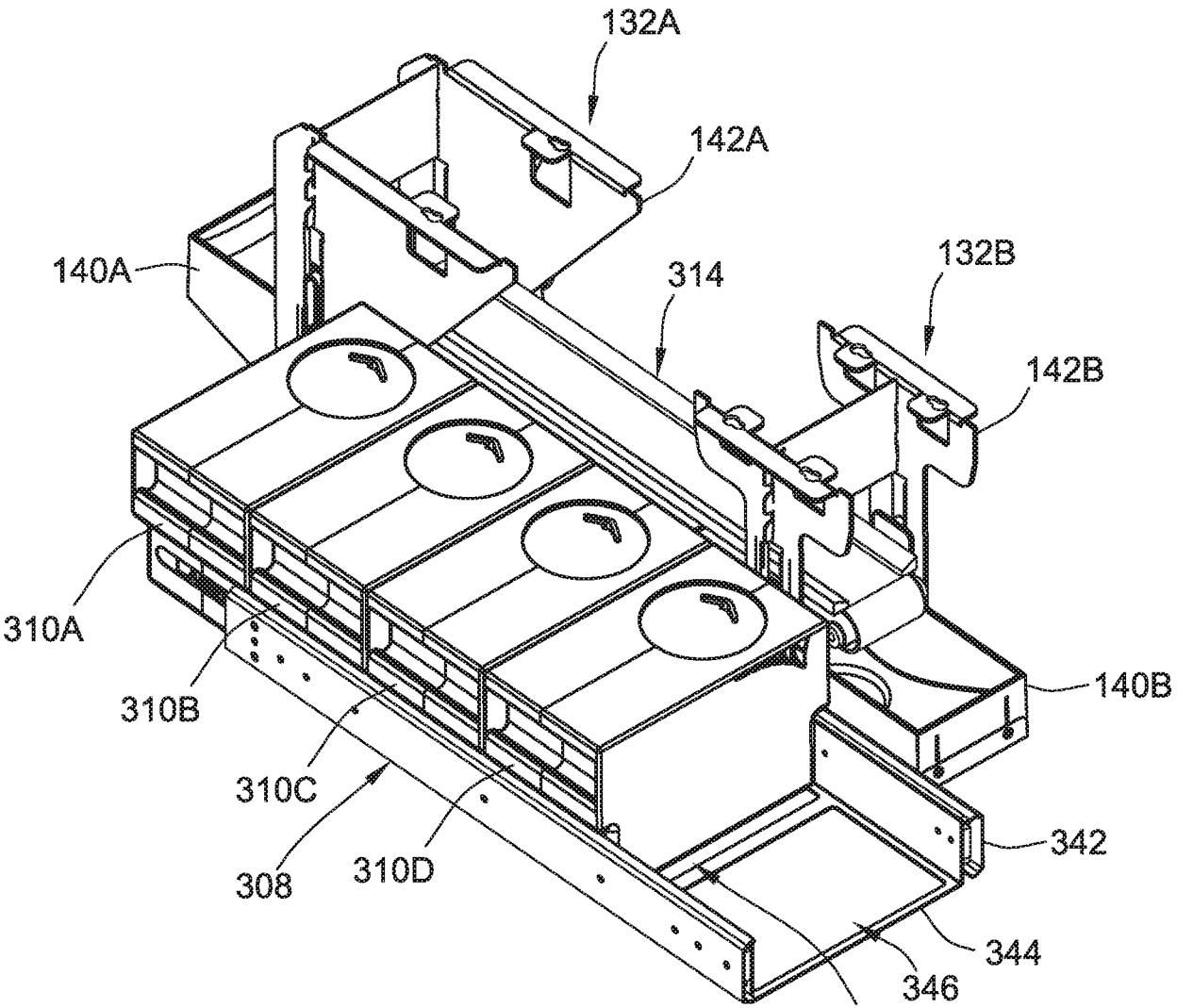
FIG. 12 is a perspective-view illustration of the tote drawer and totes, tote chutes, and conveyor assembly of the CDR Unit of FIG. 8.

As indicated above, CDR Unit 300 is designed to selectively sort processed coins received from a coin processing device into one or more coin-recycling receptacles, such as handheld coin totes 310A-310D of FIGS. 8 and 12 (and/or 410, 410A-410D of FIGS. 14, 18A-18B and 2010A-2010D of FIGS. 20A-20D, 2110A-2110D of FIGS. 21A and 22A-23B), and one or more coin-depositing receptacles, such as wheeled coin bins 110A and 110B of FIGS. 4 and 5. It may be desirable, for at least some configurations, that all of the automated coin chutes 306 be operable to divert coins into the same coin-depositing receptacle(s), whereas select coin chutes 306 are each dedicated to diverting coins to a single one of the coin-recycling receptacles. By way of non-limiting example, a first of the automated coin chutes 306 (e.g., the coin chute 306 at the 8-o-clock position in FIG. 8) receives dimes from one of the exit stations 281 of the sorting head 212, and diverts a select number of said dimes (e.g., approximately 3000 coins) through a corresponding coin port 316A in the base plate 302, which are then passed via tote chute 312D into one of the coin totes 310D. Once a threshold or limit number of dimes (e.g., approximately 3000 coins) is reached, the diverter plate 336 is repositioned, e.g., via a system processor or CPU sending a signal to the appropriate motor 340 to activate the motor to change the position of the corresponding diverter plate 336 from a first coin-recycling position 336A to a second coin-dispending position 336B, such that the first coin chute 306 diverts the remainder of processed dimes through a corresponding coin port 316B in the base plate 302 to the conveyor assembly 314 via coin-mixing manifold 304 for distribution to one or both of the coin bins 110A, 110B. In the same vein, a second of the automated coin chutes 306 (e.g., the coin chute 306 at the 9-o-clock position in FIG. 8) receives pennies from one of the exit stations 282 of the sorting head 212, and diverts a select number of said pennies (e.g., approximately 2500 coins) into one of the coin totes 310C via tote chute 312C. And once that select or threshold number of pennies is reached, the second coin chute 306 diverts the remainder of processed dimes to the coin-mixing manifold 304 for distribution to one or both of the coin bins 110A, 110B, for example, by a system processor or CPU sending a signal to the appropriate motor 340 to activate the motor to change the position of the corresponding diverter plate 336 from a first coin-recycling position 336A to a second coin-dispending position 336B. Third and fourth automated coin chutes 306 can be similarly configured and operated for filling the other two coin totes 310A and 310B with selected numbers of quarters and nickels, respectively, with the remainder being diverted to one or both coin bins 110A, 110B. One or more coin chutes can be employed for diverting coins and other objects (e.g., slugs and extraneous refuse) to coin bags, coin cassettes, reject bins, return slots, etc.

For enhanced security and ease of use, the four handheld coin totes 310A-310B can be removably seated in a lockable tote drawer 308, which is movably mounted inside, yet at least partially retractable from the coin processing machine/system's housing. Tote drawer 308 of FIGS. 8 and 12, for example, can be manually or automatically slid back-and-forth, e.g., on a roller-and-rail track system 342, between a stowed position, as shown in FIG. 8, and an extracted position when the tote drawer 308 is slide in the direction indicated by arrow A1. When in the stowed position, the tote drawer 308 is disposed substantially or entirely inside the housing. An optional locking mechanism (not shown) can secure the drawer 308 inside the housing. Conversely, when in the extracted position, the tote drawer 308 is disposed at least partially outside the housing such that the coin totes 310A-310D can be readily unseated form the drawer 308 and removed from the housing. An optional drawer handle (not shown) can be provided to facilitate manually sliding the drawer in and out of the housing. The tote drawer 308 includes a base 344 with a plurality of tote compartments 346, which are portrayed in FIG. 12 as rectangular apertures, for properly orienting and securing in place the totes 310A-D.

In at least some system configurations, the handheld coin totes 310A-310D of FIGS. 8 and 12 are substantially structurally similar; thus, for brevity and conciseness, common features of these coin totes 310A-310D will be described with respect to the handheld coin tote 310 presented in FIG. 12A. The coin tote 310 of FIG. 12A includes a rigid polymeric body 350 with a generally polyhedral shape and integrally formed bottom and top portions 352 and 354, respectively. To securely seat the coin tote 310 in the tote drawer 308, each tote compartment 346 of the drawer 308 is shaped and sized to complement and receive therein the rectangular base portion 352 of one of the coin totes 310. The rectangular top portion 354 of the tote body 350, on the other hand, is slightly wider than the base portion 352 such that the outwardly projecting ends of the top portion 354 rests on top of the tote drawer 308 when the coin tote base portion 352 is passed into the compartment 346. It is desirable, for at least some embodiments, that a "handheld" coin tote, as disclosed hereinabove and hereinbelow, weighs less than one pound (e.g., when empty) to approximately twenty or fewer pounds (e.g., when full), and be shaped and sized to be comfortably held in the hand or hands of one teenage or adult human. It is envisioned that the coin tote 310 take on alternative shapes and sizes from that which are shown in the drawings. It should be further recognized that the coin totes 310A-310D need not be structurally identical but could vary, for example, in size, shape, color and configuration from one tote to the next.

Figures 12A, 13:
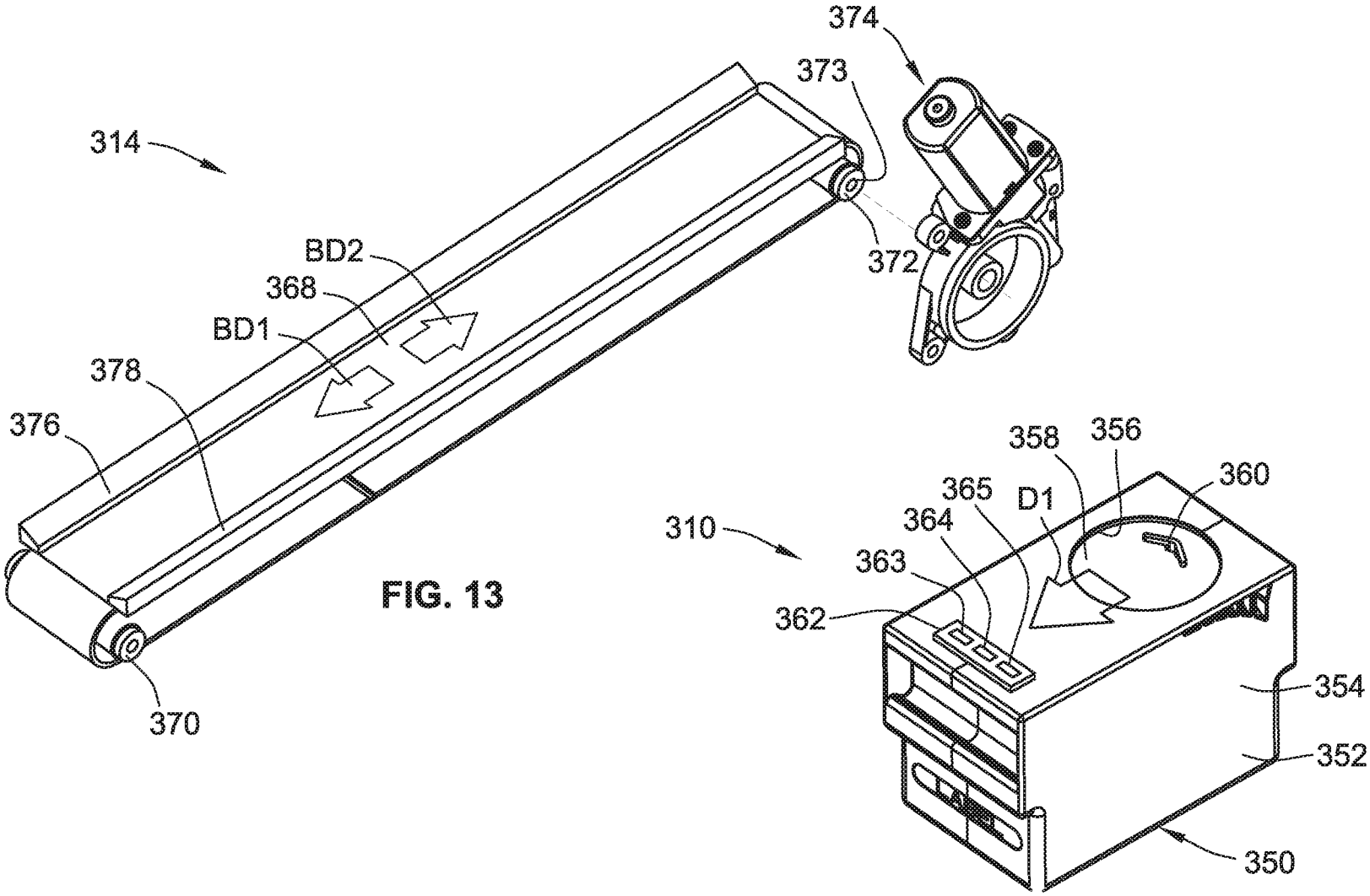
FIG. 12A is a perspective-view illustration of one of the handheld coin totes of the CDR Unit of FIG. 8.
FIG. 13 is a perspective-view illustration of the conveyor assembly of FIG. 8.

With continuing reference to FIG. 12A, a top wall of the top portion 354 of the tote body 350 defines therethrough a coin hole 356 which is covered by a slidable tote lid 358. When the base portion 352 of the coin totes 310 is properly situated in one of the tote compartments 346, and the tote drawer 308 is slid to the stowed position 308A (FIG. 8) inside of the housing, a triangular biasing feature 360 projecting upwardly from the tote lid 358 engages a corresponding tab (not visible in the views provided) that projects downward, for example, from the base plate 302 of CDR Unit 300. As these two features engage, the biasing feature 360 is urged in an opening direction D1 which, in turn, operates to open the tote lid 358 such that coins can be passed from one of the tote chutes 312A-312D through the coin hole 356 into the tote body 350. According to some embodiments, when the tote drawer 308 is slid to the extracted position 308B (FIG. 8) outside of the housing, the triangular biasing feature 360 disengages the tab and, concomitantly, the tote lid 358 is closed, for example, by an internally mounted spring-biased closing feature (not shown). Optional features for the handheld coin totes 310 can include color coding and/or labels that help to identify which handheld coin tote is associated with which particular denomination of coin.

When the coin totes 310A-310D are in one or more predetermined positions, information about the location and/or condition of the totes can be communicated (such as via wired or wireless communication) to a CPU 348 and/or other controller of the CDR Unit 300. For example, such information may be communicated to a communication interface of a controller of the coin processing system/machine. As used herein, "wirelessly communicate" is inclusive of, but not exclusive to, the transmission of information signals between two devices without the use of connecting hardline or wired couplings between the two devices. By way of example, and not limitation, the CDR Unit 300 utilizes a number of electrically conductive interfaces for detecting and/or communicating information about or between one or more or all of the coin totes 310A-310D and a controller and/or CPU 348 of a coin processing system/machine (e.g., FIGS. 1-4). For instance, the coin tote 310 is shown in FIG. 12A including at least one and, in some embodiments, a plurality of electrical contacts, which may comprise a contact junction 362 with first, second and third electrical contact 363-365. The first electrical contact 363 (FIG. 12A) can be configured to cooperate with a complementary electrical contact on a contact pad 366 (FIG. 8) of the CPU 348 to thereby communicate to a system controller a signal indicative of a presence (or absence) of the coin tote 310 in the tote drawer 308. Moreover, the second electrical contact 364 can be configured to cooperate with a complementary electrical contact on the contact pad 366 of the CPU 348 to thereby communicate to the system controller a signal indicating that the coin tote 310 in the drawer 308 is full (or not full). The third electrical contact 365, on the other hand, is configured to cooperate with a complementary electrical contact on the contact pad 366 of the CPU 348 to thereby communicate to the system controller a signal indicating that the coin tote 310 in the drawer 308 is empty (or not empty). When respective contacts 363-365 physically contact respective portions of contact pad 366, one or more electrical circuits are completed and the completion of such circuits is sensed by CPU 348. According to some embodiments, the CPU 348 also acts as a system controller and no separate system controller is needed. For at least some configurations, the coin processing unit 200 can be rendered inoperable if the tote drawer 308 is not in the proper position and/or if a tote security door is not properly closed with at least one coin tote or all four coin totes being present with sufficient storage volume to receive coins. In this regard, the system can be provided with a sensor which detects the position of the door (e.g., door open, door closed, door locked, etc.). Notably, the system can be provided with greater or fewer or alternative sensors than those described above. For instance, the system can be provided with an electrostatic discharge (ESD) sensor and, optionally, an ESD dissipation mechanism. Moreover, the system can be provided with sensors which monitor coin overflow in one or more or all of the coin totes. This overflow sensor can be further operable to render the coin processing unit 200 inoperable if any one of the coin totes is determined to be in an overflow condition. In this regard, one or more of the sensors can be replaced with a single sensing mechanism.

As indicated above, coins redirected by the automated coin chutes 306 through the coin ports 316B of the base plate 302 are deposited by the coin-mixing manifold 304 onto a conveyor belt assembly 314 for transport to coin-depositing receptacles, such as first and second coin bins 110A, 110B disposed inside the housing 134 (FIG. 4). As seen in FIG. 8, the conveyor belt assembly 314 is disposed underneath the base plate 302, e.g., mounted to the brackets 142A and 142B, positioned downstream from the coin processing unit 200 and automated coin chutes 306 and upstream from the coin bins 110A, 110B. The conveyor belt assembly 314 may be operable as a one-way transport system or a bidirectional transport system. According to the example illustrated in FIGS. 12 and 13, the conveyor belt assembly 314 comprises an elastomeric, continuous conveyor belt 368 which functions to transport articles placed upon its visible surface. Conveyor belt 368 rides on an idler roller 370 and is driven by a driven roller 372. A driven shaft 373 of the driven roller 372 can be driven by various suitable means, including a two-way brushless DC electric motor assembly 374. Lateral track rails 376, 378 help to ensure coins deposited on top of the belt 368 do not accidentally fall off of the conveyor belt assembly 314. The conveyor belt assembly 314 can be configured to selectively operate in a first belt direction BD1, whereby coins received from the automated coin chutes 306 are delivered to a first coin bin, e.g., 110A of FIG. 4. For at least some configurations, the conveyor belt assembly 314 is also configured to selectively operate in a second belt direction BD2, whereby coins received from the automated coin chutes 306 are delivered to the second coin bin, e.g., 110B of FIG. 4. In other optional configurations, such as those which employ a single bin, the conveyor assembly can run in a single direction or, optionally, could be removed in its entirety from the system.

Figure 14:
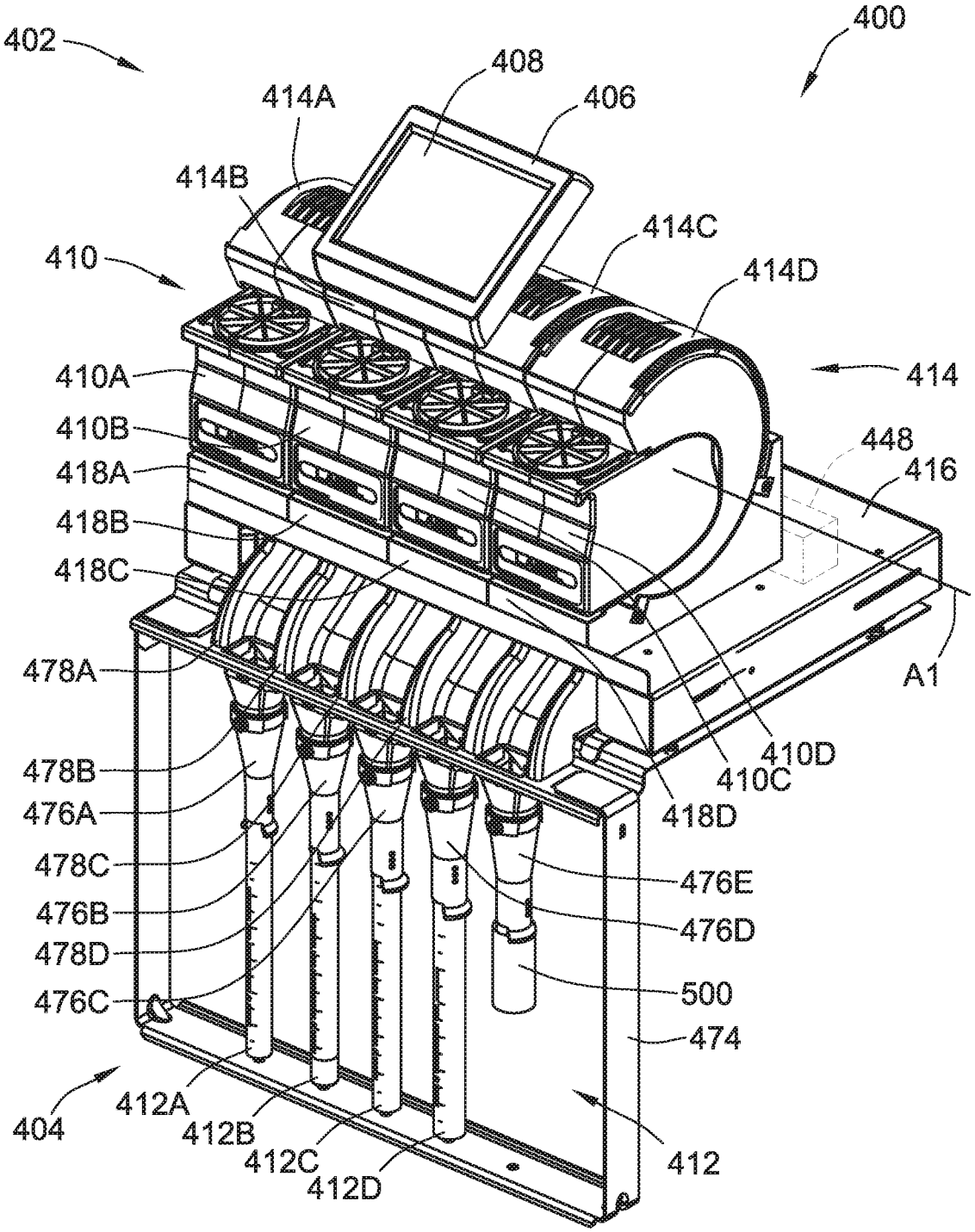
FIG. 14 is a perspective-view illustration of a representative coin-recycling system with a coin-recycling dispenser assembly in accordance with aspects of the present disclosure.

Turning next to FIG. 14, there is shown a representative coin-recycling system, designated generally at 400, for processing coins stowed in handheld coin totes, and sorting the processed coins into single-denomination handheld coin containers. The coin-recycling system 400 has two primary sections: a coin-recycling dispenser assembly 402 that is operatively connected to a coin-recycling till assembly 404. A dispenser assembly housing 416 securely houses various input devices, output devices, input/output devices, internal electronic/electromechanical components, wiring, etc. By way of example, the output device(s) includes an electronic display device 406 that is operatively mounted to the dispenser assembly housing 416 and configured to display information and user-selectable options to a user of the coin-recycling system 400. The coin-recycling dispenser assembly 402 can also be provided with one or more electronic user input devices, such as a touchscreen 408 on the display device 406, for receiving user selections to control one or more operations of the coin-recycling system 400. A resident (or remotely located) processor or central processing unit (CPU) 448 is communicatively coupled to the electronic display device 406 and user input device 408. Only select components of the coin-recycling system 400 have been shown and will be described in detail herein. It should be understood, however, that numerous other peripheral devices and other elements exist and are readily utilizable in any number of combinations to create various forms of a coin-recycling system in accord with the present concepts.

As will be described in further detail below, the coin-recycling dispenser assembly 402 is capable of dispensing coins—one coin at a time—from each of plural handheld coin totes 410 into an assemblage of single-denomination coin cylinders 412 stowed inside the coin till assembly 404. According to some embodiments, the coin cylinders 412 are sized to hold three to four times the number of coins as traditional coin rolls, for example, they may be sized to hold 120-200 coins stacked therein. According to some embodiments, filled coin cylinders 412 may be removed and used in other devices such as coin dispensers and the removed coin cylinders 412 may be replaced with empty coin cylinders 412 so the device 400 may resume operating. It is desirable, for at least some configurations, that the dispenser assembly 402 dispense coins at about 300 to about 500 coins per minute or, in some embodiments approximately 400 coins per minute. According to at least some configurations, coin-recycling system 400 monitors the number and/or denomination of handheld coin totes 410 docked in the coin-recycling dispenser assembly 402, as well as whether there are coins remaining in any of the docked coin totes. For at least some configurations, the coin-recycling system 400 is capable of tracking the number of coins dispensed from a particular coin tote 410 and, optionally, is operable to provide a total number of dispensed coins and/or a total value of dispensed coins for a particular set of coin totes 410 emptied into the coin till 404. For at least some configurations, the dispenser assembly 402 is selectively and/or automatically operable to clear coin jams during emptying of a coin tote. Some implementations provide simplified disassembly or physical manipulation of key sections of the coin-recycling system 400 to allow for manual clearing of a jam condition.

According to the illustrated example, the coin-recycling dispenser assembly 402 is capable of docking four handheld coin totes 410, for example, a first (penny (10)) coin tote 410A, a second (nickel (50)) coin tote 410B, a third (dime (100)) coin tote 410C, and a fourth (quarter (250)) coin tote 410D. A series of tote docks or drums 414 secure these four coin totes 410A-410D to the dispenser assembly 402 for recycling of coins. As shown, the set of tote docks 414 includes a first (penny) dock 414A, a second (nickel) dock 414B, a third (dime) dock 414C, and a fourth (quarter) dock 414D. It is envisioned that the coin-recycling dispenser assembly 402 comprise greater or fewer than four tote docks 414 to accommodate greater or fewer than four coin totes 410, which may comprise any combination of coin denominations of any known currency or substitute currency. Some optional features for the dispenser assembly 402 include denomination labels and color coding for the tote docks 414 to ensure correct matching with the coin totes 410 of the corresponding denomination. By way of example, the first (penny (10)) coin tote 410A may have a blue color and/or a label with a visual indication of the denomination of coin stowed in the tote; the first (penny) dock 414A can take on the same/similar color and/or label to indicate the denomination processed at that dock. In the same vein, the tote docks 414 and coin totes 410 can be configured with complementary structural features to ensure that only totes of the corresponding denomination can be securely seated within a particular tote dock. In a similar regard, the tote docks 414 and coin totes 410 can be configured with complementary structural features to ensure that an apposite coin tote cannot be inserted incorrectly into a particular tote dock.

With continuing reference to FIG. 14, the coin-recycling dispenser assembly 402 includes a rigid housing 416 which provides subjacent support for a series of tote docking stations or cradles 418, namely first, second, third and fourth tote docking stations 418A-418D that coincide in number with the four tote docks 414A-414D. In accordance with the illustrated example, the tote docking stations 418A-418D of FIG. 14 are substantially structurally identical; thus, for brevity and conciseness, additional features of these docking stations 418A-418D will be described with respect to the tote docking stations 418 presented in FIG. 17. In a similar regard, the illustrated tote docks 414A-414D of FIG. 14 are generally structurally identical; thus, for brevity and conciseness, common features of these tote docks 414A-414D will be described with respect to the tote dock 414 presented in FIGS. 15A, 15B and 16. Notably, there may be structural differences between the tote docks 414A-414D, for example, to ensure that only certain coin totes dedicated to a particular coin denomination can be seated in a given dock, as indicated in the preceding paragraph. Likewise, there may be structural distinctions between the tote docking stations 418A-418D, for example, to accommodate applications where the coin totes may have different sizes and/or gross weights and, thus, require larger docks and/or larger driving mechanisms.

Figure 17:
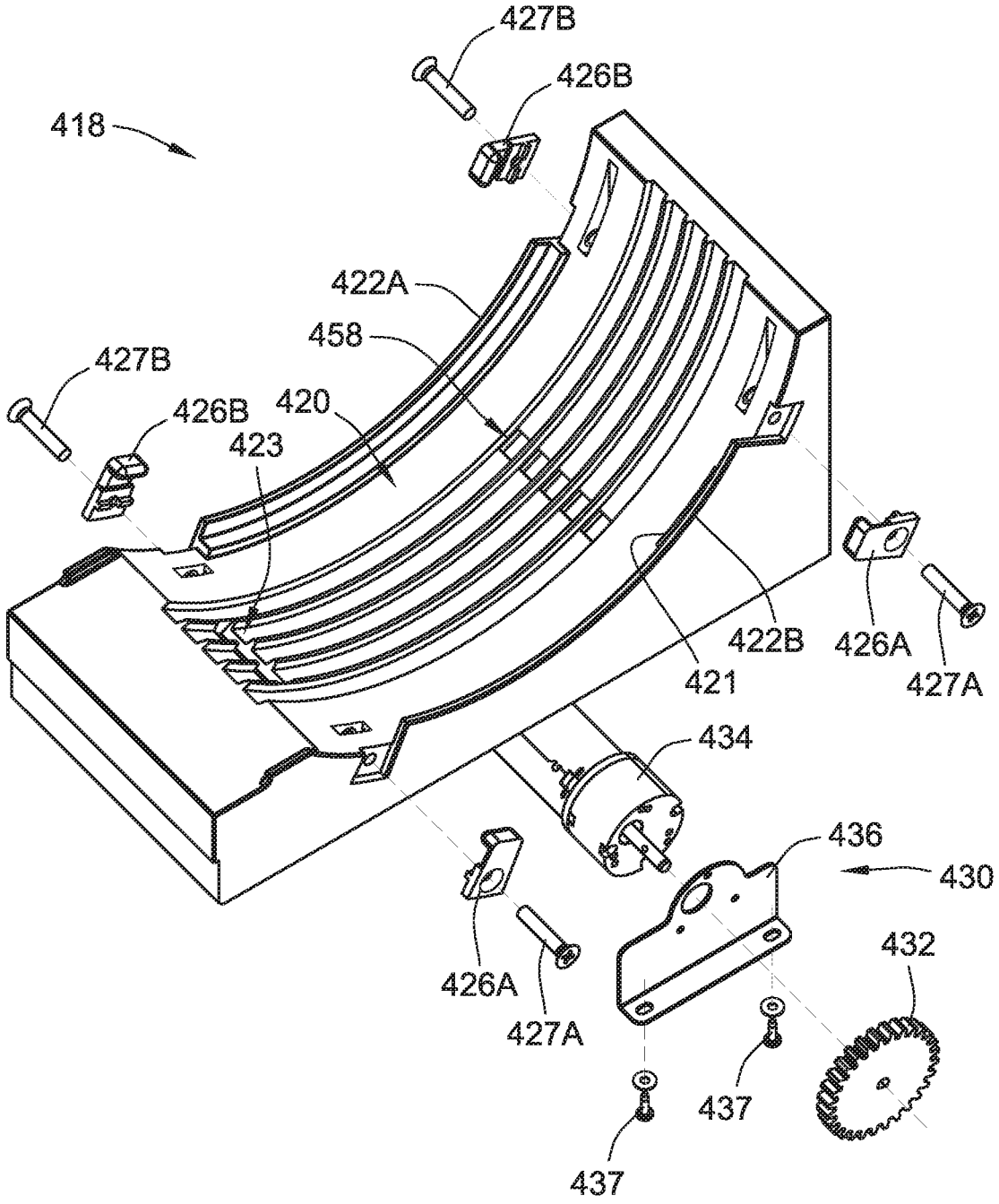
FIG. 17 is a partially exploded perspective-view illustration of one of the coin tote docking stations of FIG. 14.

Tote docking station or cradle 418 of FIG. 17 generally functions to mount one of the tote docks or drums 414 to the housing 416 and to regulate movement of the tote dock 414 during operation of the coin-recycling system 400. To provide said functionality, each docking station 418 is configured with a drive mechanism, which effectuates controlled movement of the tote dock 414, and a guide mechanism, for stabilizing movement of the tote dock 414. For instance, the guide mechanism of the tote docking station 418 of FIG. 17 includes an arcuate guide track 420 with a pair of laterally spaced barrier rails 422A and 422B on opposing sides of the track 420. The tote docking station 418 is also provided with two pairs of retention tabs, namely a first pair of retention tabs 426A secured (e.g., via bolts 427A) at opposing ends of the first barrier rail 422B, and a second pair of retention tabs 426B secured (e.g., via bolts 427B) at opposing ends of the second barrier rail 422A. To operatively interface with the docking station's guide mechanism, the tote dock 414 of FIGS. 15A and 15B includes first and second arcuate guide channels 424A and 424B, respectively, on opposing sides of an arcuate sliding surface 429 of a drum-shaped dock body 428. Each guide channel 424A, 424B has a respective flange 425A and 425B projecting laterally outward from the drum-shaped dock body 428. The guide channels 424A, 424B and flanges 425A, 425B can be seen in FIGS. 15A and 15B extending along the outer circumference of the drum-shaped dock body 428.

When the tote dock 414 is properly seated on top of the tote docking station 418, arcuate sliding surface 429 lies generally flush against the complementary arcuate guide track 420. Concomitantly, inboard surfaces of the laterally spaced barrier rails 422A, 422B press against outwardly facing surfaces of the flanges 425A, 425B. Retention tabs 426A contemporaneously slidably press against an inner diameter (ID) surface of the first flange 425A, while retention tabs 426B slidably press against an ID surface of the second flange 425B. In so doing, the guide track 420, barrier rails 422A, 422B and retentions tabs 426A, 426B prevent radial and transverse rectilinear (i.e., non-rotational) movement of the tote dock 414 while still allowing for selective rotation of the drum-shaped dock body 428 and any contents thereof around central axis A1 (FIG. 14).

As indicated above, the tote docks 414 are rotatably coupled to the tote docking stations 418 such that coin totes 410 seated in the docks 414 can be sufficiently rotated (e.g., turned upside down) to empty their contents into the coin till assembly 404. The coin totes 410 are seated in the docks 414 with the lids 468 in the open position so that when the docks are rotated coins may fall out of the coin totes 410 through the coin holes 465 in each tote 410. The tote docking station 418 is portrayed in FIG. 17 with a drive mechanism that is selectively actuable to rotate at least one of the tote docks 414. Said drive mechanism may be in the nature of a motor-driven gear assembly, designated generally at 430, which comprises a spur gear 432 that is driven by a two-way 24-volt DC electric motor 434. The motor-driven gear assembly 430 is mounted inside the tote docking station 418 underneath the guide track 420, e.g., via a bracket 436 and bolts 437, such that several of the teeth of the spur gear 432 project through a slot 421 in the track 420. To operatively interface with the docking station's drive mechanism, the tote dock 414 includes a toothed track 438 (FIG. 15A) that extends along the outer circumference of the drum-shaped body 428 adjacent the first arcuate guide channel 424A. This toothed track 438 has teeth that interleave with the teeth of the spur gear 432 of the motor-driven gear assembly 430. Through this engagement, the motor-driven gear assembly 430 can be activated in a first direction (e.g., counterclockwise in FIG. 14) to rotate the tote dock 414 from a loading position, whereat the coin tote 410 can be inserted into or removed from the tote dock 414, to a dispensing position, whereat the coins stowed inside the coin tote 414 are dispensed, one at a time, through the tote docking station 418 into one of the coin containers 412A-D. The tote docking station 418 includes a coin slot 423 that transmits coins, one at a time, from the tote 410 and tote dock 414, through the docking station 418, and into one of the coin containers 412 in the coin-recycling till assembly 404. After the tote 410 is emptied or to remedy a coin-jam condition, the motor-driven gear assembly 430 can be activated in a second direction (e.g., clockwise in FIG. 14) to rotate the tote dock 414 from the dispensing position back to the loading position or stopping at any location therebetween.

The retentions tabs 426A, 426B can also act as a rotation limiting/stopping mechanism. In the illustrated example, each of the tote docks 414 includes a first pair of stopping shoulders 431A (FIG. 15A), with one located at each end of the first guide channel 424A, and a second pair of stopping shoulders 431B (FIG. 15B), with one located at each end of the second guide channel 424B. During rotation of the tote dock 414 in a first direction (e.g., clockwise in FIG. 14), the stopping shoulders 431A and 431B at the top of the tote dock 414 (e.g., in FIG. 15A) will abut the rotation stop (e.g., the retentions tabs 426A, 426B to the right in FIG. 17) at a predetermined rotational distance and thereby limit rotation of the tote dock in the first direction. Conversely, when the tote dock 414 is rotated in a second direction (e.g., counterclockwise in FIG. 14) the stopping shoulders 431A and 431B at the bottom of the tote dock 414 (e.g., in FIG. 15A) will abut the rotation stop (e.g., the retentions tabs 426A, 426B to the left in FIG. 17) at a predetermined rotational distance and thereby limit rotation of the tote dock in the second direction. Rotation of the tote docks 414 can also/alternatively be regulated through modulation of a corresponding drive mechanism 430. While the tote docks 414A-414D may be driven independently by separate motors 434 according to some embodiments, according to some embodiments, in single motor may be used to drive all tote docks 414A-414D simultaneously.

Figure 18A:
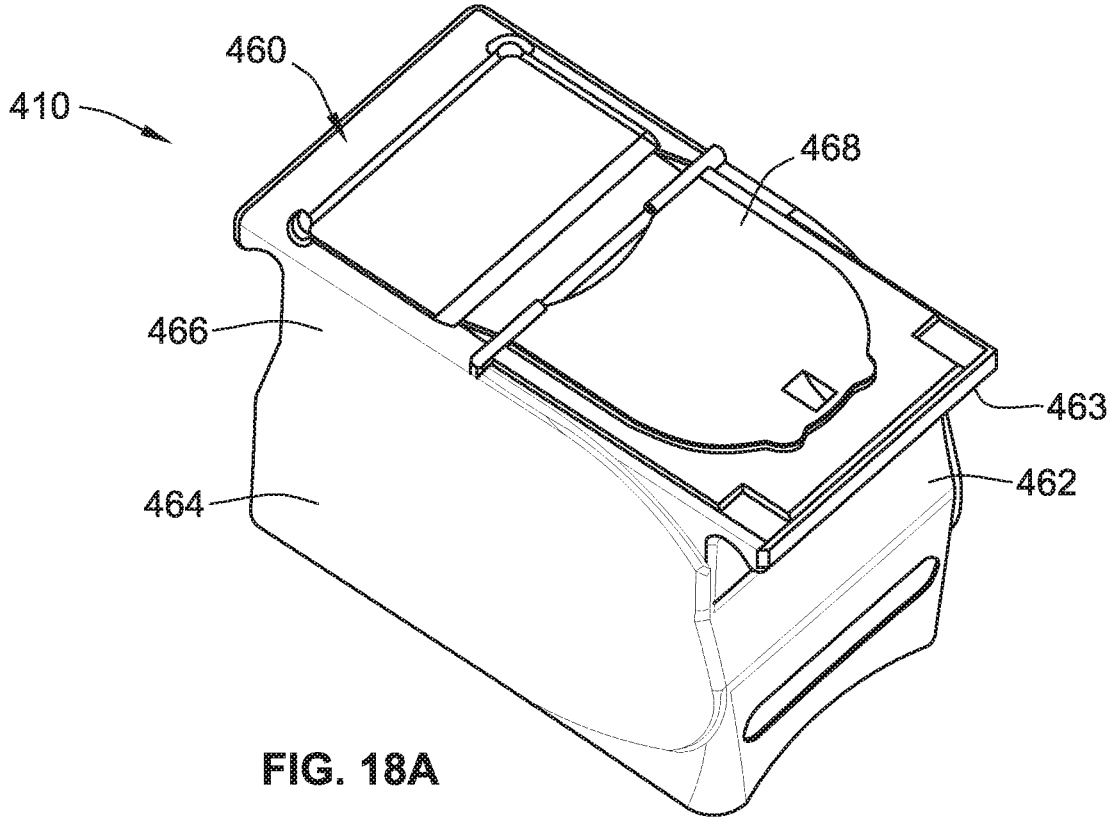
FIGS. 18A and 18B are perspective-view illustrations of one of the coin totes of FIG. 14 with the tote lid in a closed position and an open position, respectively.
Figure 18B:
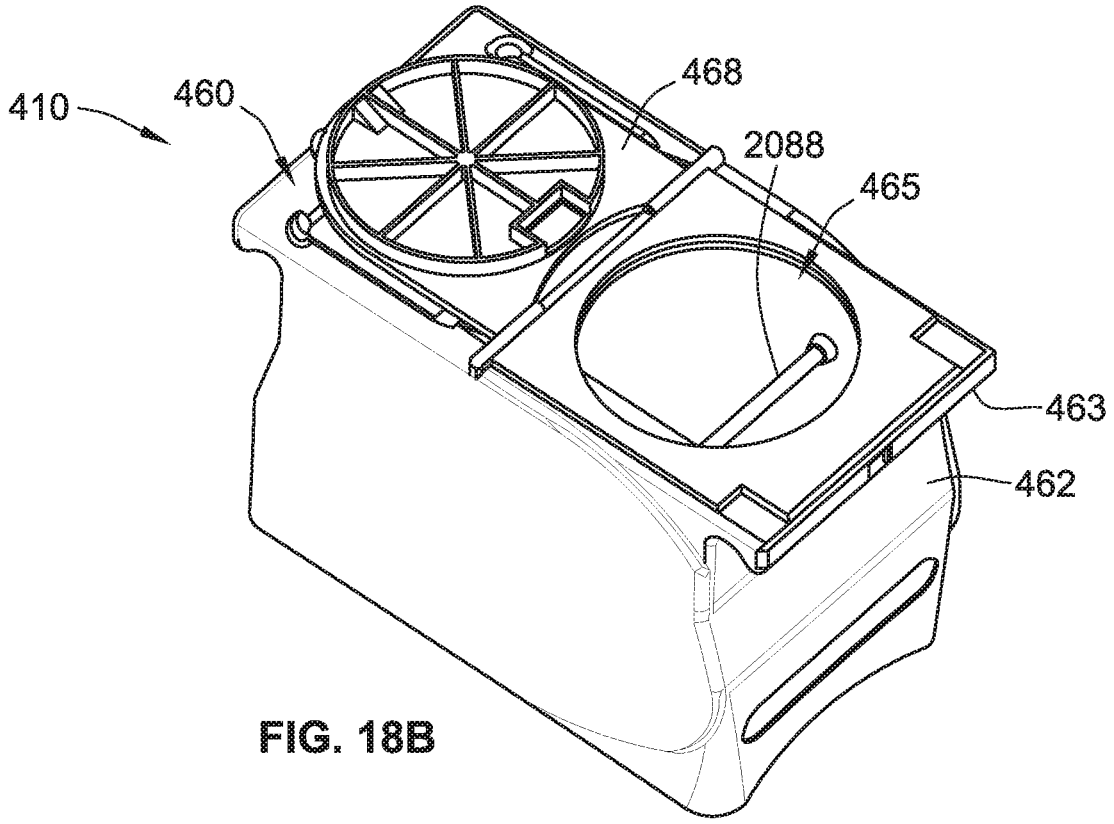

Referring again to FIGS. 15A and 15B, the drum-shaped dock body 428 of the tote dock 414 includes a tote pocket 440 that is shaped and sized to slidably receive therein one of the coin totes 410. Lateral guide walls 444A and 444B of the tote pocket 440 help to direct the coin tote 410 as it is being inserted into or retracted from the tote dock 414. For at least some embodiments, this tote pocket 440 is provided with a contoured inside surface 441 with one or more geometric features, such as a distinctly shaped shelf 443. This shelf 443 will seat thereon a corresponding overhang 463 of the coin tote 410 such that the contoured inside surface 441 will lie flush against a complementary contoured wall 462 of the tote's rigid polymeric body 460 (FIGS. 18A and 18B). The mating of these structural features helps to ensure the proper orientation of the coin tote 410 when inserted into the tote pocket 440 as the contoured wall 441 and shelf 443 will prevent the coin tote 410 from being seated completely inside the tote dock 414 unless it is properly oriented (e.g., with the topside facing up and the coin hole 465 (FIG. 18B) being presented with the leading end). Likewise, the contoured surface 441 and/or shelf 443 of the tote dock 414 can be distinctly shaped and/or sized to only mate with those coin totes of a particular denomination that have a contoured wall 463 and overhang 463 sized and shaped to mate with that tote dock 414. A spring loaded latch mechanism 446 on the floor of the tote pocket 440 will engage a corresponding slot in the base of the coin tote 410 when the tote is properly oriented and completely seated inside the tote dock 414.

Figure 15A:
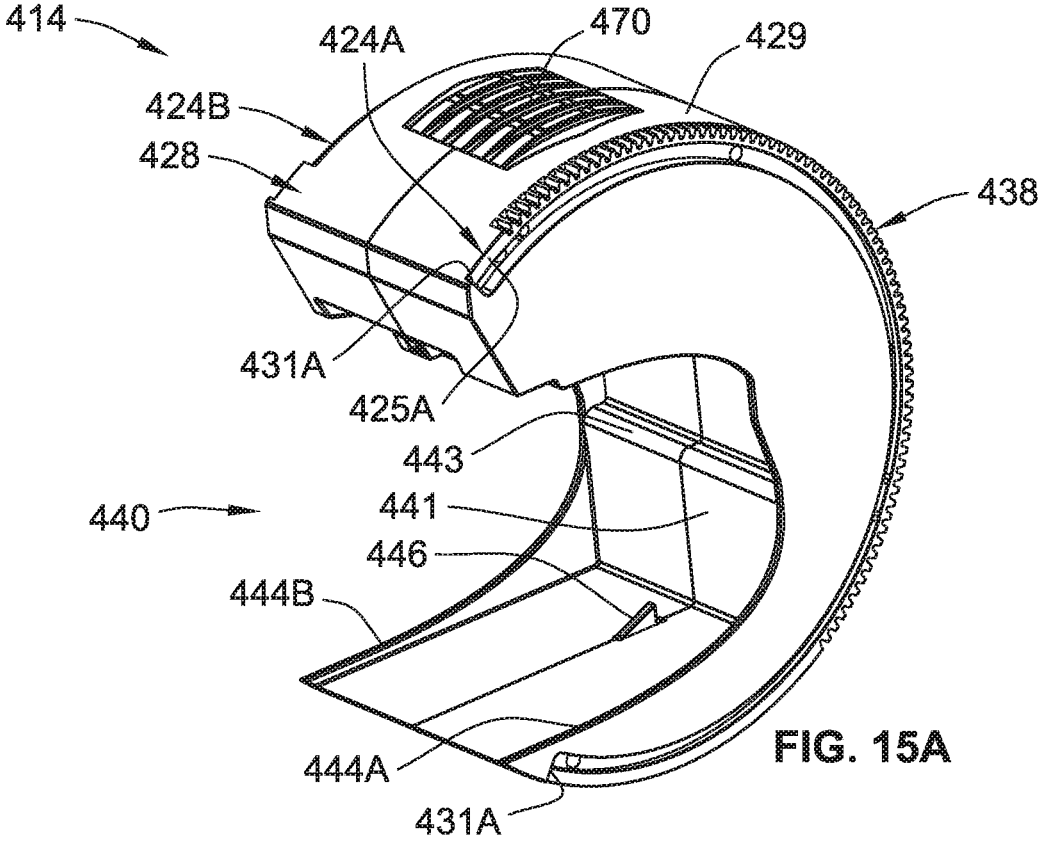
FIGS. 15A and 15B are top and bottom perspective-view illustrations, respectively, of one of the coin tote docks of FIG. 14.
Figure 15B:
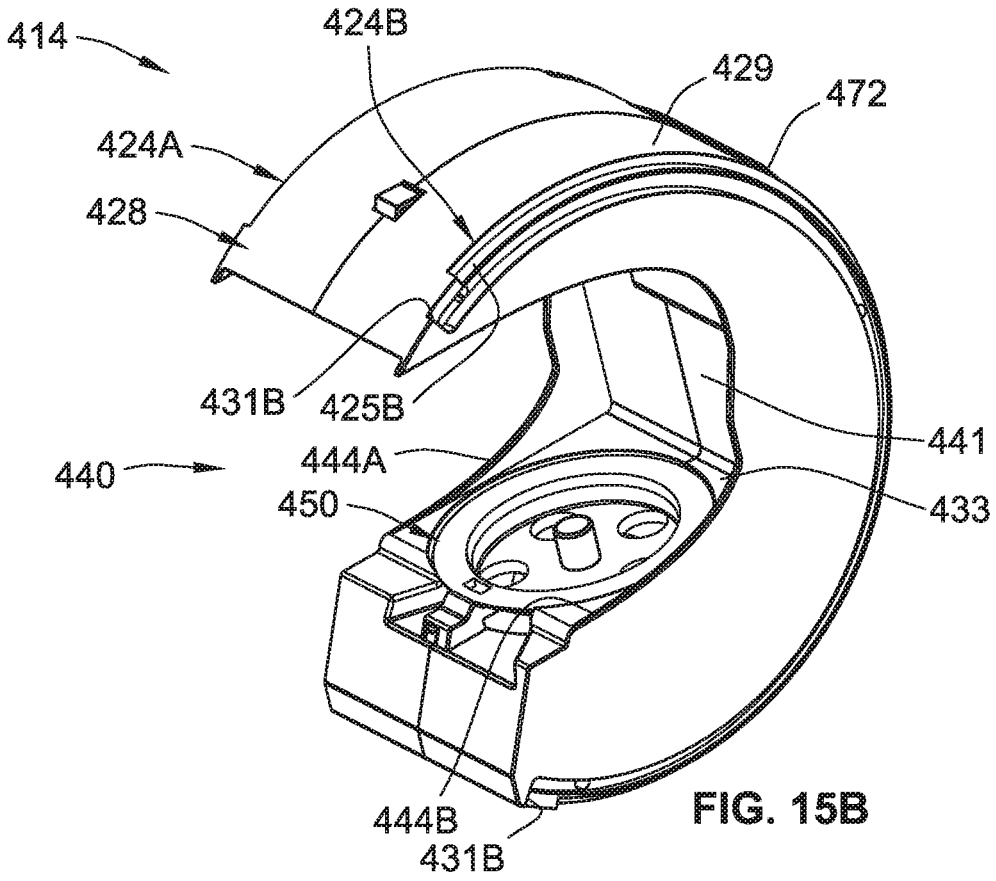
Figure 15C:
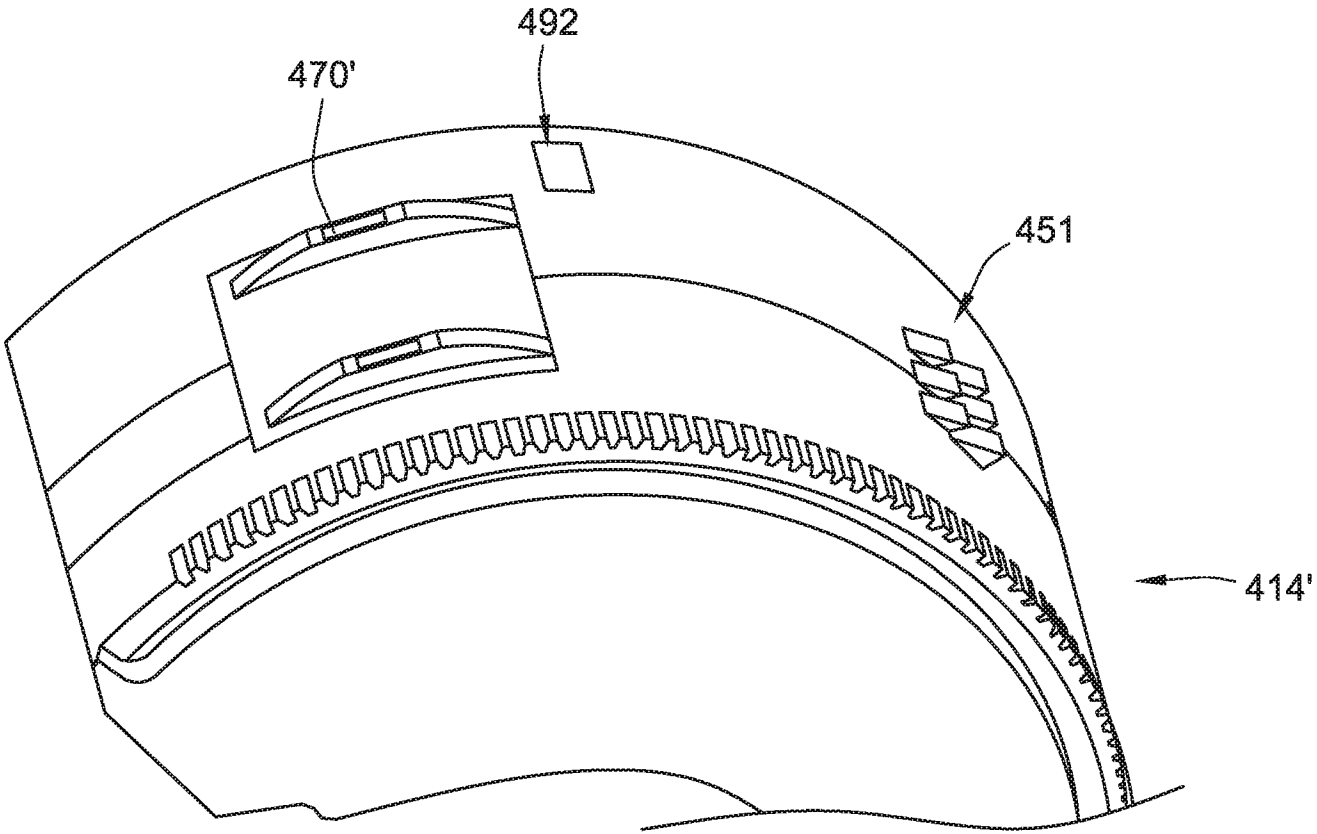
FIG. 15C is a bottom perspective view of an alternative embodiment of a tote dock or drum.
Figure 16:
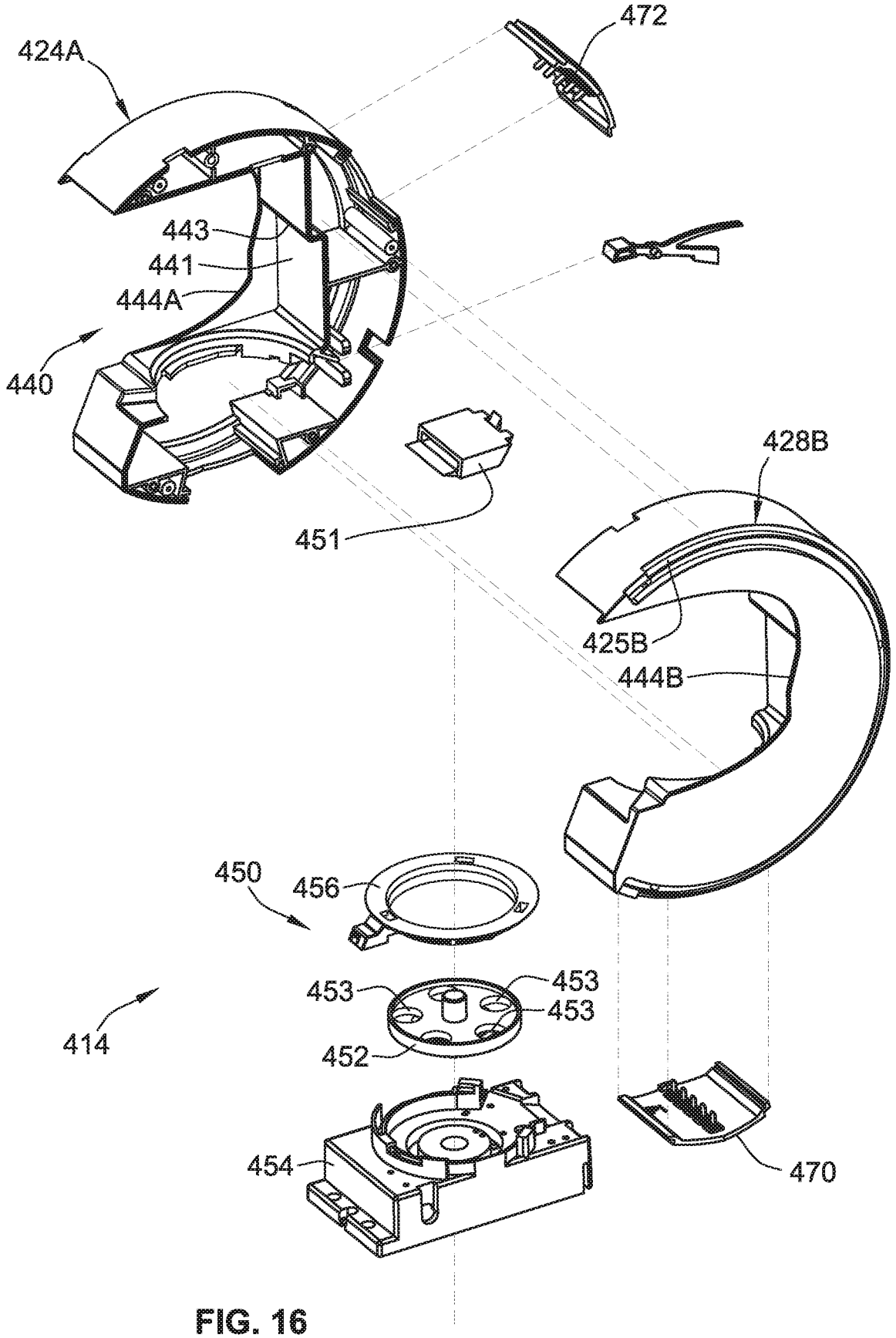
FIG. 16 is a partially exploded perspective-view illustration of one of the coin tote docks of FIG. 14.

With reference to FIG. 16, each tote dock 414 is outfitted with an automated coin disk assembly or HIMECS dispenser 450 that is selectively actuable to separates coins received from a docked coin tote 410 through coin hole 465 such that coins are transmitted, one at a time, from the coin tote 410 out of a coin channel 451 in the tote dock 414 (not shown in FIGS. 15A and 15B but is visible in FIG. 15C) to the coin slot 423 of a tote docking station 418. Automated coin disk assembly 450 includes a coin rotor 452 that is rotatably mounted to a disk motor 454 via a bezel 456. The disk motor 454 and, thus, the coin rotor 452 are mounted to a roof deck 433 of the drum-shaped tote dock body 428. The coin rotor 452 has plural disc-shaped openings 453 that receive therein coins from a docketed coin tote 410. When the tote dock 414 is inverted (e.g., as seen in FIG. 15B) through operation of the docking station 418, the disk motor 454 is selectively actuable to rotate the coin rotor 452. Spinning the coin rotor 452 operates to sequentially pull coins from a docked coin tote 410 that has been inverted, and transmit coins, on a piecemeal basis, to through the slot 423.

According to some embodiments, the tote docking station 418 includes an array electrical contacts 458 that electrically couples with first and second electrical contact pads 470 and 472 when the tote dock 414 is rotated to first and second predetermined dock orientations, respectively. For instance, rotation of the tote dock 414 to a first predetermined orientation (e.g., as seen in FIG. 15B) mates the first electrical contact pad 470 with the array of electrical contacts 458, which operates to selectively actuate the disk motor 454 of the coin disk assembly 450. Rotation of the tote dock 414 to a second predetermined orientation (e.g., as seen in FIG. 15A), on the other hand, mates the second electrical contact pad 472 with the array of electrical contacts 458 such that coin data is transferrable from a coin sensor. This coin data may include, for example: (1) the presence/absence/type of a coin tote docked in the tote dock 414; (2) the presence/absence of coins in a coin tote docked in the tote dock 414; (3) a tote full condition of a coin tote docked in the tote dock 414.

Figure 16A:
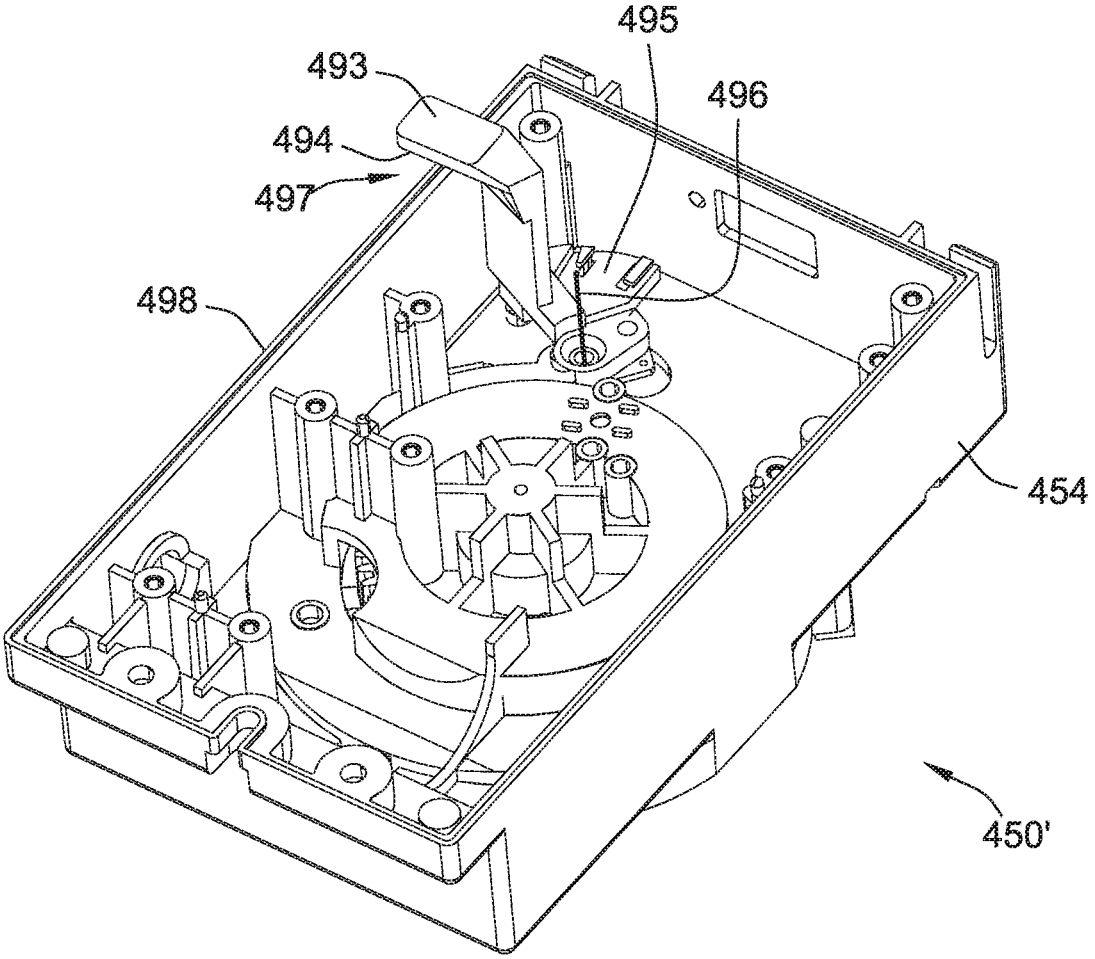
FIG. 16A is a bottom perspective view of an alternative embodiment of automated coin disk assembly or HIMECS dispenser.
Figure 17A:
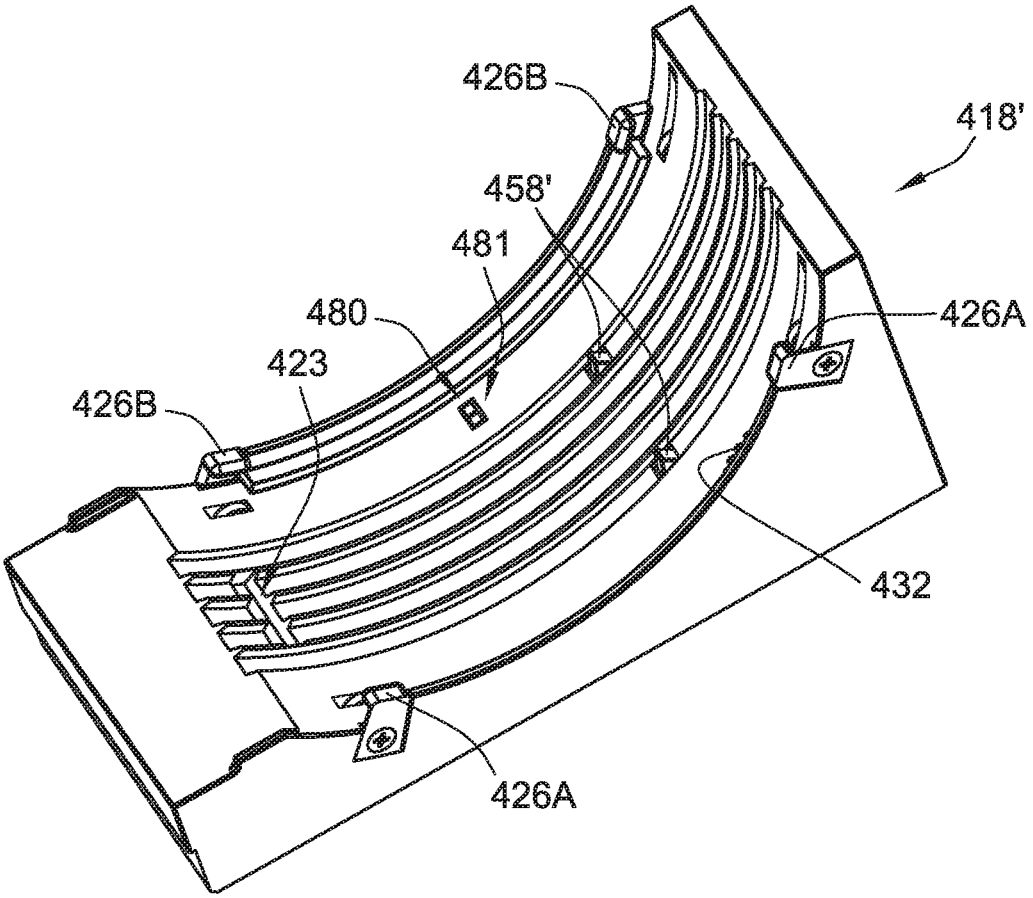
FIG. 17A is a perspective view of an alternative embodiment of tote docking station or cradle.

FIG. 15C is a bottom perspective view of an alternative embodiment of a tote dock or drum 414' similar in operation and construction to tote dock 414 described above. FIG. 16A is a bottom perspective view of an alternative embodiment of automated coin disk assembly or HIMECS dispenser 450' similar in operation and construction to automated coin disk assembly or HIMECS dispenser 450 described above. FIG. 17A is a perspective view of an alternative embodiment of tote docking station or cradle 418' similar in operation and construction to tote docking station or cradle 418 described above. Only the differences from tote dock 414, automated coin disk assembly or HIMECS dispenser 450, and docking station or cradle 418 will be described. The tote docking station 418' has an infrared (IR) transmitter 480 that generates and projects an infrared (IR) beam generally upward as view in FIG. 17A. Adjacent to the IR transmitter 480 is an infrared (IR) detector 481. The array of five electrical contacts 458 of tote docking station 418 in FIG. 17 is replaced with an array of two electrical contacts 458' in tote docking station 418'. The tote dock 414' an aperture 492 to allow infrared beam generated by IR transmitter 480 and reflected to IR detector 481 to pass there through. Electrical contact pad 470 of tote dock 414 is replaced with an electrical contact pad 470" on tote dock 414'. Turning to FIG. 16C, automated coin disk assembly 450' has a coin counting assembly 497 comprises a reflective surface 493 mounted on an arm 494 of a base 495 which pivots about axis 496.

In operation, when the tote dock 414' is rotated into a coin dispensing position (as is FIG. 15B), the IR beam proceeds from the IR transmitter 480 and through the hole or aperture 492 in the tote dock 414'. When the arm 494 is an outward extending position (as shown in FIG. 16A), the IR beam strikes the reflective surface 493 and is reflected back through the aperture 492 and is detected by IR detector 481. When the arm 494 and the reflective surface 493 are positioned inboard of a side wall 498 of the disk motor 454, the IR beam is not reflected back to the IR detector 481. A processor controls the coin counting assembly 497 so that it rotates to an inward extending position every time a coin is passed through the slot 423 such that the arm 494 and the reflective surface 493 are positioned inboard of a side wall 498 of the disk motor 454; but otherwise, rotates it to the outward extending position. The rotation and position of the coin counting assembly 497 is controlled by a motor coupled to base 495. Accordingly, the IR detector 481 can count every time a coin is dispensed through slot 423 by detecting each time it does not detect the IR beam when the tote dock 414' is in the dispensing position.

Turning back to FIG. 14, the coin till assembly 404 includes a rigid outer till housing 474 with a plurality of coin funnels 476A-476D stowed inside the till housing 474. Shown hanging from the top of the till housing 474, each coin funnel 476A-476D has removably mounted at a narrow bottom end thereof one of the coin cylinders 412A-412D, respectively. A row of coin chutes 478A-478D functionally and mechanically attaches the till housing 474 to the dispenser assembly housing 416. Each coin chute 478A-478D receives coins from a respective coin tote 410A-410D that are transmitted through a respective tote dock 414A-414D and docking station 418A-418D, and direct those coins, under the force of gravity, into one of the coin containers 412A-412D through one of the coin funnels 478A-478D.

For at least some configurations, the handheld coin totes 410A-410D of FIG. 14 are substantially structurally similar; thus, for brevity and conciseness, common features of these coin totes 410A-410D will be described with respect to the handheld coin tote 410 presented in FIGS. 18A and 18B. Along the same lines, the handheld coin tote 410 presented in FIGS. 18A and 18B can share features and options with the handheld coin tote 310 discussed above with respect to FIG. 12A, and vice versa. Coin tote 410 of FIGS. 18A and 18B, for example, includes a rigid polymeric body 460 with integrally formed bottom and top portions 464 and 466, respectively. Similar to the tote 310, handheld coin tote 410 can be shaped and sized to securely seat in the tote drawer 308 presented in FIGS. 8 and 12. In addition, a top wall of the top portion 466 of the tote body 460 defines therethrough a coin hole 465 which is covered by a tote lid 468 that is hinged to the tote body 460. The coin tote 410 may also have a rigid bar 2088 extending from one side of the tote to the other below the opening 465. This bar will be described more below in connection with FIG. 20D.

The coin totes 410A-410D can be configured to stow a predetermined quantity of a selected coin denomination. By way of non-limiting example, first (penny) tote 410A can be sized to hold approximately 2400-2500 coins (about 50 rolls of pennies); second (nickel) coin tote 410B can be sized to hold approximately 1500-1600 coins (about 37-40 rolls of nickels); third (dime) coin tote 410C can be sized to hold approximately 2500-3000 coins (about 50-60 rolls of dimes); and fourth (quarter) coin tote 410D can be sized to hold approximately 1100-1200 coins (about 30 rolls of quarters). As indicated above, each tote 410 is individually removable from and insertable into the tote drawer 308 and the coin-recycling dispenser assembly 402. It is desirable, for at least some applications, that the coin tote 410 be configured to inserted and removed at any time, whether full, partially full, or empty. As shown, the tote body 460 is ergonomic, robust and easy to carrying. The tote lid 468 can be locked, for example, with a security tie wrap. For at least some embodiments, the coin tote 410 must withstand drops from at least approximately 4 ft high without fracturing or loosing coins. For at least some embodiments, the coin tote 410, when fill, is not to exceed approximately 20 pounds or, for some embodiments, not to exceed approximately 17 pounds or, for some embodiments, weighs about 14-16.5 lbs. The total envelope dimensions for at least some configurations is about 4.5 inches by about 8 inches by about 5⅜ inches.

Figure 19B:
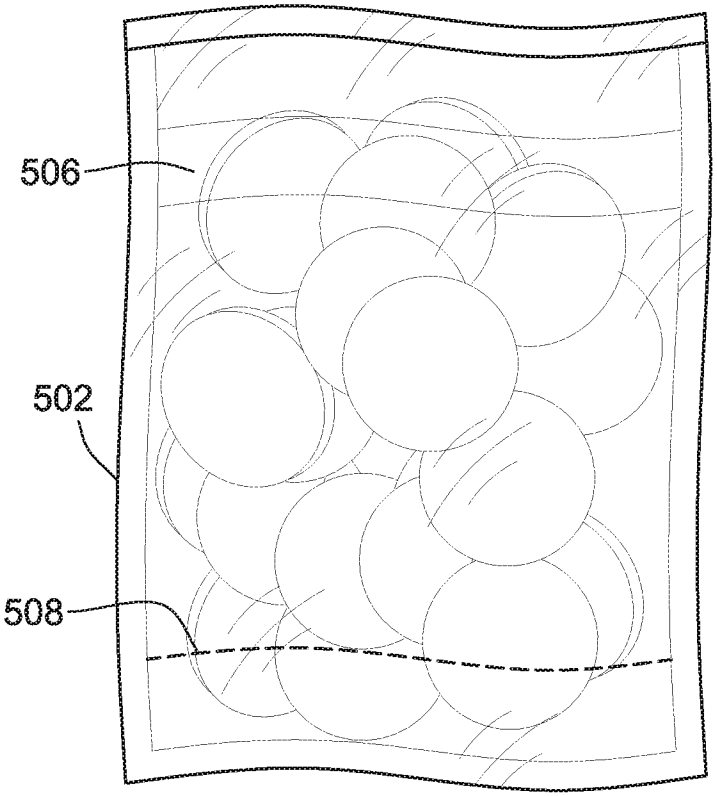
FIGS. 19A and 19B are front-view illustrations of a representative tamper-evident coin bag in accordance with aspects of the present disclosure.
Figure 19A:
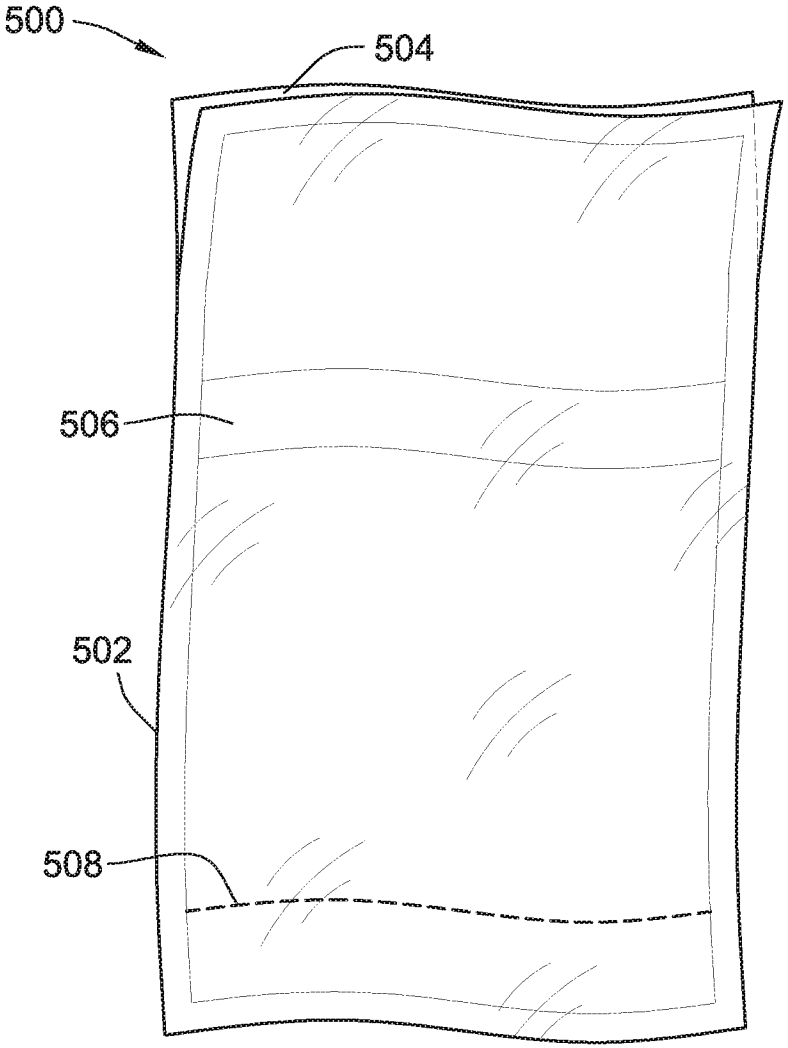

FIGS. 19A and 19B show a coin bag 500 for storing a plurality of coins. The coin bag includes an at least partially transparent and flexible polymeric body 502 with a first (top) end having an opening 504 configured to receive therethrough plural coins, and a seal 506 for securing close the opening in the first end. A second end of the coin bag body 502 has a frangible portion 508 that can be manually opened such that coins can be emptied from the coin bag 500 through the opened frangible portion 508. Utilizing this specially designed coin bag 500, obstacles are removed for retailers and other businesses needing prepackaged coin. The bag 500 is designed for uniformity, visibility, durability, validity, is also tamper evident, easy to open and low cost. The coin bag 500 shape and size can be the same for all denominations. Coins are visible through the transparent/partially transparent body 502 and, thus, it is easier to verify the contents and denomination of the bag 500. Strong polymeric body 502 is durable to withstand drop tests. The coin bag 500 is also provided with tamper indicators to show signs of tampering and reduce likelihood of theft. The coin bag 500 is relatively inexpensive (e.g., lower cost than paper rolls). The coin bag 500 eliminates the need for special automated coin wrapping machines to create coin rolls in a format that is acceptable to the retailer. According to some embodiments, coin cylinders 412A-412D of FIG. 14 can be removed and replaced with coin bags 500. One such coin bag 500 is illustrated in FIG. 14 coupled to coin funnel 476E such as by a bag clamp. According to some embodiments, coin cylinders 412A-412D of FIG. 14 can be removed and replaced with coin wrappers such as paper coin wrappers. Coins are dispensed into and stacked in the coin wrappers.

Figure 20A:
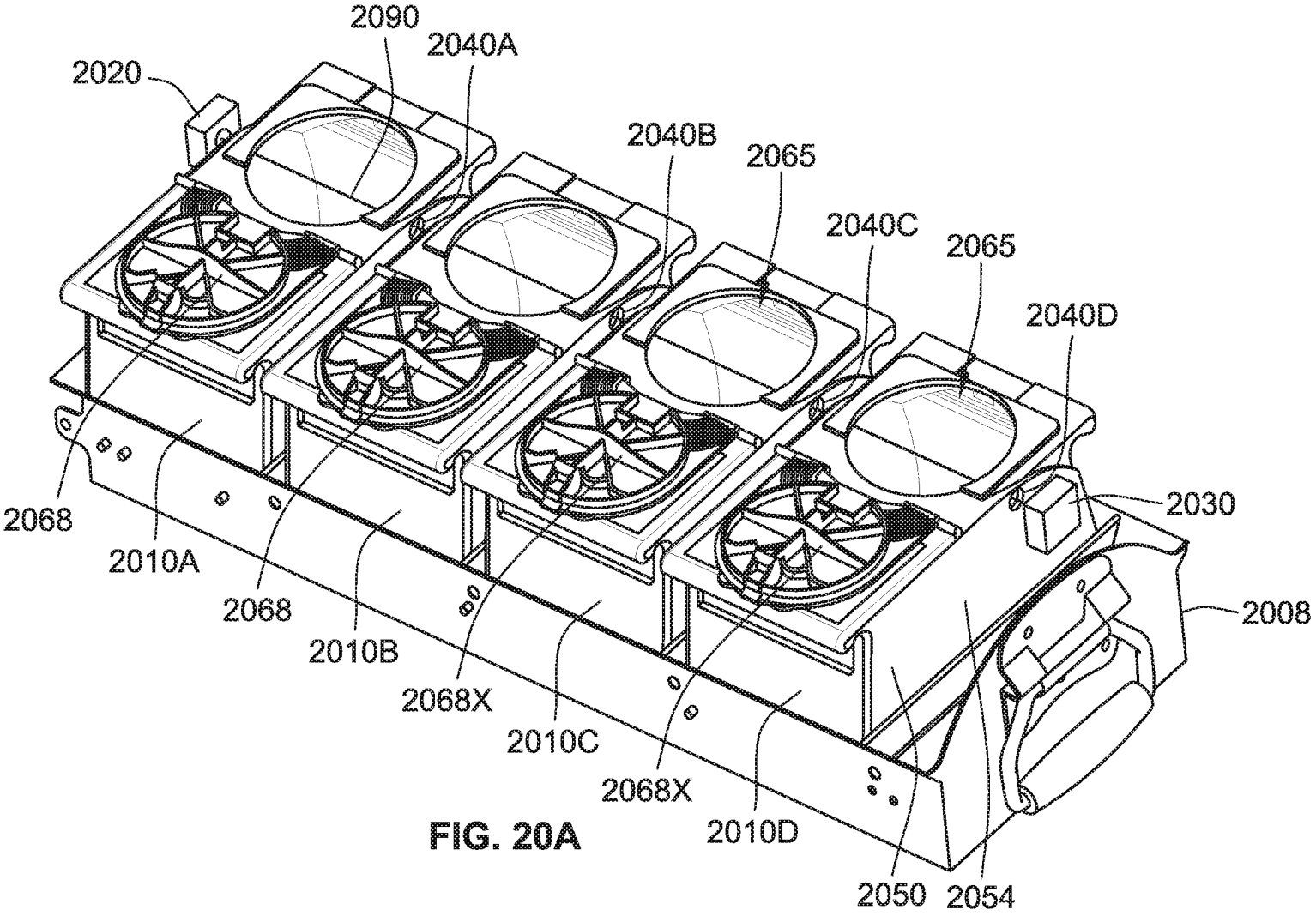
FIGS. 20A-20E are perspective views of tote drawers.
Figure 20B:
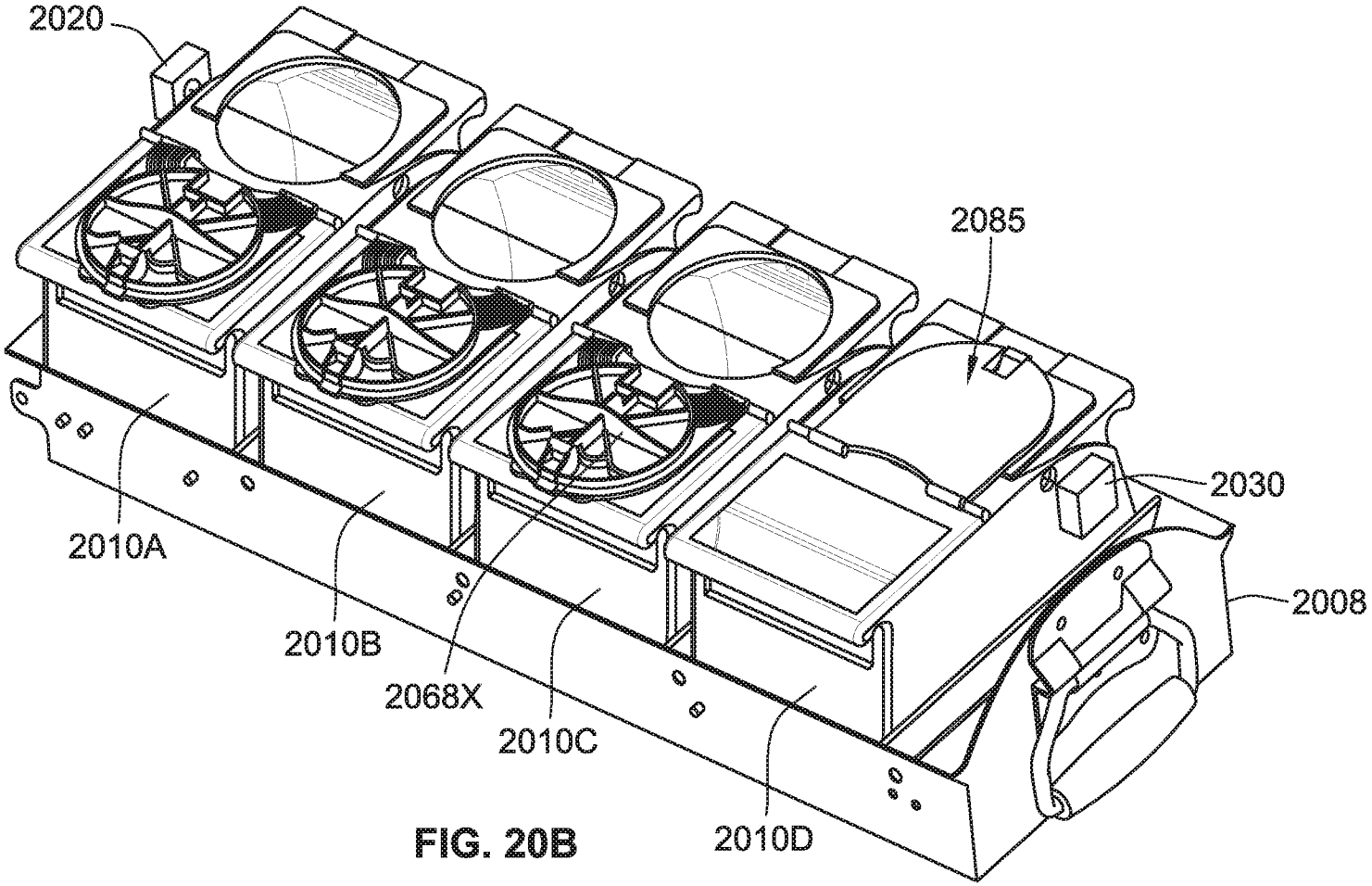

Turning to FIGS. 20A and 20B, four coin totes 2010A-2010D are positioned in a tote drawer 2008. Each of the coin totes 2010A-2010D are similar to coin totes 310A-310D and coin totes 410A-410D described above and have a tote body 2050 having an upper portion 2054. Similarly, tote drawer 2008 is similar to tote drawer 308 described above. Each coin tote 2010A-2010D has a coin hole 2065 and a tote lid 2068. Each coin tote 2010A-2010D has a plurality of openings or infrared transparent regions 2040A-2040D located in top portions 2054 of the tote body 2050 near the coin hole 2065 (note only one opening 2040 in visible in each tote 2010). When the coin totes 2010A-2010D are positioned in the tote drawer 2008, the openings or infrared transparent regions 2040A-2040D are lined up along a common axis 2090.

When the tote drawer 2008 is positioned in an operable position such as the position 308A of tote drawer 308 in the coin depositing and recycling unit (CDR Unit) 300 of FIG. 8, an infrared source 2020 is positioned adjacent to an opening 2040A in a first coin tote 2010A and an infrared receiver or sensor 2030 is positioned adjacent to an opening 2040D in a fourth coin tote 2010D. When all tote lids 2068 are in the open position, an infrared light beam travels from the infrared source 2020 along the common axis 2090 and is sensed by infrared sensor 2030.

Each tote lids 2068 has an infrared opaque flange 2068X. When a tote lid 2068 is positioned in its closed position (as seen in FIG. 20B for coin tote 2010D), the infrared opaque flange 2068X is positioned so as to traverse and block the common axis 2090 and the infrared beam emitting from the infrared light source 2020. Similarly, if enough coins are received in a coin tote 2010A-2010D, they will be piled high enough so a coin blocks the common axis 2090 and the infrared beam emitting from the infrared light source 2020.

Thus, according to some embodiments, whether any coin totes 2010A-2010D have a lid 2068 in a closed position can be determined using a single infrared source 2020 and a single infrared sensor 2030. Likewise, according to some embodiments, whether any coin totes 2010A-2010D have coins piled herein above a certain height can be determined using the same single infrared source 2020 and the same single infrared sensor 2030. According to some embodiments, if the infrared sensor 2030 stops detecting the infrared light beam from the infrared source 2020, a controller communicatively coupled to the infrared sensor 2030 sends a signal setting a full coin tote condition status in a memory communicatively coupled to the controller that in turn causes a controller or CPU to halt the coin sorter such as by halting the rotatable disk 214 shown in FIG. 6 in the coin processing machine 10, 1020, 1030 of FIGS. 1-3 or coin processing machine 100 of FIG. 4 or coin depositing and recycling unit 300 of FIG. 8. Thus, the infrared sensor 2030 can detect a coin tote full condition by detecting when a coin tote has a pile of coins therein that a stacked so high as to interrupt of the infrared light beam, which in turn can be used to prevent coins from overfilling a coin tote 2010A-2010D.

Similarly, if an attendant loads coin totes 2010A-2010D onto the coin drawer 2008 and forgets to open a tote lid 2068 of any coin tote 2010A-2010D, the infrared sensor 2030 will detect this condition and prevent the coin processing machine or system, or coin depositing and recycling unit from starting.

Figure 20C:
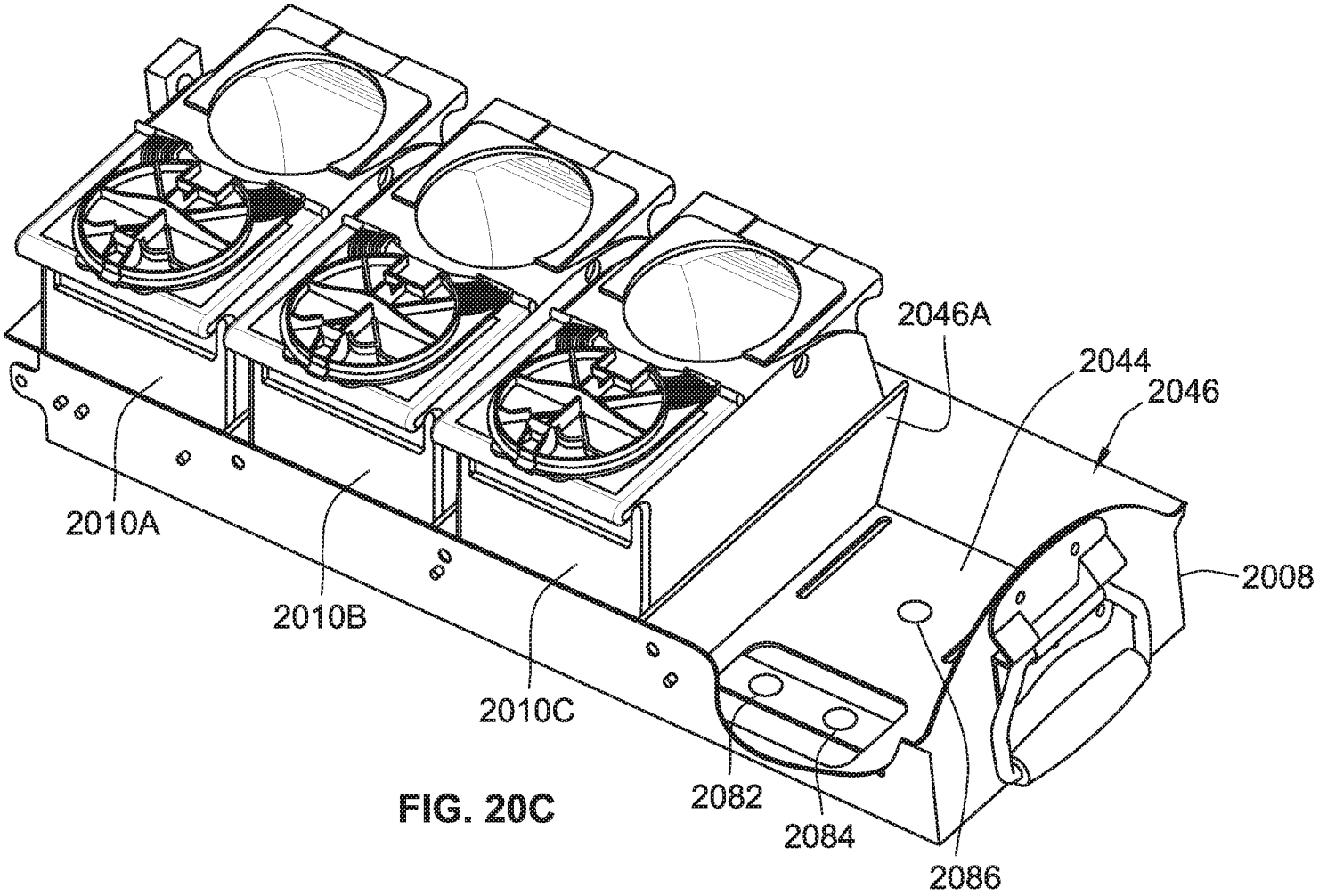

Turning to FIG. 20C, the coin drawer 2008 of FIGS. 20A and 20B is shown with one coin tote 2010D removed. The tote drawer 2008 includes a base 2044 with a plurality of coin tote compartments 2046, which are portrayed in FIG. 20C as generally rectangular compartments, for properly orienting and securing in place the totes 2010A-D. Adjacent compartments 2046 are separated by compartment partitions 2046A. A coin presence inductive coil 2082, a tote presence inductive coil 2084 and an electrostatic discharge (ESD) bleedoff post 2086 are illustrated positioned adjacent to the base 2044 in the open compartment 2046. According to some embodiments, each compartment (four such compartments are illustrated in FIGS. 20A-20C), has a coin presence inductive coil 2082, a tote presence inductive coil 2084 and an electrostatic discharge (ESD) bleedoff post 2086 although these features are only visible in the open compartment illustrated in FIG. 20C.

Each coin tote 2010A-2010D has a small piece of metal (like a rivet or something similar) imbedded into or coupled to the bottom wall of the tote 2010A-2010D. According to some embodiments, the small piece of metal is imbedded into or coupled to a wall of each tote 2010A-2010D in a location such that when a tote 2010A-2010D is seated in a coin tote compartment 2046 the metal is positioned adjacent the tote presence inductive coil 2084 of the compartment. The tote presence inductive coil 2084 in each compartment 2046 can sense if a coin tote 2010A-2010D has been seated in a corresponding compartment 2046 by sensing the presence of the metal imbedded into or coupled to the bottom of a corresponding coin tote 2010A-2010D. Accordingly, if an attendant forgets to place all coin totes 2010A-2010D in the tote drawer 2008 in the machine, the tote presence inductive coils 2084 detect that one or more coin totes 2010A-2010D are missing which in turn can be used to prevent the machine from operating. For example, when a tote presence inductive coils 2084 detect that one of coin totes 2010A-2010D is missing, a missing coin tote condition status can be set in a memory and when all tote presence inductive coils 2084 detect that all coin totes 2010A-2010D have been seated in the corresponding compartments 2046, the missing coin tote condition status can be cleared in memory. If the missing coin tote condition status is set in memory, then a controller or CPU controlling the operation of the coin sorter can detect this condition and prevent the coin sorter from being restarted or if the coin sorter is running to stop its operation.

The coin presence inductive coil 2082 which may be an eddy current sensor can detect if at least one coin is present within a corresponding coin tote 2010A-2010D seated in a corresponding compartment 2046 of the coin drawer 2008. Each coin presence sensor 2082 detects coins in an adjacent coin tote 2010A-2010D through the plastic body of the coin tote 2010A-2010D. After a full tote condition has occurred (such as when coins within one of the coin totes 2010A-2010D blocks infrared light from reaching infrared sensor 2030 and the associated coin sorter, system, machine or unit (e.g., 10, 1020, 1030, 100, 300) halts operation, a controller coupled to the coin presence inductive coil can sense if a coin tote reinserted into the corresponding compartment 2046 is empty of coins. If so, the controller can send a signal to the system controller or CPU to automatically clear the corresponding full coin tote condition status and in some embodiments setting an empty tote condition status in a communicatively coupled memory.

The information obtainable from the infrared sensor 2030, the coin presence inductive coils 2082, and the tote presence inductive coils 2084 can be used to determine various conditions regarding the state of the machine. For example, if an empty coin tote is installed in one of the compartments 2046 with its lid closed, a corresponding tote presence inductive coil 2084 can detect the presence of the coin tote 2010A-2010D, the corresponding coin presence inductive coil 2082 can detect that there are no coins on the coin tote 2010A-2010D, but the infrared sensor 2030 will fail to detect the infrared light beam because the infrared opaque flange 2068X of the closed lid will block the infrared light beam from reaching the infrared sensor 2030. This combination of conditions can be used to determine that an empty container has been placed in the machine with its lid closed and a corresponding error condition status can be set in the memory. The presence of this error condition can be used to display an appropriate error condition warning to a user of the machine such as via a displayed message on a display and/or an audible warning generated using a speaker. Likewise, the presence of the error condition can be used by an associated controller or CPU to prevent the machine from being started.

Each of the ESD bleedoff posts 2086 acts a ground for static electricity present on incoming coins deposited into a corresponding coin tote 2010A-2010D. Each post 2086 extends through a hole in the floor of each coin tote 2010A-2010D. Each post 2086 also provides a secondary benefit of acting as an additional alignment point for installing the coin totes 2010A-2010D into the compartments 2046.

Figure 20D:
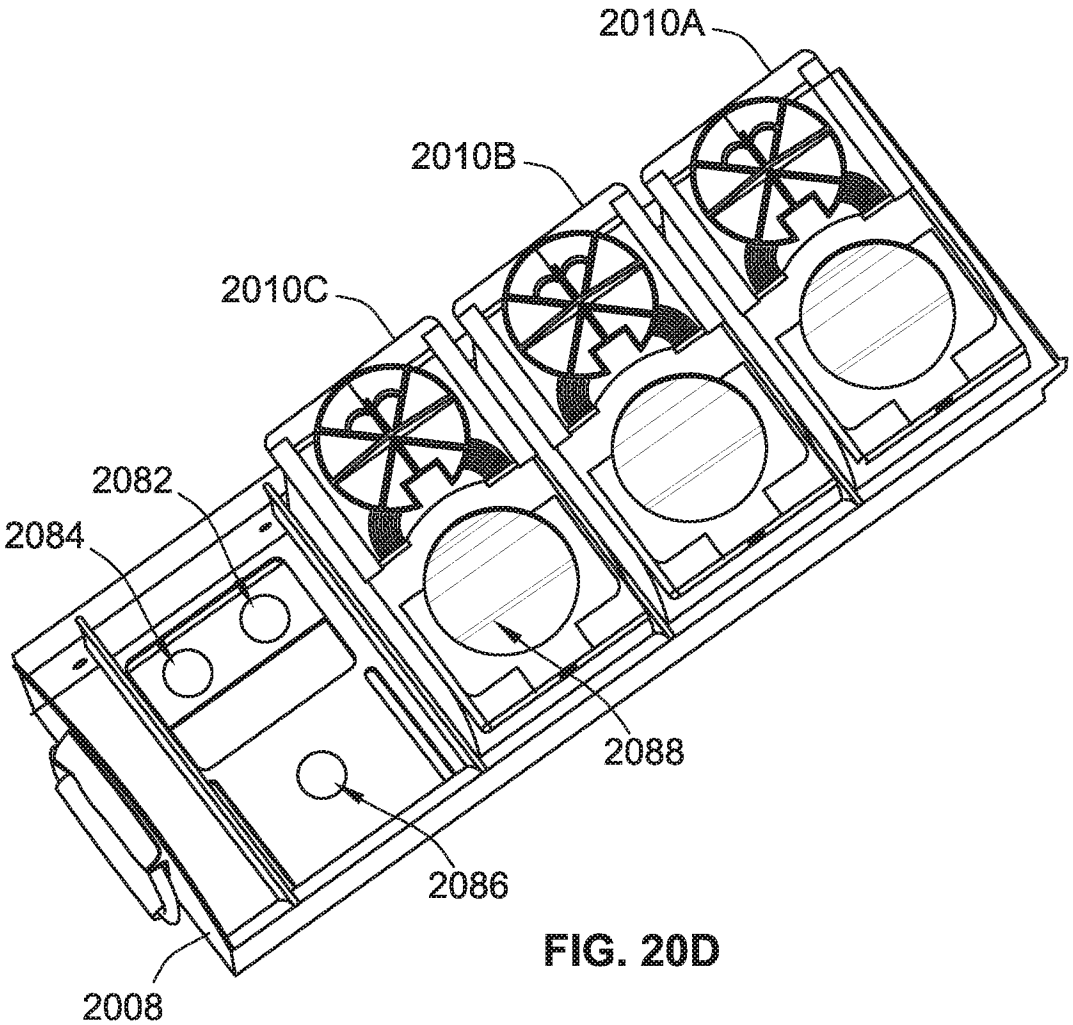

As shown in FIG. 20D, each coin tote 2010A-2010D has a metal bar 2088 spanning the interior width of each coin tote 2010A-2010D. As better illustrated in FIG. 18B, each metal bar 2088 is positioned below the coin hole 2065, 465 of the corresponding coin tote 2010A-2010D, 410. The metal bar 2088 adds some structural integrity to each coin tote 2010A-2010D, 410. Additionally, when each coin tote 2010A-2010D, 410 is inserted into a corresponding tote dock 414A-414D of the coin-recycling assembly 402 of FIG. 14 and turned upside down for dispensing, the bar 2088 takes the weight of some of the coins in the coin tote 2010A-2010D, and thereby takes some weight and/or pressure off of the rotating coin rotor 452 (see FIGS. 15B and 16) of the coin-recycling assembly 402. By taking some weight and/or pressure off of the coin rotor 452 jamming of the dispenser near the coin rotors 452 is reduced and failure of the disk motors 454 due to overwork may also be reduced.

Figure 20E:
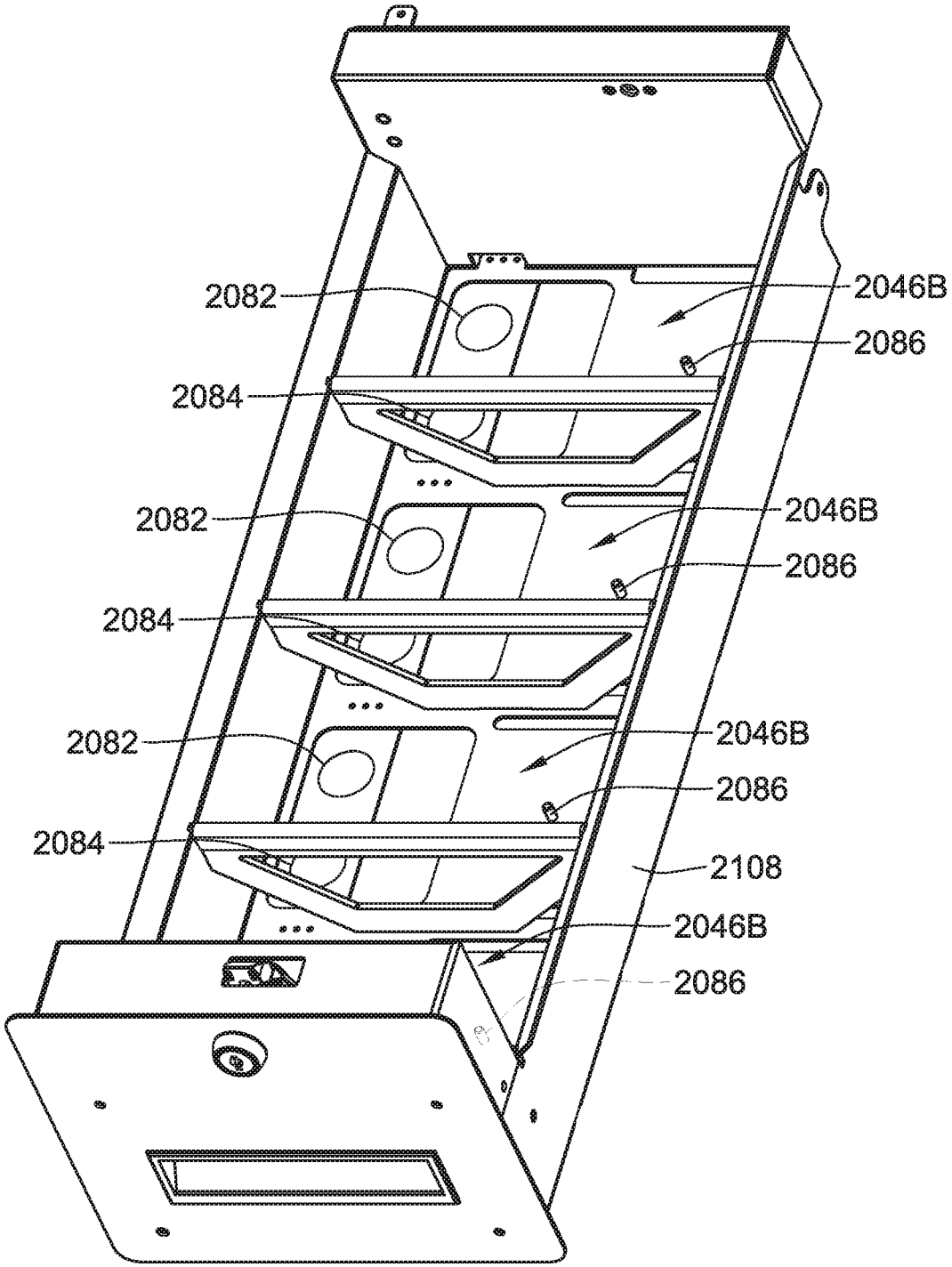

FIG. 20E is a perspective view of a coin drawer 2108 similar to coin drawer 2008 but with all coin totes removed. As with coin drawer 2008, coin drawer 2108 has two inductive sensors 2082, 2084 and an electrostatic discharge (ESD) bleedoff post 2086 in each coin tote compartment 2046B. The coin tote compartments 2046B are similar to coin tote compartments 2046 discussed above. Although not illustrated in FIG. 20E (but illustrated in FIGS. 22A and 22A), the coin drawer 2008 has a ninth inductive sensor 2083 located outside of the coin tote compartments 2046, 2046B which may be used as a calibration sensor to calibrate the inductive sensors 2082, 2084. According to some embodiments, the nine inductive sensors 2082-2084 are arranged linearly along a single printed circuit board (PCB). The inductive sensors 2082, 2084 of coin drawer 2108 operate in the same manner as discussed above in connection with coin drawer 2008.

Figure 21A:
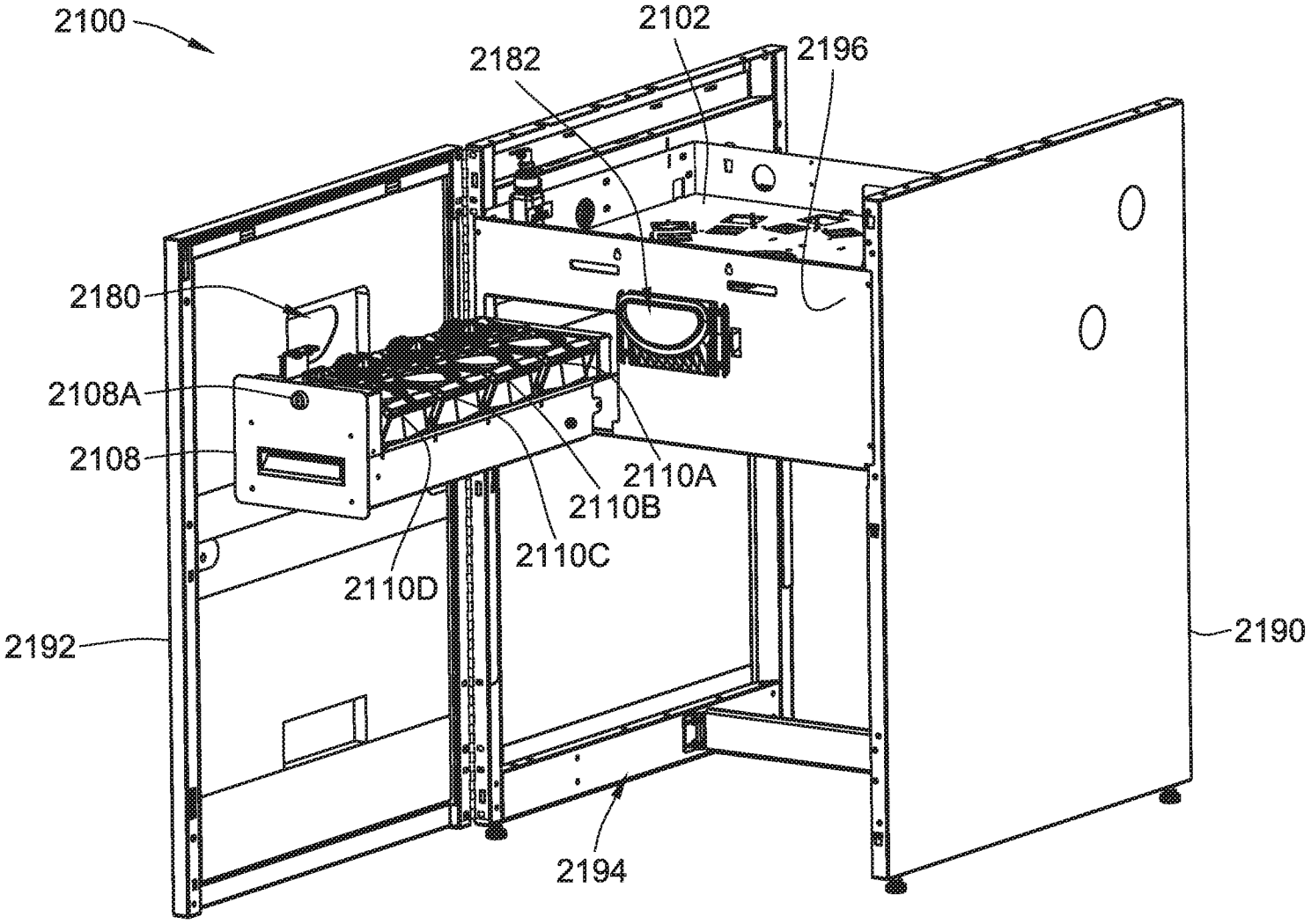
FIGS. 21A and 21B are perspective views of selected components of a representative coin depositing and recycling unit.
Figure 21B:
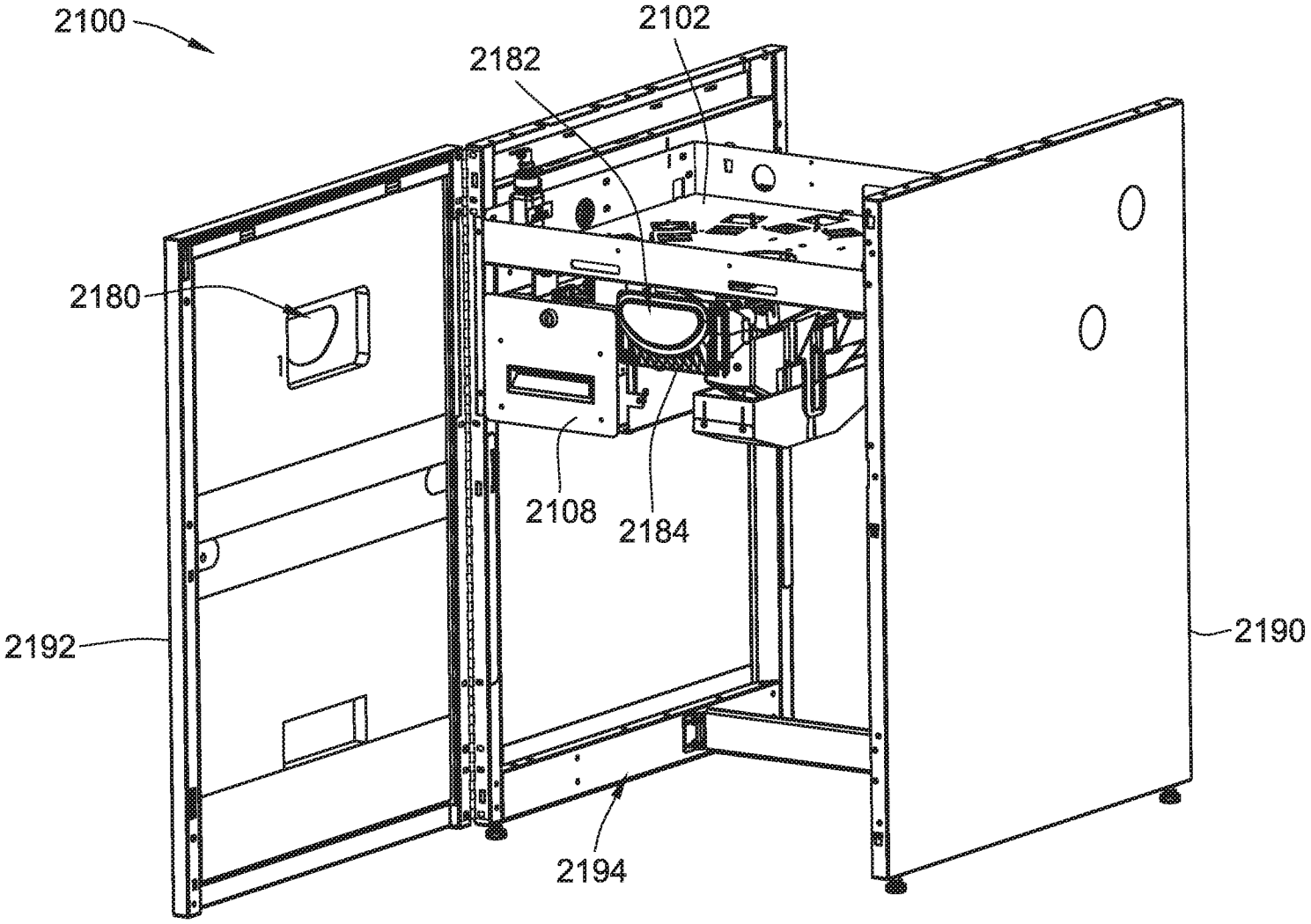

FIGS. 21A and 21B are perspective view illustrations of selected components of a representative coin depositing and recycling unit ("CDR Unit") 2100 in accord with aspects of the present disclosure. The CDR Unit 2100 is similar to the CDR Unit 300 that discussed above such as in conjunction with FIG. 8 and similar numbering with be used for similar components. The CDR Unit 2100 portrayed in FIGS. 21A and 21B includes a base plate 2102 similar to base plate 302 that is positioned underneath the disk-type coin processing unit 200, disposed over a coin-mixing manifold (not shown) similar to coin-mixing manifold 304. Handheld coin totes 2110A-2110D similar to handheld coin totes 410 (FIGS. 18A-18B) are shown seated in a tote drawer 2108 similar to tote drawer 308 (see FIGS. 8 and 12). The CDR Unit 2100 has a housing or cabinet 2190 having a door 2192. According to some embodiments, the door 2192 may have a lock thereby permitting the door 2192 to be closed and locked so as to inhibit access inside the cabinet. Likewise, the drawer 2108 may have a lock 2108A thereby permitting the drawer 2108 to be closed and locked so as to inhibit or prevent the drawer 2108 being retracted from its operational position shown in FIG. 21B. The drawer 2108 is shown in a retracted position in FIG. 21A whereat coin totes 2110A-2110D may be accessed by an operator and inserted and/or removed from the drawer 2108. Inside the cabinet 2190 is a coin bin storage area 2194 sized to accommodate one or more coin bins 110A, 110B (see FIGS. 4 and 5). In FIG. 21A a plate 2196 is shown which cover some of the interior components of the CDR Unit 2100. For illustration purposes, this plate 2196 has been removed in FIG. 21B. According to some embodiments, the door 2192 of the CDR Unite 2100 has an opening 2180 which is lined up with an opening 2182 of a reject coin bin 2184 when the door 2192 is in a closed position. The openings 2180 and 2182 permit an operator to reach into the reject coin bin and withdraw any coins rejected by the diverting pin 242 of the sorting head 212 (see FIG. 7) into a coin reject tube. The CDR Unit 300 discussed above may have a similar cabinet 2190, cabinet door 2192, and tote drawer 2108 to that described in conjunction with FIGS. 21A and 21B.

Figure 22A:
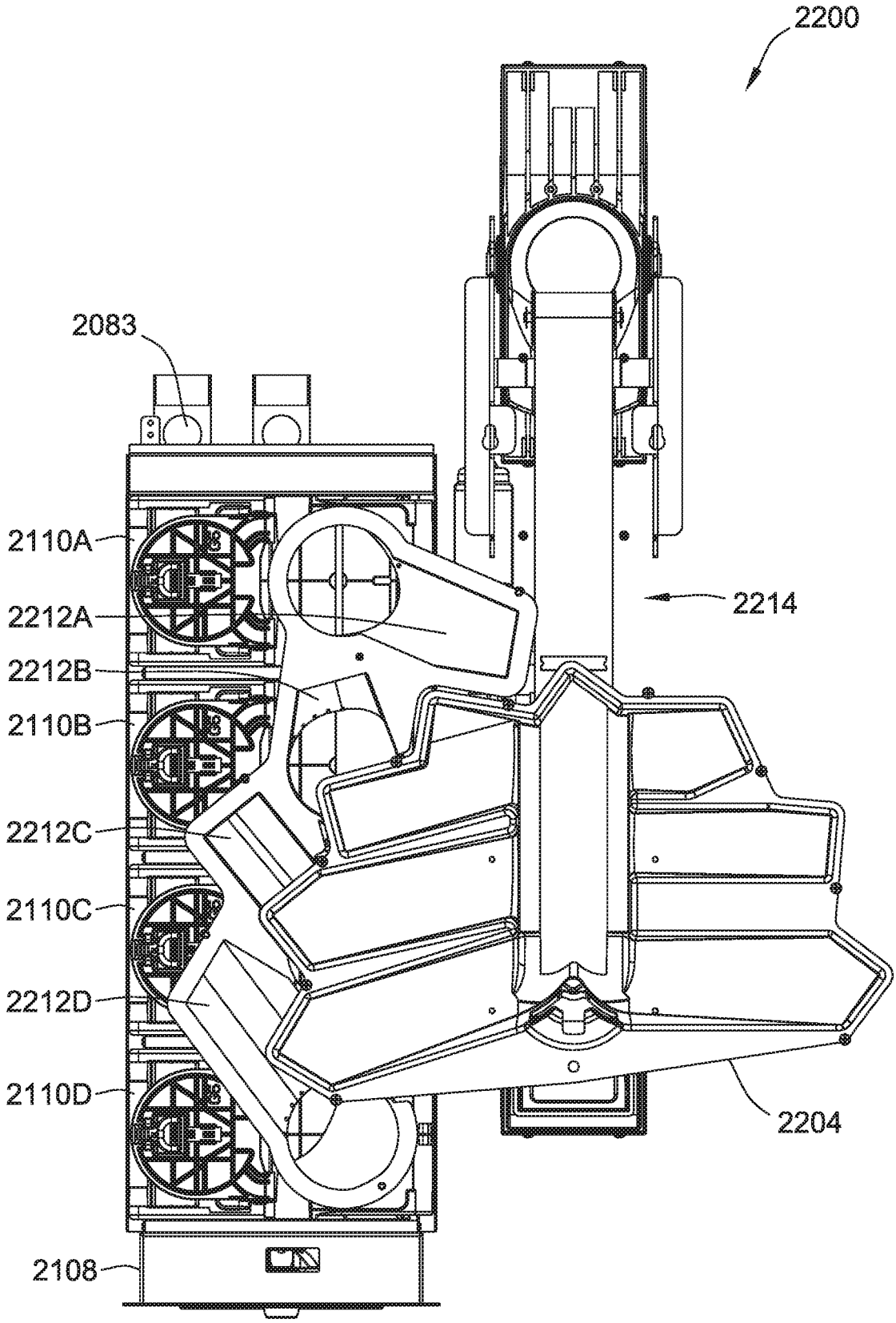
FIGS. 22A and 22B illustrate a top view and a perspective view, respectively, of portions of a CDR Unit.
Figure 22B:
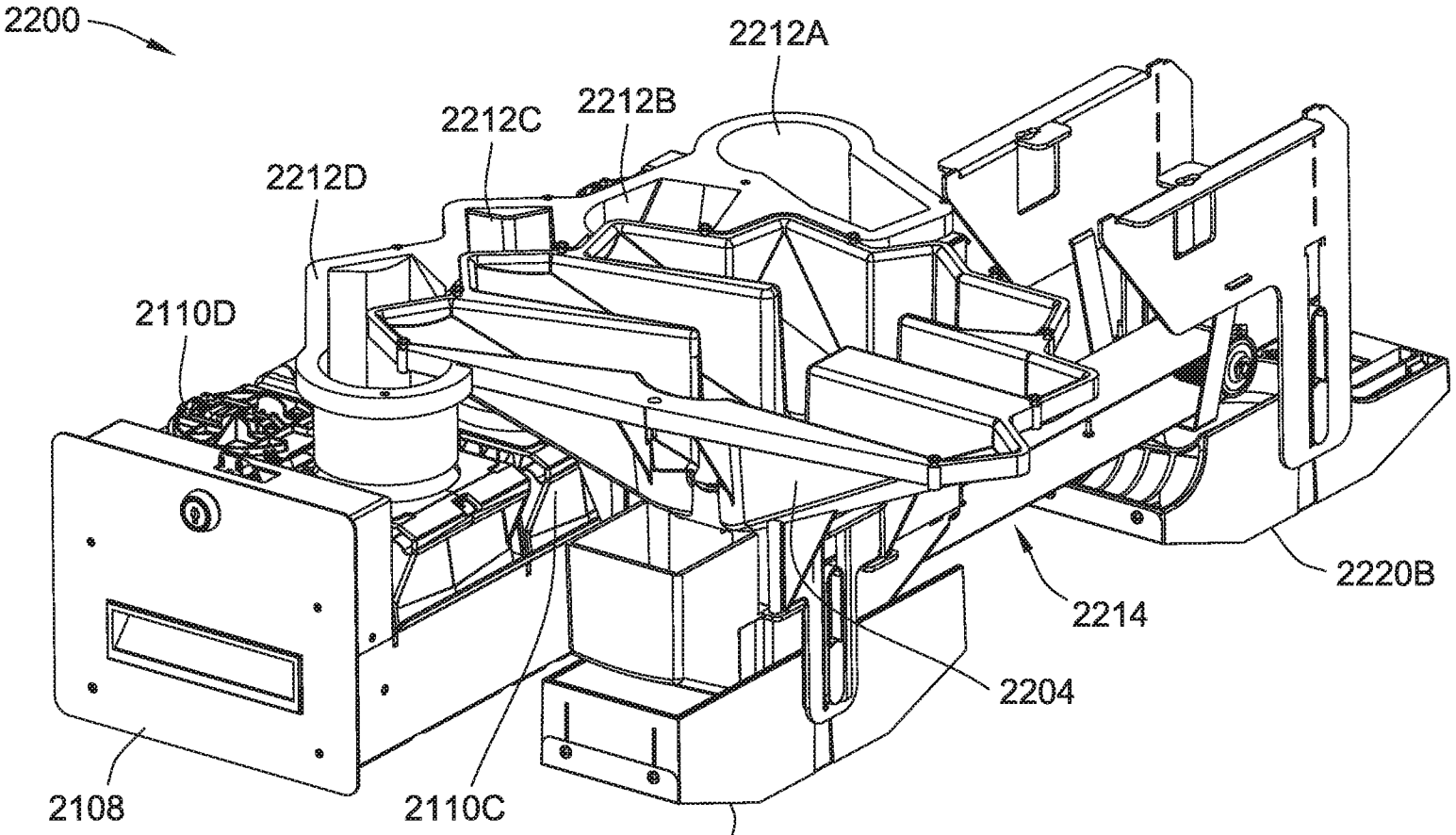

FIGS. 22A and 22B illustrate a top view and a perspective view, respectively, of portions of a CDR Unit 2200 similar to CDR Units 300 and 2100 described above and similar numbering with be used for similar components. As described above, the CDR Unit 2000 further includes a tote drawer 2108, which carries a variety of handheld coin totes 2110A-2110D, as well as an assortment of tote chutes 2212A-2212D positioned above the totes 2110A-2110D. The tote chutes 2212A-2212D are the same or similar to tote chutes 312A-312D discussed above. Adjacent the tote drawer 2108 and coin totes 2110A-2110D is a conveyor belt assembly, designated generally as 2214, all of which are located underneath the base plate 2102, not shown in FIGS. 22A and 22B—see, e.g, FIGS. 21A, 21B and base plate 302 shown in FIGS. 8-10. The base plate 2102 may be the same or similar to base late 302. The illustrated example is shown comprising four coin totes with four corresponding chutes; nevertheless, it is within the scope and spirit of this disclosure to incorporate greater or fewer than four totes and chutes into the CDR Unit 2200. For example, another drawer 2108 holding an additional four coin totes 2110 may be positioned on the right side of the cabinet and receive coins through the rightmost apertures or coin ports 316A in base plate 302 (see FIGS. 8-10) via tote chutes similar to tote chutes 2212A-2212D. The conveyor belt assembly 2214 operates the same as described above in conjunction with conveyor belt assembly 314 and is configured coins received from manifold 2204 into either of two coins bins 110A, 110B positioned below the outlet plenums 2220A, 2220B of the manifold 2204. Outlet plenums 2220A, 2220B may be the same or similar to outlet plenum 320 discussed above.

Figure 23A:
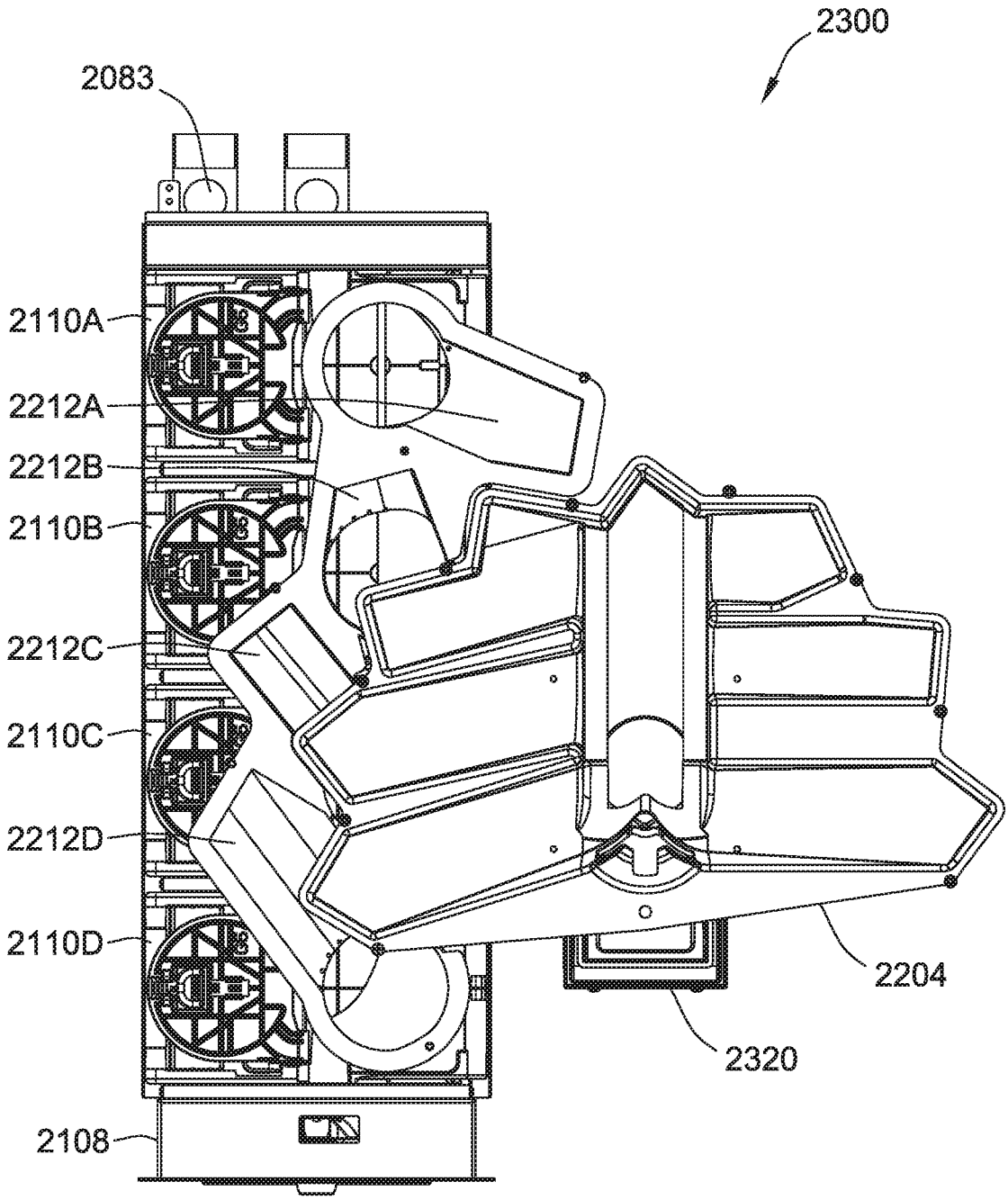
FIGS. 23A-23C illustrate a top view, a perspective view, and another perspective view, respectively, of portions of a CDR Unit.
Figure 23B:
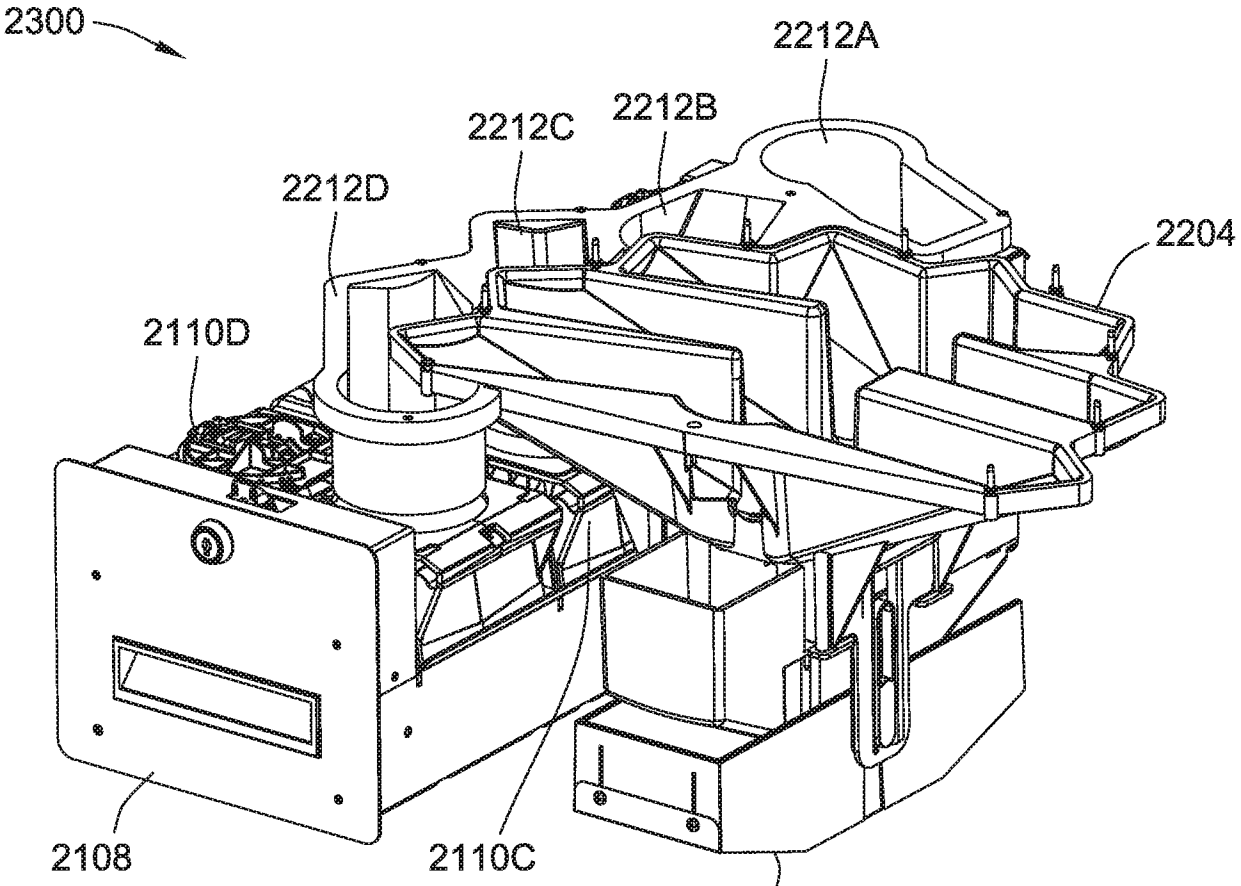
Figure 23C:
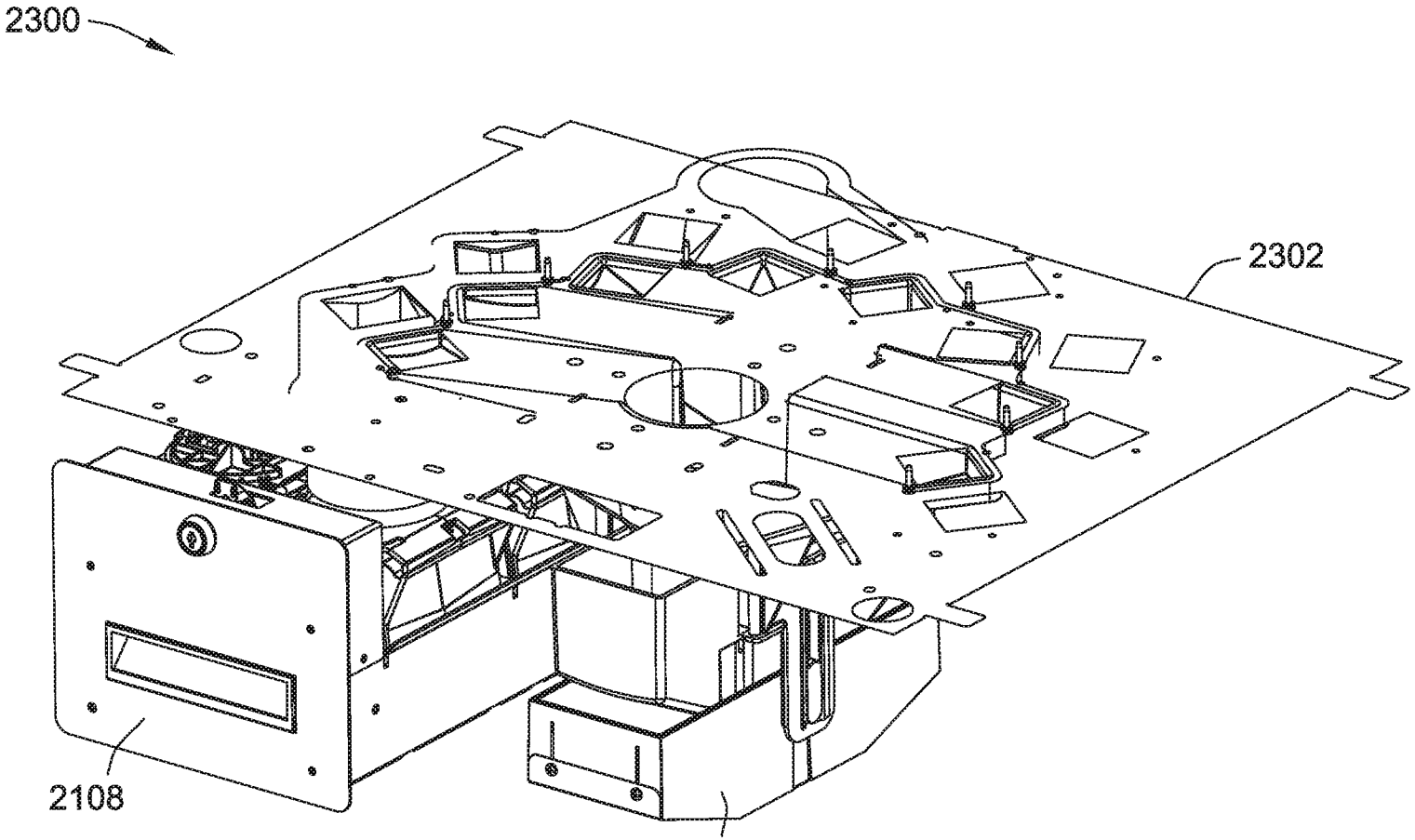

FIGS. 23A-23C illustrate a top view, a perspective view, and another perspective view, respectively, of portions of a CDR Unit 2300 similar to CDR Units 300, 2100, and 2200 described above and similar numbering with be used for similar components. In generally CDR Unit 2300 is the same as CDR Unit 2200 except that the CDR Unit 2300 is configured to deliver coins from a mixed coin manifold 2204 into a single coin bin 110A via a single outlet plenum 2320. The conveyor belt assembly 2214 has been omitted in the CDR Unit 2300. A base plate 2302 which may be the same or similar to base plate 302 is illustrated in FIG. 23C. Although not shown in FIGS. 22A-22B, the same base plate 2302 may be used in conjunction with CDR Unit 2200.

Coin bins 2110A and 110B (FIGS. 4 and 5), and supports thereon a plurality of automated coin chutes 306. While there are four automated coin chutes 306 shown in FIG. 8, the illustrated example can include as few as one and as many as eight (or potentially more) automated coin chutes 306 depending, for example, on the intended application and design requirements of the CDR Unit 300.

Figure 24:
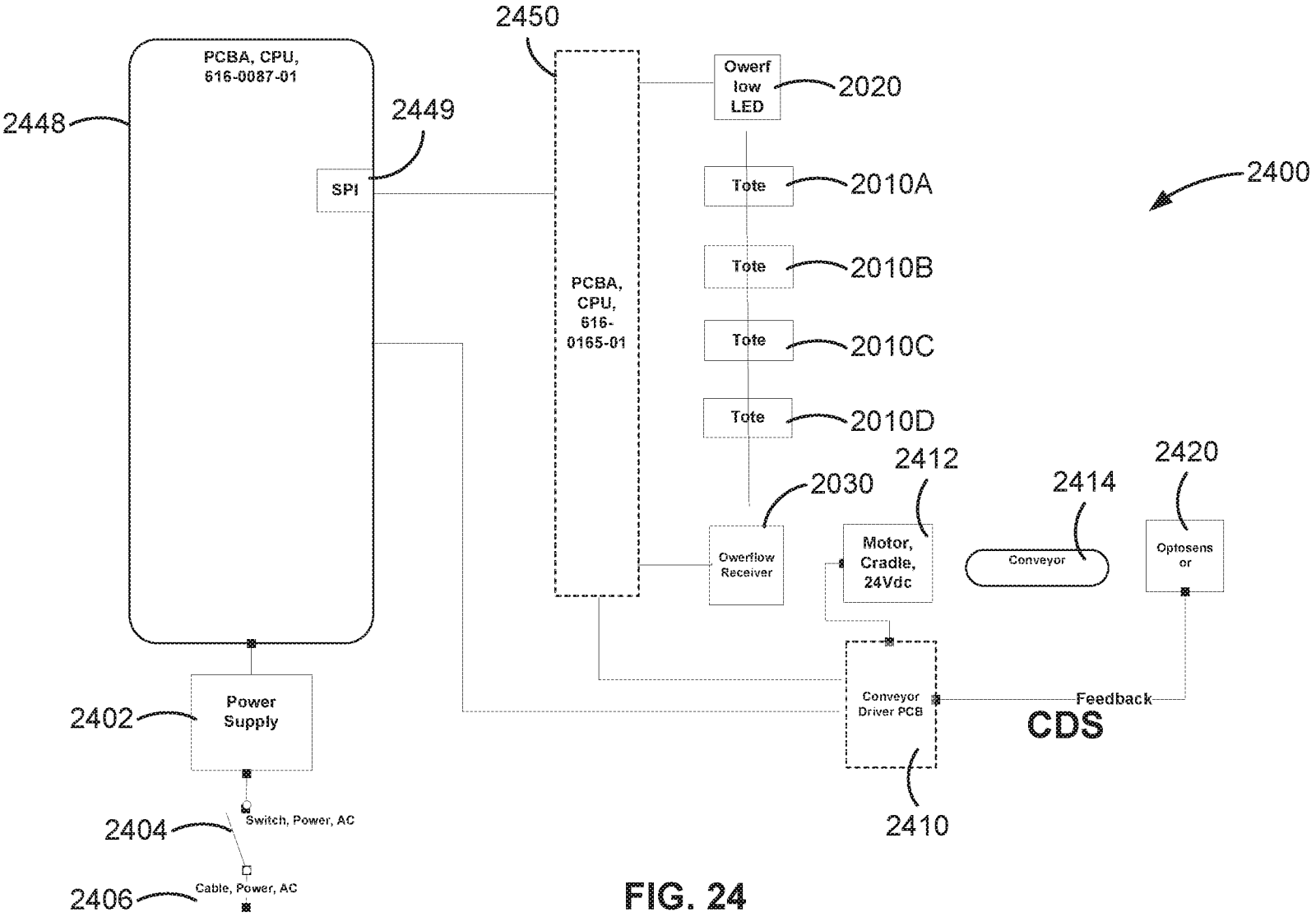
FIG. 24 is a block diagram of selected components of a coin depositing and recycling unit ("CDR Unit").

FIG. 24 is a block diagram of selected components of a coin depositing and recycling unit ("CDR Unit") 2400 such as CDR Units 300, 2100, 2200, 2300. The CDR Unit 2400 has a processor or CPU 2448 powered by a power supply 2402 coupled thereto. The power supply 2402 is coupled to a power source 2406 such as an electrical outlet via a switch 2404. The CDR Unit 2400 illustrated has four coin totes 2010A-2010D as well as an infrared light source 2020, infrared receiver or sensor 2030 as described above. The CDR Unit 2400 illustrated also has a conveyer belt assembly 2414 such as conveyor belt assemblies 314 and 2214 described above. The conveyor belt assembly is selectively driven by a motor 2412. The position of the conveyor belt assembly is monitored by an optical sensor 2420. The motor 2412 and the optical sensor 2420 are coupled to a processor 2410 which controls the operation of the motor 2412 and receives and interprets signals from the optical sensor 2420. The processor 2410 is communicatively coupled to both the CPU 2448 and another processor 2450. The processor 2450 is coupled to the infrared light source 2020 and the infrared receiver or sensor 2030. The processor 2450 controls the IR light source 2020 and receives data signals from the IR sensor 2030 and interprets those data signals. The processor 2450 is also communicatively coupled to the CPU 2448 via a port 2449. The communications between the components can be made via hard wire and/or wirelessly. While an exemplary block diagram is provided, the exact configuration can be altered without departing from the spirit of the present disclosure. For example, the functionality of the three processors 2448, 2410, and 2450 could be combined into one or two processors or distributed to additional processors.

Figure 25:
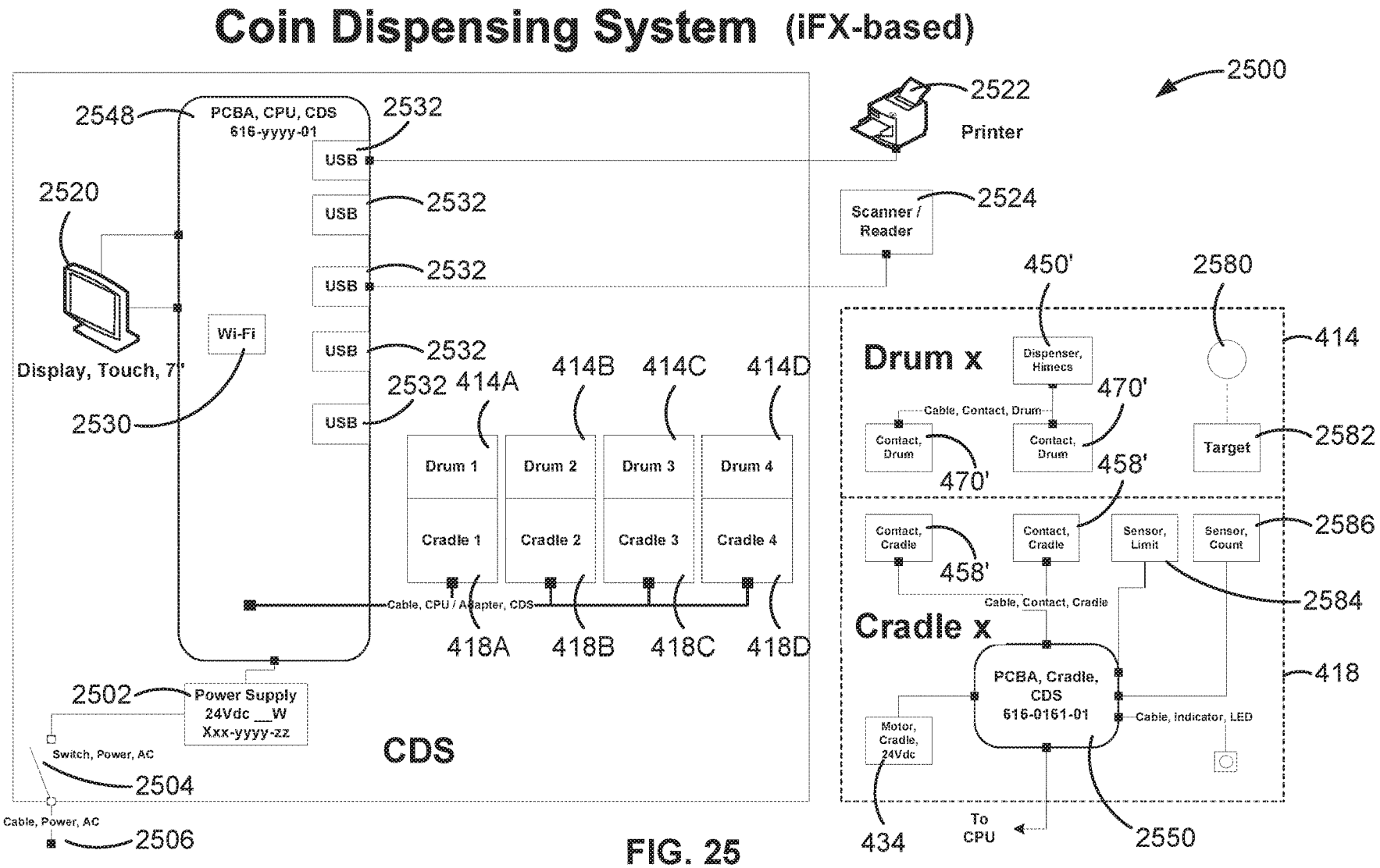
FIG. 25 is a block diagram of selected components of a coin-recycling system 2500 such as coin-recycling system.

FIG. 25 is a block diagram of selected components of a coin-recycling system 2500 such as coin-recycling system 400. The coin-recycling system 2500 has a processor or CPU 2548 powered by a power supply 2502 coupled thereto. The power supply 2502 is coupled to a power source 2506 such as an electrical outlet via a switch 2504. The CPU 2548 is communicatively coupled to an input/output device 2520 such as a display and/or touchscreen, and may also be communicatively coupled to a printer 2522 and/or a scanner/reader 2524 such as via USB ports 2532. The coin-recycling system 2500 also comprises a plurality of tote docks or drums 414A-414D and a plurality of associated tote docking stations or cradles 418A-418D as described above. The tote docking stations 418A-418D communicatively coupled to the CPU 2548. The CPU 2548 may also have a WiFi interface for wireless communication. Each tote dock 414 comprises an automated coin disk assembly or HIMECS dispenser 450' and a plurality of contacts 470' such as two contacts as describe above. Each tote dock 414 also comprises a target 2582.

Each corresponding tote docking station 418 comprises a motor 434, a plurality of contacts 458' such as two contacts, a limit sensor 2584, and a count sensor 2586, all communicatively coupled to a processor 2550. Each processor 2550 is communicatively coupled to the CPU 2548. According to some embodiments, when contacts 458' and 470' are in physical contact, an electrical circuit is completed and power to drive the automated coin disk assembly or HIMECS dispenser 450' is supplied to the automated coin disk assembly 450' from the tote docking station 418 through the contacts 458', 470'. The communications between the components can be made via hard wire and/or wirelessly. While an exemplary block diagram is provided, the exact configuration can be altered without departing from the spirit of the present disclosure. For example, the functionality of the three processors 2548 and 2450 could be combined into fewer or distributed to more processors.

ALTERNATIVE EMBODIMENTS

Embodiment 1

A currency processing system comprising: a housing with a coin input area configured to receive a batch of coins; a plurality of coin receptacles operatively coupled to the housing, the plurality of coin receptacles including a coin-recycling receptacle and a coin-depositing receptacle; a disk-type coin processing unit operatively coupled to the coin input area and the coin receptacles to transfer coins therebetween, the coin processing unit including: a rotatable disk configured to impart motion to a plurality of the coins, and a sorting head having a lower surface generally parallel to and at least partially spaced from the rotatable disk, the lower surface forming a plurality of shaped regions configured to guide the coins, under the motion imparted by the rotatable disk, to a plurality of exit channels configured to sort and discharge the coins through a plurality of exit stations; and an automated coin chute with an input passage connected to coin-recycling and coin-depositing output passages, the automated coin chute including a movable diverter plate configured to selectively transition between a first position, whereby coins received from one of the exit stations of the disk-type coin processing unit by the input passage are redirected through the coin-recycling output passage to the coin-recycling receptacle, and a second position, whereby coins received by the input passage from the one exit station are redirected through the coin-depositing output passage to the coin-depositing receptacle.

Embodiment 2

The currency processing system of embodiment 1, wherein the automated coin chute comprises a chute housing defining therein the input passage, the coin-recycling passage, and the coin-depositing passage.

Embodiment 3

The currency processing system of embodiment 2, wherein the movable diverter plate is rotatably mounted on a diverter shaft inside of the chute housing.

Embodiment 4

The currency processing system of embodiment 3, wherein the automated coin chute further comprises a motor connected to the diverter shaft, the motor being selectively actuable to transition the diverter plate between the first and second positions.

Embodiment 5

The currency processing system of embodiment 1, further comprising a base plate disposed between the disk-type coin processing unit and the plurality of coin receptacles, the base plate defining therethrough coin-recycling and coin-depositing ports, wherein the automated coin chute is mounted to the base plate with the coin-recycling and coin-depositing output passages aligned with the coin-recycling and coin-depositing ports, respectively.

Embodiment 6

The currency processing system of embodiment 5, wherein the coin-recycling ports are spaced circumferentially about the coin processing unit a first radial distance from the center of the rotatable disk, and the coin-depositing ports are spaced circumferentially about the coin processing unit a second radial distance, distinct from the first radial distance, from the center of the rotatable disk.

Embodiment 7

The currency processing system of embodiment 5, wherein the disk-type coin processing unit is mounted on the base plate adjacent the automated coin chute.

Embodiment 8

The currency processing system of embodiment 1, further comprising a plurality of the automated coin chutes, the respective input passage of each of the automated coin chutes being coupled to only one of the exit stations of the disk-type coin processing unit to receive coins therefrom.

Embodiment 9

The currency processing system of embodiment 8, wherein the coin receptacles include a plurality of coin-recycling receptacles, and wherein each of the automated coin chutes is operable to divert coins received from the coin processing unit to only one of the coin-recycling receptacles.

Embodiment 10

The currency processing system of embodiment 8, wherein all of the automated coin chutes are operable to divert coins received from the coin processing unit to the coin-depositing receptacle.

Embodiment 11

The currency processing system of embodiment 1, further comprising a coin-mixing manifold configured to receive coins sorted by the disk-type coin processing unit, combine the sorted coins, and direct the combined coins to the coin-depositing receptacle.

Embodiment 12

The currency processing system of embodiment 11, wherein the automated coin chute diverts coins received by the input passage from the one exit station to the coin-depositing receptacle via the coin-mixing manifold.

Embodiment 13

The currency processing system of embodiment 1, wherein the coin-depositing receptacle includes first and second coin bins disposed inside the housing.

Embodiment 14

The currency processing system of embodiment 13, further comprising a conveyor belt assembly disposed between the automated coin chute and the coin bins, the conveyor belt assembly being configured to selectively operate in a first direction, whereby coins received from the automated coin chute are delivered to the first coin bin, and a second direction, whereby coins received from the automated coin chute are delivered to the second coin bin.

Embodiment 15

The currency processing system of embodiment 1, wherein the coin-recycling receptacle comprises a plurality of handheld coin totes removably stowed inside the housing.

Embodiment 16

The currency processing system of embodiment 15, wherein the handheld coin totes are removably seated inside a tote drawer, the tote drawer being configured to transition between a stowed position, whereat the tote drawer is disposed at least substantially inside the housing, to an extracted position, whereat the tote drawer is disposed at least partially outside the housing such that the coin totes can be removed therefrom.

Embodiment 17

The currency processing system of embodiment 16, wherein the tote drawer includes a base defining a plurality of tote compartments, each of the tote compartments being configured to receive therein a base portion of one of the coin totes.

Embodiment 18

The currency processing system of embodiment 15, wherein each of the coin totes includes a first electrical contact configured to cooperate with a system interface contact to thereby communicate to a system controller a signal indicative of a presence of the coin tote in the tote drawer.

Embodiment 19

The currency processing system of embodiment 15, wherein each of the coin totes includes a second electrical contact configured to cooperate with a system interface contact to thereby communicate to a system controller a signal indicating a full coin tote in the tote drawer.

Embodiment 20

The currency processing system of embodiment 15, wherein each of the coin totes includes a third electrical contact configured to cooperate with a system interface contact to thereby communicate to a system controller a signal indicating an empty coin tote in the tote drawer.

Embodiment 21

The currency processing system of embodiment 11, further comprising a plurality of sorted coin chutes, each of the sorted coin chutes being configured to direct coins received from the coin processing unit into a respective one of the coin totes.

Embodiment 22

A self-service coin processing machine comprising: a housing with a coin input area configured to receive coins; a plurality of coin receptacles removably positioned inside the housing and configured to receive and store processed coins, the plurality of coin receptacles including a plurality of coin-recycling receptacles and a plurality of coin-depositing receptacles; a coin processing unit configured to receive coins from the coin input area, process the coins, and output the processed coins through coin exit stations; a plurality of automated coin chutes each having a chute body defining an input passage connected to coin-recycling and coin-depositing output passages, each of the automated coin chutes including a movable diverter plate configured to selectively transition between a first position, whereby coins received by the input passage from a respective one of the exit stations are redirected through the coin-recycling output passage to a respective one of the coin-recycling receptacles, and a second position, whereby coins received by the input passage from the respective one of the exit stations are redirected through the coin-depositing output passage to a respective one of the coin-depositing receptacles.

Embodiment 23

A method of processing and recycling coins, the method comprising: receiving a batch of mixed coins in a currency processing machine comprising a coin processing unit configured to sort received coins, at least one coin-depositing receptacle, and a plurality of coin-recycling receptacles, each of the coin-recycling receptacles being associated with a single denomination of coin; discharging sorted coins from the coin processing unit through a plurality of exit stations, each of the exit stations being associated with a single denomination of coin; receiving coins from each of the exit stations via one of a plurality of automated coin chutes, each of the automated coin chutes including a movable diverter plate configured to selectively transition between a first position, whereby coins received from the exit station are directed through a coin-recycling output passage, and a second position, whereby coins received from the exit station are directed through a coin-depositing output passage; discharging coins from the coin-recycling output passage of each of the automated coin chutes into a respective one of the coin-recycling receptacles; and discharging coins from the coin-depositing output passage of each of the automated coin chutes into the at least one coin-depositing receptacle.

Embodiment 24

The method of embodiment 23, wherein each of the automated coin chutes comprises a chute housing defining therein the coin-recycling passage and the coin-depositing passage.

Embodiment 25

The method of embodiment 25, wherein each of the automated coin chutes further comprises a motor connected to the diverter shaft, the motor being selectively actuable to transition the diverter plate between the first and second positions.

Embodiment 26

The method of embodiment 23, wherein the currency processing machine further comprises a base plate disposed between the coin processing unit and the coin receptacles, the base plate defining therethrough coin-recycling and coin-depositing ports, wherein each of the automated coin chutes is mounted to the base plate with the coin-recycling and coin-depositing output passages aligned with the coin-recycling and coin-depositing ports, respectively.

Embodiment 27

The method of embodiment 26, wherein the coin-recycling ports are spaced circumferentially about the coin processing unit a first radial distance from a center of the unit, and the coin-depositing ports are spaced circumferentially about the coin processing unit a second radial distance, distinct from the first radial distance, from the center of the unit.

Embodiment 28

The method of embodiment 23, wherein the coin processing unit is mounted on the base plate adjacent the plurality of automated coin chutes.

Embodiment 29

The method of embodiment 23, wherein the currency processing machine further comprises a coin-mixing manifold configured to receive coins sorted by the coin processing unit, recombine the sorted coins, and direct the recombined coins to the at least one coin-depositing receptacle.

Embodiment 30

The method of embodiment 29, wherein the plurality of automated coin chutes divert coins received from the exit stations to the at least one coin-depositing receptacle via the coin-mixing manifold.

Embodiment 31

The method of embodiment 23, wherein the at least one coin-depositing receptacle includes first and second coin bins.

Embodiment 32

The method of embodiment 31, wherein the currency processing machine further comprises a conveyor belt assembly configured to selectively operate in a first direction, whereby coins received from the automated coin chutes are delivered to the first coin bin, and a second direction, whereby coins received from the automated coin chutes are delivered to the second coin bin.

Embodiment 33

The method of embodiment 23, wherein the plurality of coin-recycling receptacles includes a plurality of handheld coin totes removably mounted inside a housing of the currency processing machine.

Embodiment 34

The method of embodiment 33, wherein the handheld coin totes are removably mounted to a tote drawer, the tote drawer being configured to transition from a stowed position, whereat the tote drawer is disposed at least substantially inside the housing, to an extracted position, whereat the tote drawer is disposed at least partially outside the housing such that the coin totes can be removed therefrom.

Embodiment 35

The method of embodiment 34, wherein the tote drawer includes a base defining a plurality of tote compartments, each of the tote compartments being configured to receive therein a base portion of one of the coin totes.

Embodiment 36

The method of embodiment 33, wherein each of the coin totes includes a first electrical contact, and the housing includes a second electrical contact configured to cooperate with the first electrical contact to thereby communicate to a system controller a signal indicative of a presence of the coin tote in the tote drawer.

Embodiment 37

The method of embodiment 33, wherein each of the coin totes includes a third electrical contact, and the housing includes a fourth electrical contact configured to cooperate with the third electrical contact to thereby communicate to a system controller a signal indicating a full coin tote in the tote drawer.

Embodiment 38

The method of embodiment 33, wherein each of the coin totes includes a fifth electrical contact, and the housing includes a sixth electrical contact configured to cooperate with the fifth electrical contact to thereby communicate to a system controller a signal indicating an empty coin tote in the drawer.

Embodiment 39

The method of embodiment 23, wherein the currency processing machine further comprises a plurality of sorted coin chutes, each of the sorted coin chutes being configured to direct coins received from the coin processing unit into a respective one of the coin totes.

Embodiment 40

A coin-recycling dispenser assembly for dispensing coins stowed in one or more coin totes into one or more coin containers, the coin-recycling dispenser assembly comprising: a housing with one or more tote docking stations, each of the tote docking stations including a guide mechanism and a drive mechanism; one or more tote docks coupled to the housing, each of the tote docks being rotatably coupled to one of the tote docking stations and configured to seat therein one of the coin totes, movement of each of the tote docks being limited by the guide mechanism, wherein each of the drive mechanisms is selectively actuable to rotate one of the tote docks between a loading position, whereat the coin tote is removable from the tote dock, and a dispensing position, whereat the coins stowed inside the coin tote are dispensed, one at a time, into one of the coin containers.

Embodiment 41

The coin-recycling dispenser assembly of embodiment 40, wherein each of the guide mechanisms of the tote docking stations includes a guide track, and each of the tote docks includes a guide channel configured to mate with the guide track and thereby limit rectilinear movement of the tote dock during rotation thereof.

Embodiment 42

The coin-recycling dispenser assembly of embodiment 41, wherein each of the guide tracks of the tote docking stations includes a retention tab pressing against a flange of the guide channel and thereby retaining the tote dock in contact with the tote docking station.

Embodiment 43

The coin-recycling dispenser assembly of embodiment 41, wherein each of the tote docks includes a drum-shaped body, the guide channel extending along the outer circumference of the drum-shaped body.

Embodiment 44

The coin-recycling dispenser assembly of embodiment 40, wherein each of the guide mechanisms of the tote docking stations includes a rotation stop, and each of the tote docks includes a stopping shoulder configured to abut the rotation stop and thereby limit rotation of the tote dock.

Embodiment 45

The coin-recycling dispenser assembly of embodiment 40, wherein each of the drive mechanisms of the tote docking stations includes a motor-driven gear assembly, and each of the tote docks includes a toothed track configured to engage with the motor-driven gear assembly.

Embodiment 46

The coin-recycling dispenser assembly of embodiment 45, wherein each of the tote docks includes a drum-shaped body, the toothed track extending along the outer circumference of the drum-shaped body.

Embodiment 47

The coin-recycling dispenser assembly of embodiment 40, wherein each of the tote docking stations includes a coin slot configured to transmit coins, one at a time, to one of the coin containers.

Embodiment 48

The coin-recycling dispenser assembly of embodiment 40, wherein each of the tote docks includes a tote pocket configured to slidably receive therein one of the coin totes.

Embodiment 49

The coin-recycling dispenser assembly of embodiment 48, wherein each of the tote pockets includes a contoured surface configured to lie flush against a complementary contoured wall of a coin tote and thereby ensure proper orientation of the coin tote when seated inside the tote pocket.

Embodiment 50

The coin-recycling dispenser assembly of embodiment 40, further comprising a coin till assembly with a till housing and one or more coin funnels stowed inside the till housing, each of the coin funnels having removably mounted at a narrow end thereof one of the coin containers.

Embodiment 51

The coin-recycling dispenser assembly of embodiment 50, wherein the coin till assembly further comprises one or more coin chutes attaching the till housing to the dispenser assembly housing, each of the coin chutes being configured to direct coins, under the force of gravity, into one of the coin containers through one of the coin funnels.

Embodiment 52

The coin-recycling dispenser assembly of embodiment 40, wherein each of the tote docks includes an automated coin disk assembly selectively actuable to separate coins received from the coin tote such that coins are transmitted one at a time from the tote dock to the tote docking station.

Embodiment 53

The coin-recycling dispenser assembly of embodiment 52, wherein each of the coin disk assemblies includes a disk motor and a rotor mounted to a roof deck of the tote dock, the rotor having disc-shaped openings configured to receive therein coins from the coin tote, the disk motor being selectively actuable to rotate the rotor.

Embodiment 54

The coin-recycling dispenser assembly of embodiment 52, wherein each of the tote docking stations includes an array of electrical contacts and each of the tote docks includes an electrical contact pad, wherein rotation of the tote dock to a predetermined position mates the electrical contact pad with the array of electrical contacts and thereby selectively actuates the disk motor.

Embodiment 55

The coin-recycling dispenser assembly of embodiment 40, wherein each of the tote docks includes a coin sensor configured to count coins received from the coin tote.

Embodiment 56

The coin-recycling dispenser assembly of embodiment 55, wherein each of the tote docking stations includes an electrical contact pad, and each of the tote docks includes an electrical contact, wherein rotation of the tote dock to a predetermined position mates the electrical contact with the electrical contact pad such that coin data is transferrable from the coin sensor.

Embodiment 57

A coin-recycling system comprising: an electronic display device configured to display information and user-selectable options; an electronic user input device configured to receive one or more user selections to control one or more operations of the coin-recycling system; a central processing unit communicatively coupled to the electronic display device and the electronic user input device; a plurality of hand-held coin totes, each of the hand-held coin totes having a respective rigid tote body with a wall defining a coin hole, and a lid attached to the tote body and configured to move between a first position, whereat the lid covers the coin hole, and a second position, whereat the lid exposes the coin hole such that coins can be passed therethrough; a coin till assembly with a till housing, a plurality of coin chutes attached to the till housing, and a plurality of coin funnels stowed inside the till housing, each of the coin funnels having removably mounted at a narrow end thereof a respective coin cylinder, and each of the coin chutes being configured to direct coins, under the force of gravity, into a respective one of the coin cylinders through one of the coin funnels; a dispenser assembly housing with a plurality of tote docking stations, each of the tote docking stations including a respective arcuate guide track with a rotation stop and laterally spaced rails, a respective motor-driven gear assembly, and a respective coin slot configured to transmit coins, one at a time, to one of the coin chutes; a plurality of tote docks juxtaposed on the dispenser assembly housing and rotatably coupled to a respective one of the tote docking stations, each of the tote docks having a respective tote pocket configured to removably seat therein one of the coin totes, a respective stopping shoulder configured to mate with the rotation stop and thereby limit rotation of the tote dock, a respective pair of guide channels configured to mate with the laterally spaced rails of the guide track and thereby limit lateral movement during rotation of the tote dock, and a respective coin disk configured to separate coins received from the coin tote, and a respective toothed track engaged with the motor-driven gear assembly, wherein each of the motor-driven gear assemblies is selectively actuable to rotate a respective one of the tote docks between a loading position, whereat the coin tote is pushable into and removable from the tote dock, and a dispensing position, whereat the coins stowed inside the coin tote are dispensed, one at a time, from the tote dock, through the tote docking station, to the coin till assembly and into one of the coin cylinders through one of the coin funnels.

Embodiment 58

A coin bag for storing a plurality of coins, the coin bag comprising: an at least partially transparent and flexible polymeric body with a first end having an opening configured to receive therethrough plural coins, a seal for securing close the opening in the first end, and a second end with a frangible portion configured to be manually opened such that coins can be emptied from the coin bag through the opened frangible portion.

Embodiment 59

A coin tote drawer comprising: a plurality of coin tote compartments, each tote compartment configured to accommodate a coin tote therein, wherein each tote compartment has at least two inductive sensors residing therein; wherein one of the inductive sensors in each compartment is a coin presence inductive coil and wherein one of the inductive sensors in each compartment is a tote presence inductive coil; wherein each coin tote configured to be accommodated in each compartment has a piece of metal imbedded into or coupled to a wall of the coin tote; and wherein the tote presence inductive coil in each compartment can sense if a coin tote has been positioned in a corresponding compartment by sensing the presence of the metal imbedded into or coupled to a corresponding coin tote.

Embodiment 60

The coin tote drawer of embodiment 59 wherein each tote compartment an electrostatic discharge (ESD) bleedoff post therein.

The present invention is not limited to the precise construction and compositions disclosed herein. Rather, any and all modifications, changes, and variations apparent from the foregoing descriptions are within the scope and spirit of the invention as defined in the appended claims. Moreover, the inventive aspects of the present disclosure expressly include any and all combinations and subcombinations of the preceding embodiments, elements and features.

What is claimed:

1. A self-service coin processing machine comprising:

a housing with a coin input area configured to receive coins;

a plurality of coin receptacles removably positioned inside the housing and configured to receive and store processed coins, the plurality of coin receptacles including a plurality of coin-recycling receptacles and a plurality of coin-depositing receptacles, wherein the plurality of coin-recycling receptacles comprises a plurality of handheld coin totes removably seated inside a tote drawer within the housing, wherein the tote drawer includes a base including a plurality of tote compartments disposed along a length of the base, each of the tote compartments being configured to receive therein a base portion of one of the plurality of handheld coin totes and wherein the plurality of tote compartments are separated by partitions extending from the base of the tote drawer, wherein each coin tote of the plurality of handheld coin totes includes either an opening or an infrared transparent region, wherein the opening or the infrared transparent region of each coin tote of the plurality of handheld coin totes, when seated inside the tote drawer, is aligned with a common axis, wherein each coin tote of the plurality of handheld coin totes includes a tote lid operable to move between an open position and a closed position, wherein each coin tote of the plurality of handheld coin totes includes a flange on the tote lid, and wherein the common axis is blocked by the flange when the tote lid is closed when seated in the tote drawer, or is blocked by one or more coins when the coin tote is filled;

a coin processing unit configured to receive coins from the coin input area, process the coins, and output the processed coins through coin exit stations; and a plurality of automated coin chutes each having a chute body defining an input passage coupled to a coin-recycling output passage and a coin-depositing output passage, each of the automated coin chutes including a movable diverter plate configured to selectively transition between a first position, whereby coins received by the input passage from a respective one of the coin exit stations are redirected through the coin-recycling output passage to a respective one of the coin-recycling receptacles, and a second position, whereby coins received by the input passage from the respective one of the coin exit stations are redirected through the coin-depositing output passage to a respective one of the coin-depositing receptacles.

2. The self-service coin processing machine of claim 1, further comprising a coin-mixing manifold configured to receive coins processed by the coin processing unit, combine the processed coins, and direct the combined coins to the coin-depositing receptacles.

3. The self-service coin processing machine of claim 1, wherein the tote drawer is configured to transition between a stowed position, whereat the tote drawer is disposed at least substantially inside the housing, to an extracted position, whereat the tote drawer is disposed at least partially outside the housing such that the plurality of handheld coin totes can be removed therefrom.

4. The self-service coin processing machine of claim 3, wherein each of the plurality of handheld coin totes includes a first electrical contact configured to cooperate with a system interface contact to thereby communicate to a system controller a signal indicative of a presence of the coin tote in the tote drawer.

5. The self-service coin processing machine of claim 4, wherein each of the plurality of handheld coin totes includes a second electrical contact configured to cooperate with another system interface contact to thereby communicate to the system controller a signal indicating a full coin tote in the tote drawer.

6. The self-service coin processing machine of claim 5, wherein each of the plurality of handheld coin totes includes a third electrical contact configured to cooperate with yet another system interface contact to thereby communicate to the system controller a signal indicating an empty coin tote in the tote drawer.

7. The self-service coin processing machine of claim 1, wherein each of the plurality of tote compartments includes a post operable for insertion within the base portion of, and to align, one of the plurality of handheld coin totes when removably seated.

8. The self-service coin processing machine of claim 7, wherein the post acts as a ground for static electricity of incoming coins.

9. The self-service coin processing machine of claim 1, wherein, in response to a detection that the common axis is blocked, a system controller of the self-service coin processing machine receives a signal indicating the common axis is blocked.

10. A method of processing and recycling coins, the method comprising:

opening a tote lid of a coin tote of a plurality of handheld coin totes upon insertion of a base portion of the coin tote into a tote compartment of a plurality of tote compartments of a tote drawer, wherein the tote drawer is within a housing of a currency processing machine, wherein the coin tote is removably seated in the tote compartment, wherein the plurality of tote compartments are disposed along a length of a base of the tote drawer and are separated by partitions extending from the base of the tote drawer, wherein each coin tote of the plurality of handheld coin totes includes either an opening or an infrared transparent region, wherein the opening or the infrared transparent region of each coin tote of the plurality of handheld coin totes, when seated inside the tote drawer, is aligned with a common axis, and wherein each coin tote of the plurality of handheld coin totes includes a flange on the tote lid:

wherein the currency processing machine comprises a coin processing unit configured to sort received coins, at least one coin-depositing receptacle, and a plurality of coin-recycling receptacles, each of the coin-recycling receptacles being associated with a single denomination of coin, wherein the plurality of coin-recycling receptacles includes the plurality of handheld coin totes;

detecting that the common axis is blocked by the flange when the tote lid is closed when seated in the tote drawer, or is blocked by one or more coins when the coin tote is filled;

receiving a batch of mixed coins in the currency processing machine;

discharging sorted coins from the coin processing unit through a plurality of exit stations, each of the exit stations being associated with a single denomination of coin;

receiving coins from each of the exit stations via one of a plurality of automated coin chutes, each of the automated coin chutes including a movable diverter plate configured to selectively transition between a first position, whereby coins received from the exit station are directed through a coin-recycling output passage, and a second position, whereby coins received from the exit station are directed through a coin-depositing output passage;

discharging coins from the coin-recycling output passage of each of the automated coin chutes into a respective one of the coin-recycling receptacles; and discharging coins from the coin-depositing output passage of each of the automated coin chutes into the at least one coin-depositing receptacle.

11. The method of claim 10, wherein each of the automated coin chutes further comprises a motor connected to the movable diverter plate, the motor being selectively actuable to transition the movable diverter plate between the first and second positions.

12. The method of claim 10, wherein the currency processing machine further comprises a base plate disposed between the coin processing unit and the plurality of coin-recycling receptacles and the at least one coin-depositing receptacle, the base plate defining therethrough coin-recycling and coin-depositing ports, wherein each of the automated coin chutes is mounted to the base plate with the coin-recycling and coin-depositing output passages aligned with the coin-recycling and the coin-depositing ports, respectively.

13. The method of claim 10, wherein the currency processing machine further comprises a coin-mixing manifold configured to receive coins sorted by the coin processing unit, recombine the sorted coins, and direct the recombined coins to the at least one coin-depositing receptacle.

14. The method of claim 13, wherein the plurality of automated coin chutes divert coins received from the exit stations to the at least one coin-depositing receptacle via the coin-mixing manifold.

15. The method of claim 10, wherein the at least one coin-depositing receptacle includes first and second coin bins.

16. The method of claim 10, wherein the tote drawer is configured to transition from a stowed position, whereat the tote drawer is disposed at least substantially inside the housing, to an extracted position, whereat the tote drawer is disposed at least partially outside the housing such that the plurality of handheld coin totes can be removed therefrom.

17. The method of claim 16, wherein each of the plurality of handheld coin totes includes a first electrical contact, and the housing includes a second electrical contact configured to cooperate with the first electrical contact to thereby communicate to a system controller a signal indicative of a presence of the coin tote in the tote drawer.

18. The method of claim 17, wherein each of the plurality of handheld coin totes includes a third electrical contact, and the housing includes a fourth electrical contact configured to cooperate with the third electrical contact to thereby communicate to the system controller a signal indicating a full coin tote in the tote drawer.

19. The method of claim 10, wherein each of the plurality of tote compartments includes a post for insertion within the base portion of, and to align, one of the plurality of handheld coin totes when removably seated, and wherein the post acts as a ground for static electricity of incoming coins.

20. The method of claim 10, further comprising, in response to the detecting that the common axis is blocked, receiving, by a system controller of the currency processing machine, a signal indicating the common axis is blocked.

* * * * *